US007406764B2

(12) United States Patent
Takayama et al.

(10) Patent No.: US 7,406,764 B2
(45) Date of Patent: Aug. 5, 2008

(54) METHOD OF DETERMINING THE ACCEPTABILITY OF THE PRESS CONTACTING OF A TERMINAL USING REFERENCE DATA

(75) Inventors: Tsutomu Takayama, Haibara-gun (JP); Kei Fujimoto, Haibara-gun (JP); Nobuyuki Asakura, Haibara-gun (JP); Shigeru Tanaka, Haibara-gun (JP)

(73) Assignee: Yazaki Corporation, Tokyo (JP)

( * ) Notice: Subject to any disclaimer, the term of this patent is extended or adjusted under 35 U.S.C. 154(b) by 494 days.

(21) Appl. No.: 10/811,977

(22) Filed: Mar. 30, 2004

(65) Prior Publication Data

US 2005/0217108 A1 Oct. 6, 2005

(51) Int. Cl.
*H01R 43/04* (2006.01)

(52) U.S. Cl. ..... 29/866; 29/865; 29/857; 29/33 F; 29/33 M; 29/745; 29/747; 29/748; 29/750; 73/865.9

(58) Field of Classification Search ..... 29/863, 29/854, 861, 865, 866, 867, 33 F, 33 M, 745, 29/747, 748, 749, 750, 751, 753, 761; 72/416, 72/16.2, 16.8, 17.3; 73/81–87, 760, 849, 73/865.9

See application file for complete search history.

(56) References Cited

U.S. PATENT DOCUMENTS 5,271,254 A * 12/1993 Gloe et al. ..... 72/13.2

FOREIGN PATENT DOCUMENTS

JP 2001-159514 A 6/2001
JP 2001-183251 A 7/2001

* cited by examiner

*Primary Examiner*—Rick K Chang
(74) *Attorney, Agent, or Firm*—Sughrue Mion, PLLC

(57) ABSTRACT

A method of determining the acceptability of a press contact of a wire between press contact blades of a terminal. The method includes the steps of storing a reference data of a relationship between displacements of the press contact blades when the wire is brought into press contact with a normal press contact terminal and contact loads between the press contact blades and the core wire; inserting the wire between the press contact blades of the press contact terminal as an object to be inspected; measuring the displacement of the press contact blades caused by the insertion of the wire; and determining the acceptability of the press contact terminal as the object to be inspected by predicting the contact loads between the press contact blades of the press contact terminal as the object to be inspected based on the measured displacements and the reference data.

1 Claim, 52 Drawing Sheets

METHOD OF DETERMINING THE ACCEPTABILITY OF THE PRESS CONTACTING OF A TERMINAL USING REFERENCE DATA

BACKGROUND OF THE INVENTION

The present invention relates to a method and an apparatus for determining acceptability of a press contact terminal by predicting contact loads between press contact blades and a core wire when an electric wire is inserted between the press contact blades or the like.

Various electronic apparatus are mounted on an automobile as a vehicle. The automobile is wired with a wire harness for transmitting a predetermined power and signal to the electronic apparatus. The wire harness is provided with a plurality of electric wires and connectors attached to end portions of the electric wires.

The electric wire includes a conductive core wire and an insulating sheath portion for covering the core wire. The connector is provided with a terminal metal piece attached to the electric wire and a connector housing containing the terminal metal piece. The terminal metal piece is made of a conductive drawn sheet or the like. The terminal metal piece is electrically connected to the core wire of the electric wire. The connector housing is made of an insulating synthetic resin and formed in a box-like shape.

The wire harness having the above-described constitution transmits a predetermined power and signal to respective electronic apparatus by coupling to wire the connector with a connector provided at the above-described electronic apparatus.

There is a case of using a press contact terminal as a terminal metal piece of the wire harness. The press contact terminal is provided with a bottom wall for positioning the core wire of the electric wire on a surface thereof, a pair of side walls erected from opposite edges of the bottom wall and press contact blades extended from respectives of the pair of side walls in directions of approaching each other. The press contact terminal is inserted with the electric wire between the press contact blades. Then, the press contact blades are brought into contact with the core wire by cutting the sheath portion. In this way, the press contact terminals are electrically connected to the electric wire, that is, brought into press contact with the electric wire. The press contact terminals are attached to the connector housing.

At this occasion, there is a case in which when the electric wire is inserted between the press contact blades, an interval between the pair of side walls of the press contact terminals is expanded after having been brought into press contact therewith. Therefore, when the electric wire is inserted between the press contact blades, the press contact blades are brought into contact with the core wire by cutting the sheath portion and therefore, in inserting the electric wire between the press contact blades, a load in a direction of hampering the insertion is generated. Therefore, in a press contact apparatus or the like for inserting the electric wire between the press contact blades, the electric wire is inserted between the press contact blades by a force exceeding the load.

When the load is excessively increased, it is conceivable that the press contact terminal is abnormally deformed or chipped off. In a state of attaching the press contact terminal to the connector housing, it is conceivable that the connector housing is destructed.

Therefore, in developing the press contact terminal, a designed press contact terminal is trially produced, the electric wire is actually inserted between the press contact blades and the load and the expansion of the interval between the side walls are measured. A relationship between the load and the expansion of the interval between the side walls is calculated and acceptability of design of the press contact terminal is determined based on the relationship.

A the time of a mass production after completing the design, the press contact terminal is brought into press contact with the electric wire and contained in the connector housing to constitute the wire harness. In order to maintain/improve quality of the wire harness, even in the case of the press contact terminal in mass production, it is desired to calculate the relationship between the expansion of the interval between the side walls and the load in bringing the electric wire into press contact therewith. It is desired to determine acceptability of the press contact terminal based on the relationship.

The loads are based on contact loads between the core wire and the press contact blades. Various measuring apparatus (refer to, for example, Patent Reference 1) have been proposed to measure the loads, that is, the contact loads.

The measuring apparatus is provided with strain gage type load cells (hereinafter, referred to as load cells) on outer sides of respectives of the pair of side walls of the trially produced press contact terminal. Front ends of the load cells are brought into contact with outer faces of the side walls of the press contact terminal before press contact. The measuring apparatus measures the contact loads by inserting the electric wire between the press contact blades and measuring loads applied on the load cells.

Patent Reference 1

JP-A-2001-183251

In an actual press contact terminal, when an electric wire is inserted between press contact blades, a pair of side walls are separated from each other. However, in the measuring apparatus, the front ends of the load cells are brought into contact with the outer faces of the side walls and therefore, even when the electric wire is inserted between the press contact blades, the pair of side walls are made to be difficult to separate from each other. Therefore, the loads applied on the load cells tend to be larger than the contact loads between the press contact blades and the core wire of the actual press contact terminal.

Therefore, when the measuring apparatus of the related art is used, the contact loads between the press contact blades and the core wire cannot accurately be measured. When the measuring apparatus of the related art is used, the side walls are made to be difficult to separate from each other and therefore, it is naturally difficult to accurately measure the expansion of the interval between the side walls. Therefore, when the measuring apparatus having the load cells is used, not only the contact loads between the press contact blades and the core wire cannot accurately be measure but also the expansion of the pair of side walls, that is, the expansion of the press contact blades cannot accurately be measured. Therefore, when the measuring apparatus provided with the load cells is used, it is difficult to accurately determine acceptability of the press contact terminal.

On the other hand, when the press contact terminals are brought into press contact with the electric wire, since the electric wire is press fit between the press contact blades, an interval between the pair of side walls of the press contact terminal may be widened.

It is conceivable that when the interval between the pair of side walls is excessively expanded, the press contact terminal is abnormally deformed or chipped off. It is conceivable that in a state in which the press contact terminal is attached to the connector housing, the connector housing is destructed.

Therefore, in developing the press contact terminal, a designed press contact terminal is trially produced, the electric wire is actually press fit between the press contact blades and expansion of the interval between the pair of side walls is measured. In order to measure expansion of the interval between the pair of side walls of the press contact terminal, there is proposed a measuring method for measuring expansion of the interval between the pair of side walls by measuring respective displacements of the pair of side walls by using, for example a laser displacement meter (refer to, for example, Patent Reference 2).

According to the measuring method, a pair of the laser displacement meters are provided. A displacement of one of the side walls is measured by irradiating laser to one of the side walls by one of the laser displacement meters. A displacement of other of the side walls is measured by irradiating laser to other of the side walls by other of the laser displacement meters. In this way, according to the measuring method, expansion of the interval between the pair of side walls is measured.

Patent Reference 2

JP-A-2001-159514

An angle made by a surface of the bottom wall and a surface of the side wall is changed before press contact and after press contact, that is, the side walls are inclined by bringing the electric wire into press contact therewith. Therefore, according to the measuring method described in the publication, a portion of the side wall on which laser impinges is shifted before press contact and after press contact. Therefore, it is conceivable that the laser displacement meter cannot accurately measure the displacement of the side wall. An incident angle and an emitting angle of laser relative to the side wall is changed before contact and after contact and therefore, it is conceivable that the laser displacement meter cannot measure the displacement of the side wall further accurately.

SUMMARY OF THE INVENTION

Therefore, it is an object of the invention to provide a method and an apparatus of determining acceptability of a press contact terminal capable of accurately determining acceptability of a press contact terminal for inserting an electric wire between press contact blades.

It is another object of the invention to provide a method and an apparatus of measuring a width of a press contact terminal in press contact capable of accurately measuring a width of a press contact terminal in which an electric wire is press fit between the press contact blades.

It is further another object of the invention to provide a method and an apparatus of grasping a press contact state of a press contact terminal capable of accurately grasping a press contact state of a press contact terminal in which an electric wire is inserted between press contact blades thereof.

In order to solve the aforesaid object, the invention is characterized by having the following arrangement.

(1) A method of determining acceptability of a press contact terminal including press contact blades which are separated from each other when the wire is inserted between the press contact blades so that a core wire of the wire is electrically connected to the press contact terminal, the method comprising the steps of:

storing a reference data showing a relationship between displacements of the press contact blades when the wire is brought into press contact with a normal one of the press contact terminal and contact loads between the press contact blades and the core wire;

inserting a detector which produces information in accordance with contact loads generated when the press contact blades are brought into contact with the core wire between the press contact blades of the press contact terminal as an object to be inspected;

acquiring a characteristic data showing a relation ship between the information in accordance with the contact loads produced by the detector and displacements of the press contact blades caused by the insertion of the detector; and determining an acceptability of the press contact terminal as the object to be inspected based on the characteristic data and the reference data.

(2) The method according to Claim 1, wherein a width of the detector in a direction of aligning the press contact blades is equal to or larger than an interval between the press contact blades and equal to or smaller than an outer diameter of the core wire.

(3) A method of determining acceptability of a press contact terminal including press contact blades which are separated from each other when the wire is inserted between the press contact blades so that a core wire of the wire is electrically connected to the press contact terminal, the method comprising the steps of:

storing a reference data showing a relationship between displacements of the press contact blades when the wire is brought into press contact with a normal one of the press contact terminal and contact loads between the press contact blades and the core wire;

inserting the wire between the press contact blades of the press contact terminal as an object to be inspected;

measuring the displacement of the press contact blades caused by the insertion of the wire; and determining the acceptability of the press contact terminal as the object to be inspected by predicting the contact loads between the press contact blades of the press contact terminal as the object to be inspected based on the measured displacements and the reference data.

(4) An apparatus of determining acceptability of a press contact terminal including press contact blades which are separated from each other when the wire is inserted between the press contact blades so that a core wire of the wire is electrically connected to the press contact terminal, the apparatus comprising:

a storing unit which stores a reference data showing a relationship between displacements of the press contact blades when the core wire is brought into press contact with a normal one of the press contact terminal and contact loads between the press contact blades and the core wire;

a detector adapted to be inserted between the press contact blades to produce information in accordance with the contact loads between the press contact blades and the detector;

a calculating unit which calculates the contact loads based on the information produced by the detector;

a measuring unit which measures the displacements of the press contact blades caused by the insertion of the detector;

a forming unit which forms a characteristic data showing a relationship between the contact loads calculated by the calculating unit and the displacements of the press contact blades measured by the measuring unit; and a determining unit which determines the acceptability of the press contact terminal based on the characteristic data and the reference data.

(5) The apparatus according to (4), wherein the measuring unit includes:

a light emitting portion which emits light, an image pickup portion which picks up an image by receiving the light from the light emitting portion and positions the press contact terminal between the light emitting portion and the image pickup portion in a state that an optical axis of the light emitted by the light emitting portion and a longitudinal direction of the wire inserted between the press contact blades are in parallel with each other, and a processing portion which calculates the displacements of the press contact blades based on an outer shape of the press contact blades, an image of which is picked up by the image pickup portion.

(6) The apparatus according to (5), wherein the detector includes a piezoelectric element capable of being in contact with the press contact blades, the calculating unit calculates the contact loads based on an output current from the piezoelectric element, and a width of the piezoelectric element in a direction of aligning the press contact blades is equal to or larger than an interval between the press contact blades and equal to or smaller than an outer diameter of the core wire.

(7) The apparatus according to (5), wherein the detector includes a rotor inserted between the press contact blades and is rotated by a drive source, the calculating unit calculates the contact loads based on a torque of a rotation of the rotor, and both of a minimum width and a maximum width of the rotor in a direction of aligning the press contact blades are equal to or larger than an interval between the press contact blades and equal to or smaller than an outer diameter of the core wire.

(8) An apparatus of determining acceptability of a press contact terminal including press contact blades which are separated from each other when the wire is inserted between the press contact blades so that a core wire of the wire is electrically connected to the press contact terminal, the apparatus comprising:

a storing unit which stores a reference data showing a relationship between displacements of the press contact blades when the wire is brought into press contact with a normal one of the press contact terminal and contact loads between the press contact blades and the core wire;

an inserting unit which holds the press contact terminal as an object to be inspected and inserts the wire between the press contact blades of the press contact terminal;

a measuring unit which measures the displacement of the press contact blades caused by the insertion of the wire; and a predication determining unit which determines the acceptability of the press contact terminal by predicting the contact loads between the press contact blades of the press contact terminal as the object to be inspected and the core wire based on the displacement of the press contact blades measured by the measuring unit and the reference data stored in the storing unit.

(9) The apparatus according to (5), wherein the measuring unit includes:

a light emitting portion which emits light;

an image pickup portion which picks up an image by receiving the light from the light emitting portion and positioning the press contact terminal between the light emitting portion and the image pickup portion in a state in which an optical axis of the light emitted by the light emitting portion and a longitudinal direction of the wire inserted between the press contact blades are in parallel with each other; and a processing portion which calculates the displacements of the press contact blades based on an outer shape of the press contact blades, an image of which are picked up by the image pickup portion.

(10) An apparatus of determining acceptability of a press contact terminal including press contact blades which are separated from each other when the wire is inserted between the press contact blades so that a core wire is electrically connected to the press contact terminal, the apparatus comprising:

a storing unit which stores a reference data showing a relationship between displacements of the press contact blades when the wire is brought into press contact with a normal one of the press contact terminal and contact loads between the press contact blades and the core wire;

an inserting unit which holds the press contact terminal as an object to be inspected and inserts the wire between the press contact blades of the press contact terminal;

a measuring unit which measures the displacement of the press contact blades caused by the insertion of the wire; and a predication determining unit which determines the acceptability of the press contact terminal by predicting the contact loads between the press contact blades of the press contact terminal as the objected to be inspected and the core wire based on the displacement measured by the measuring unit and the reference data stored by the storing unit.

(11) An apparatus of determining acceptability of a press contact terminal including press contact blades which are separated from each other when the wire is inserted between the press contact blades so that a core wire of the wire is electrically connected to the press contact terminal, the apparatus comprising:

a storing unit which stores a reference data showing a relationship between displacements of the press contact blades and contact loads between the press contact blades and the core wire when the wire is brought into press contact with a normal one of the press contact terminal;

a holding unit which holds the press contact terminal;

a detector adapted to be inserted between the press contact blades to produce information in accordance with the contact loads between the press contact blades and the detector;

a calculating unit which calculates the contact loads between the press contact blades and the detector when the detector is inserted between the press contact blades of the press contact terminal held by the holding unit;

a measuring unit capable of measuring the displacements of the press contact blades caused by the insertion of the detector between the press contact blades and the displacements of the press contact blades caused by insertion of the wire between the press contact blades;

a forming unit which forms a characteristic data showing a relationship between the contact loads calculated by the calculating unit and the displacements of the press contact blades measured by the measuring unit;

a determining unit which determines the acceptability of the press contact terminal as an object to be inspected based the characteristic data formed by the forming unit and the reference data stored in the storing unit;

an inserting unit which holds the press contact terminal as the object to be inspected and inserts the wire between the press contact blades of the press contact terminal; and a prediction determining unit which determines the acceptability of the press contact terminal by predicting the contact loads between the press contact blades of the press contact terminal as the object to be inspected and the core wire based on the displacements of the press contact blades caused by the insertion of the wire between the press contact blades and the reference data stored in the storing unit.

(12) The apparatus according to (11), wherein the measuring unit includes:

a light emitting portion which emits light;

an image pickup portion which picks up an image by receiving the light from the light emitting portion and positioning the press contact terminal held by one of the holding portion and the inserting unit between the light emitting portion and the image pickup portion in a state in which an optical axis of the light emitted by the light emitting portion and a longitudinal direction of the wire inserted between the press contact blades are in parallel with each other; and a processing portion which calculates the displacements of the press contact blades from an outer shape of the press contact blades, an image of which is picked up by the image pickup portion.

(13) The apparatus according to (11), wherein the detector includes a piezoelectric element capable of being in contact with the press contact blades, the calculating unit calculates the contact loads based on an output current from the piezoelectric element, and a width of the piezoelectric element in a direction of aligning the press contact blades is equal to or larger than an interval between the press contact blades and equal to or smaller than an outer diameter of the core wire.

(14) The apparatus according to (11), wherein the detector includes a rotor inserted between the press contact blades and is rotated by a drive source, the calculating unit calculates the contact loads based on a torque of a rotation of the rotor, and both of a minimum width and a maximum width of the rotor in a direction of aligning the press contact blades are equal to or larger than an interval between the press contact blades and equal to or smaller than an outer diameter of the core wire.

(15) The apparatus according to (12), wherein the detector includes an expander inserted between the press contact blades and expanded by supplying a pressurized fluid from a pressurized fluid supply source, the calculating unit calculates the contact loads based on a pressure of the pressurized fluid supplied to the expander and the outer shape of the press contact blades, and a maximum width of the expander in a direction of aligning the press contact blades is equal to or larger than an interval between the press contact blades and equal to or smaller than an outer diameter of the core wire.

(16) A method of measuring a width of a press contact terminal in a press contact state, wherein the press contact terminal includes a bottom wall on which a wire is to be placed, a pair of side walls erected from opposite edges of the bottom wall and opposed to each other with an interval, and press contact blades respectively extended from the side walls in directions of approaching each other, the method comprising the steps of:

acquiring an outer shape of the wire, the pair of side walls and the press contact blades viewed from a position along a longitudinal direction of the press contact terminal with which the wire is brought into press contact;

calculating a center of the wire based on the acquired outer shape; and calculating a distance between outer faces of the pair of side walls in a direction passing the calculated center and along the bottom wall.

(17) An apparatus of measuring a width of a press contact terminal in a press contact state, wherein the press contact terminal includes a bottom wall on which a wire is to be placed, a pair of side walls erected from opposite edges of the bottom wall and opposed to each other with an interval, and press contact blades respectively extended from the side walls in directions of approaching each other, the apparatus comprising:

a light emitting portion which emits light;

an image pickup portion which picks up an image by receiving the light from the light emitting portion;

a terminal holding portion which holds the press contact terminal provided between the light emitting portion and the image pickup portion and press fit with the wire between the press contact blades in a state in which an optical axis of the light emitted by the light emitting portion and a longitudinal direction of the wire are in parallel with each other; and a processing portion which calculates a center of the wire based on an outer shape of the press contact terminal the image of which is picked up by the image pickup portion and calculates a distance between outer faces of the pair of side walls in a direction passing the center and along of the bottom wall.

(18) A method of grasping a press contact state of a press contact terminal including press contact blades which are separated from each other when the wire is inserted between the press contact blades so that a core wire of the wire is electrically connected to the press contact terminal, the method comprising the steps of:

inserting a detector between the press contact blades to produce information in accordance with contact loads generated when the detector is inserted between the press contact blades; and grasping the contact loads based on the information produced by the detector.

(19) The method according to (18), wherein the press contact blades are displaced in direction separating from each other when the wire is inserted to therebetween, and a relationship between the contact loads and the displacements is grasped by measuring the displacement of the press contact blades.

(20) The method according to (18), wherein a width of the detector in a direction of aligning the press contact blades is equal to or larger than an interval between the press contact blades and equal to or smaller than an outer diameter of the core wire.

(21) An apparatus of grasping a press contact state of a press contact terminal including press contact blades which are separated from each other when the wire is inserted between the press contact blades so that a core wire of the wire is electrically connected to the press contact terminal, the apparatus comprising:

a detector which produces information in accordance with contact loads between the press contact blades and the detector by being brought into contact with the press contact blades; and a calculating unit which calculates the contact loads based on the information produced by the detector, wherein the calculating unit calculates the contact loads by inserting the detector between the press contact blades.

(22) The apparatus according to (21), wherein the press contact blades are displaced in directions of separating from each other when the wire is inserted to therebetween, further comprising:

a measuring unit capable of measuring displacements of the press contact blades caused by the insertion of the detector between the press contact blades, wherein the measuring unit grasps a relationship between the contact loads and the displacements by measuring the displacements of the press contact blades.

(23) The apparatus according to (22), wherein the measuring unit includes:

a light emitting portion which emits light;

an image pickup portion which picks up an image by receiving the light from the light emitting portion;

a holding portion provided between the light emitting portion and the image pickup portion, which holds the press contact blades in a state in which an optical axis of the light emitted by the light emitting portion and a longitudinal direction of the wire inserted between the press contact blades are in parallel with each other; and a processing portion which calculates the displacements of the press contact blades from an outer shape of the press contact blades the image of which are picked up by the image pickup portion.

(24) The apparatus according to (21), wherein the detector includes a piezoelectric element capable of being brought into contact with the press contact blades, the calculating unit calculates the contact loads based on an output current from the piezoelectric element, and a width of the piezoelectric element in a direction of aligning the press contact blades is equal to or larger than an interval between the press contact blades and equal to or smaller than an outer diameter of the core wire.

(25) The apparatus according to (21), wherein the detector includes a rotor inserted between the press contact blades and is rotated by a drive source, the calculating unit calculates the contact loads based on a torque of a rotation of the rotor, and both of a minimum width and a maximum width of the rotor in a direction of aligning the press contact blades are equal to or larger than an interval between the press contact blades and equal to or smaller than an outer diameter of the core wire.

(26) The apparatus according to (23), wherein the detector includes an expander inserted between the press contact blades and expanded by supplying a pressurized fluid from a pressurized fluid supply source, the calculating unit calculates the contact loads based on a pressure of the pressurized fluid supplied to the expander and the outer shape of the press contact blades, and a maximum width of the expander in a direction of aligning the press contact blades is equal to or larger than an interval between the press contact blades and equal to or smaller than an outer diameter of the core wire.

DETAILED DESCRIPTION OF PREFERRED EMBODIMENTS

First Embodiment

Figure 1:
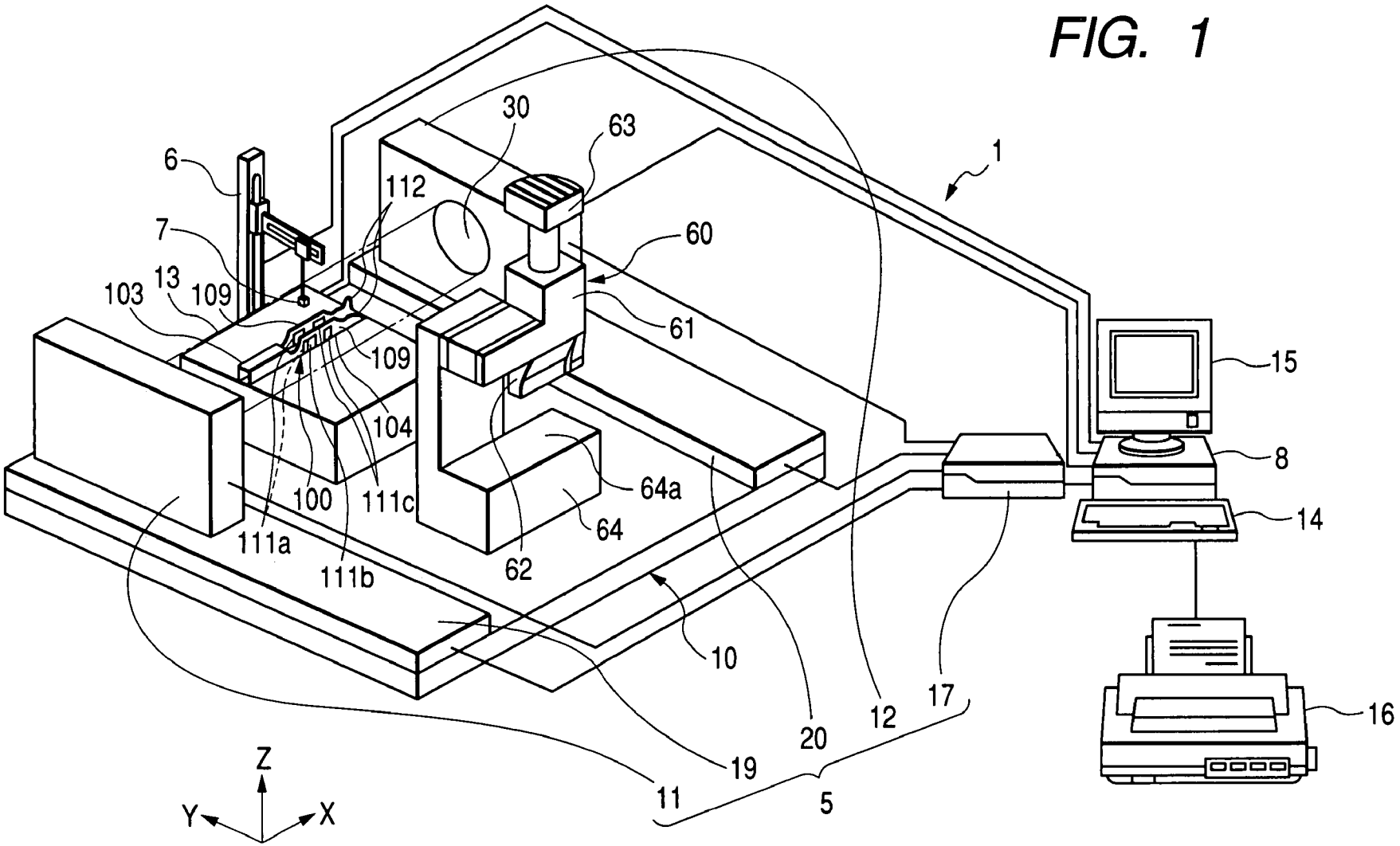
FIG. 1 is an explanatory view showing a constitution of a determining apparatus according to a first embodiment of the invention.

An explanation will be given of an apparatus of determining acceptability of a press contact terminal (hereinafter, simply referred to as determining apparatus) 1 according to a first embodiment of the invention in reference to FIG. 1 through FIG. 27. The determining apparatus 1 shown in, for example FIG. 1, FIG. 2 brings an electric wire 2 (shown in FIG. 10, for example) into contact with a press contact terminal 100 shown in FIG. 12 to determine acceptability of the press contact terminal 100.

The determining apparatus 1 is stored with a relationship (shown in FIG. 21) between an expansion amount (also referred to as displacement) of a pair of side walls 109, that is, press contact blades 111*a*, 111*b*, 111*c*, mentioned later, when the electric wire 2 is brought into press contact with a normal one of the press contact terminal 100, and a sum of contact loads P1, P2 (shown in FIG. 9) between a core wire 3 of the electric wire 2 and the press contact blades 111*a*, 111*b*, 111*c*. The relationship between the displacement of the press contact blades 111*a*, 111*b*, 111*c* and the sum of the contact loads P1, P2 shown in FIG. 21 by a bold line KD constitutes a reference data described in the specification. Hereinafter, the relationship shown in FIG. 21 by the bold line is referred to as reference data KD.

The determining apparatus 1 inserts a piezoelectric element 7, mentioned later, between the press contact blades 111*b* of the press contact terminal 100 as an object to be inspected and measures the contact loads P1, P2 (shown in FIG. 17) between the piezoelectric element 7 and the press contact blades 111*b*. The contact loads P1, P2 which can be measured by inserting the piezoelectric element 7 between the press contact blades 111*b* constitute the contact loads P1, P2 between the press contact blades 111*b* and the core wire 3 produced when the electric wire 2 is inserted between the press contact blades 111*b*.

The determining apparatus 1 inserts the piezoelectric element 7 between the press contact blades 111*b* of the press contact terminal 100 as the object to be inspected to measures an amount of separating the pair of side walls 109 from each other. The amount of separating the pair of side walls 109 from each other constitutes the displacement of the press contact blades 111*a*, 111*b*, 111*c*. The determining apparatus 1 calculates a relationship between the sum of the contact loads P1, P2 and the amount of separating the pair of side walls 109 from each other which are measured and shown in FIG. 22 by a one-dotted chain line TD. The relationship between the sum of the contact loads P1, P2 and the amount of separating the pair of side walls 109 from each other which are measured and shown in the drawing by the one dotted chain line TD constitutes a characteristic data described in the specification. Hereinafter, the relationship shown in FIG. 22 by the one-dotted chain line is referred to as the characteristic data TD.

The determining apparatus 1 determines acceptability of the press contact terminal 100 as the object to be inspected based on the reference data KD and the characteristic data TD.

The determining apparatus 1 brings the electric wire 2 into press contact with the press contact terminal 100 as the object to be inspected. The determining apparatus 1 measures an amount of separating the pair of side walls 109 from each other when the electric wire is brought into press contact with the press contact terminal 100. The amount of separating the side walls 109 from each other constitutes the displacements of the press contact blades 111*a*, 111*b*, 111*c*. The determining apparatus 1 predicts a contact load Ps (shown in FIG. 27) between the core wire 3 of the electric wire 2 and the press contact blades 111*a*, 111*b*, 111*c* based on the reference data KD and a measured amount Hs of separating the pair of side walls 109 from each other (shown in FIG. 27). The determining apparatus 1 determines acceptability of the press contact terminal 100 based on the predicted contact load Ps.

Figure 11:
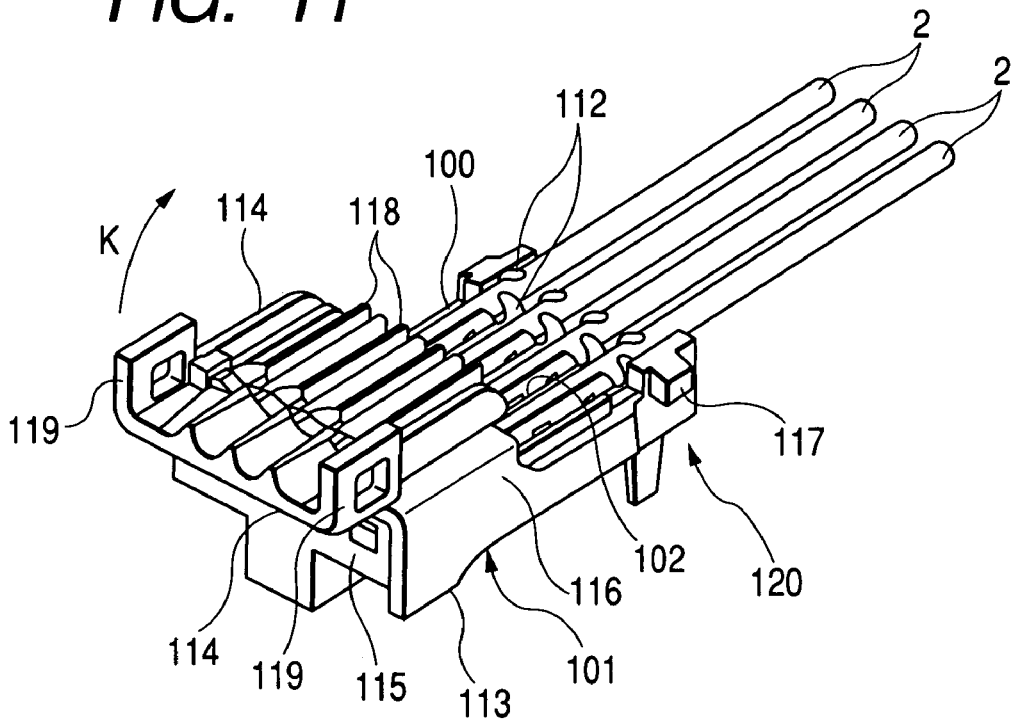
FIG. 11 is a perspective view of a state of attaching the press contact terminal to the connector housing shown in FIG. 10.
Figure 12:
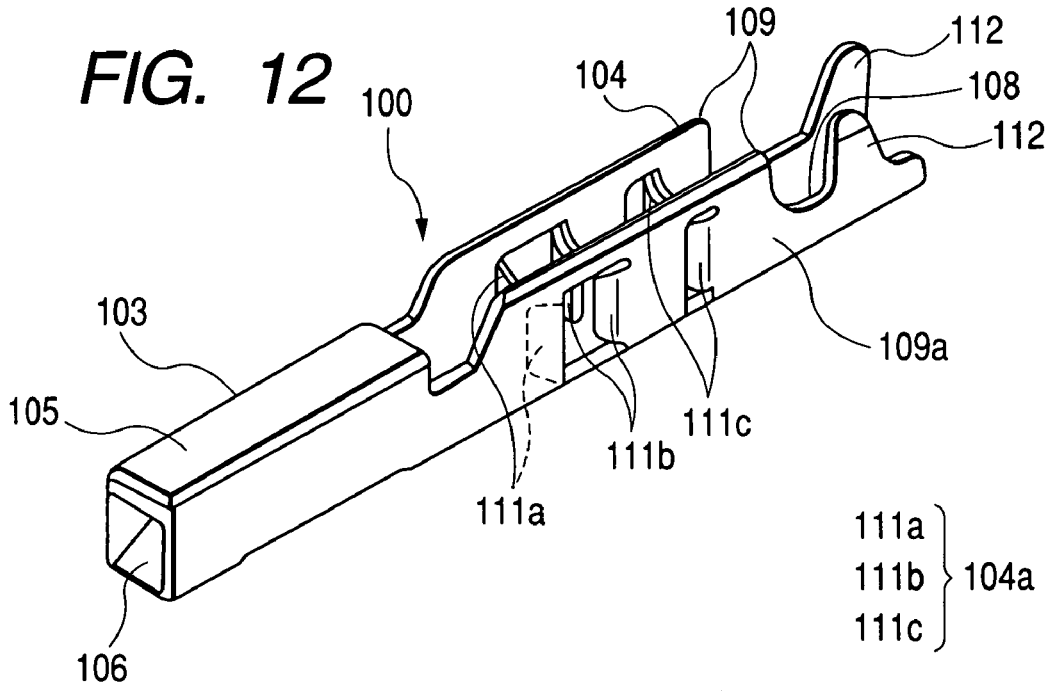
FIG. 12 is a perspective view of the press contact terminal shown in FIG. 10.
Figure 13:
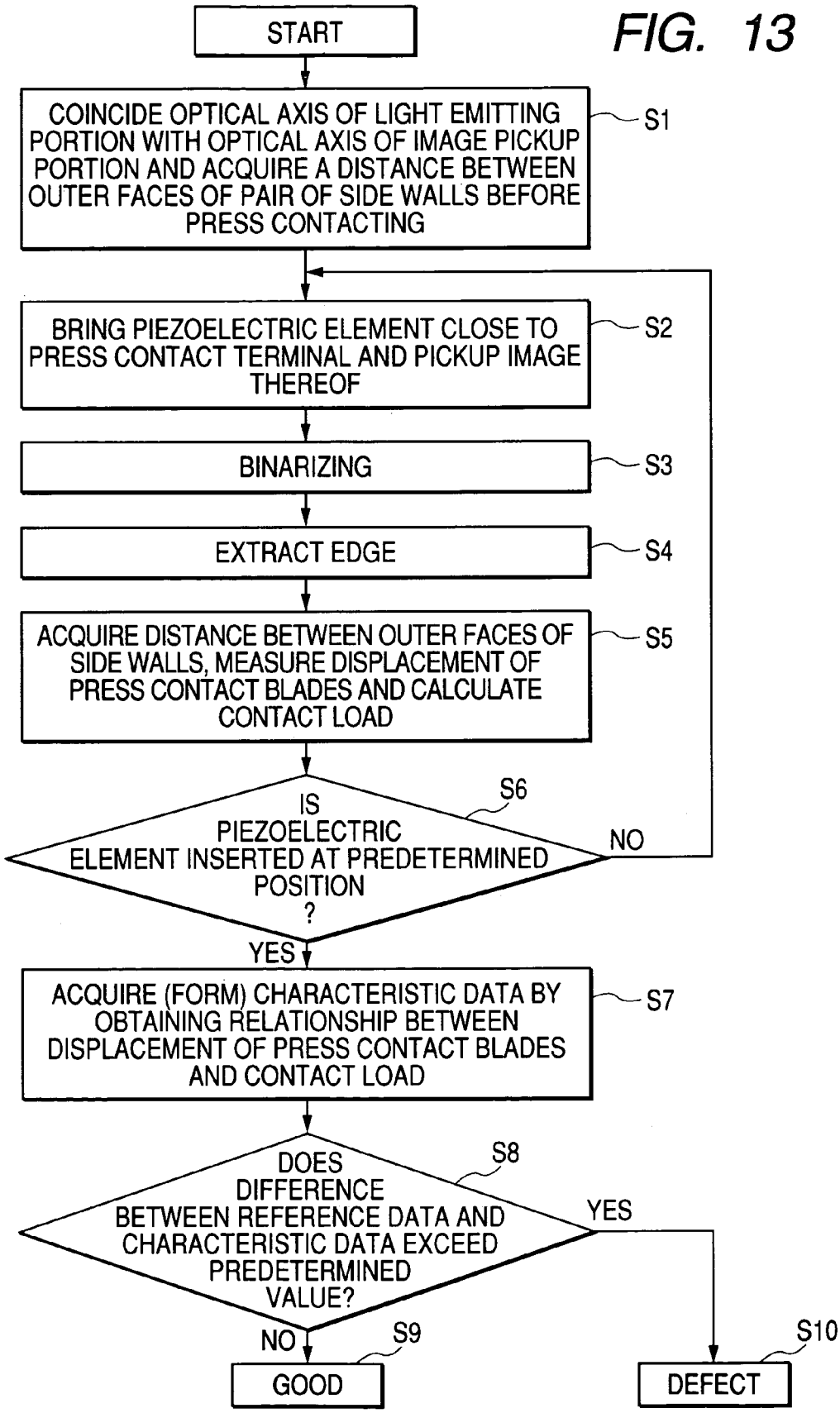
FIG. 13 is a flowchart showing a procedure of inserting a piezoelectric element between press contact blades and determining acceptability of the press contact terminal by the determining apparatus shown in FIG. 1.

The press contact terminal 100 shown in FIG. 12 is brought into press contact with the electric wire 2 and attached to a connector housing 101 to constitute a connector 120 shown in FIG. 11.

Figure 10:
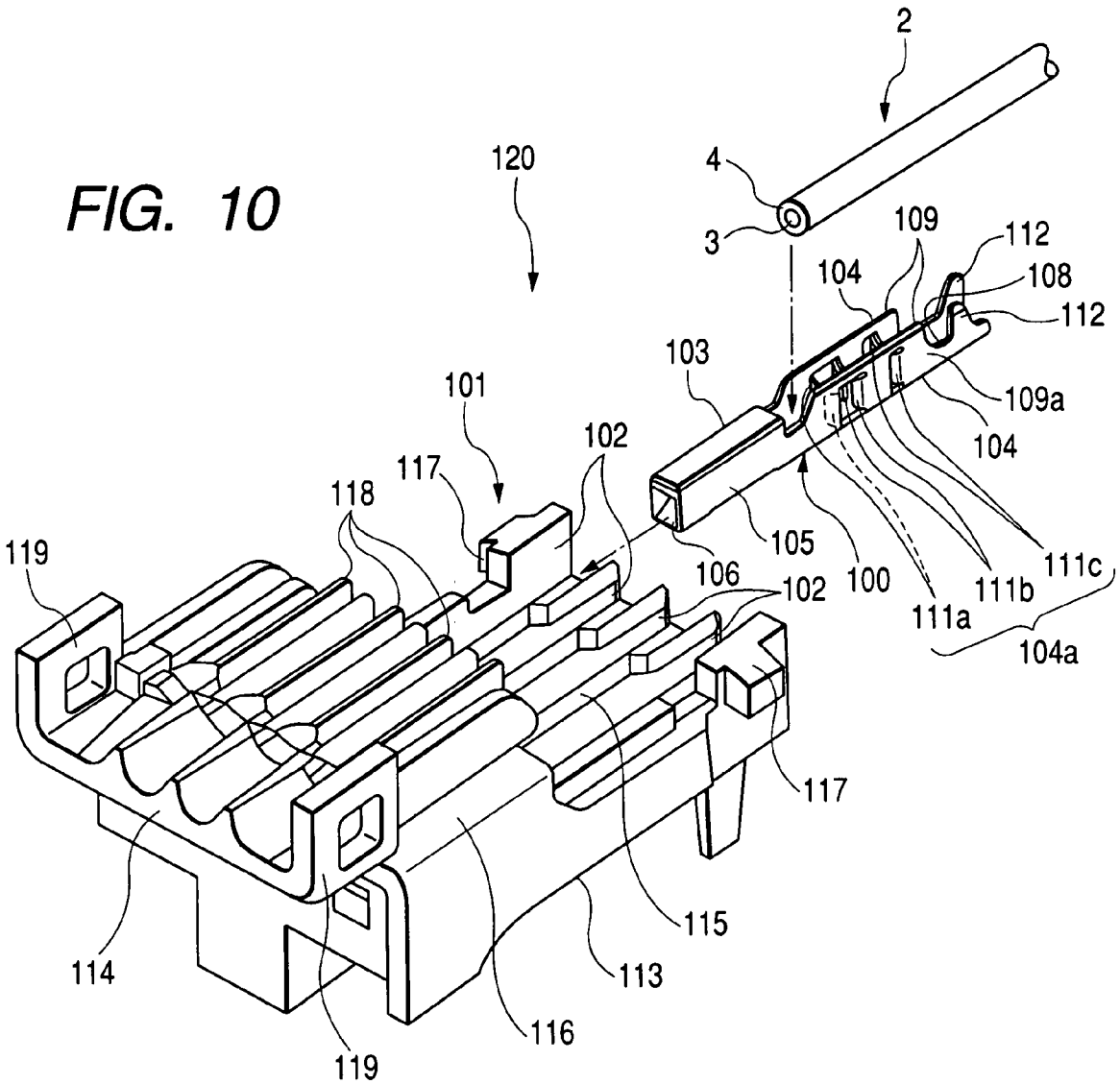
FIG. 10 is a perspective view showing the press contact terminal having the electric wire connecting portion shown in FIG. 6 and the connector housing attached with the press contact terminal.

As shown in, for example, FIG. 10, the electric wire 2 is provided with the conductive core wire 3 and a sheath portion 4 for covering the core wire 3. The core wire 3 is formed by twisting a plurality of strands comprising a conductive metal. The core wire 3 is formed in a circular shape in a sectional shape thereof intersecting with a longitudinal direction thereof. The sheath portion 4 is made of an insulating synthetic resin. The sheath portion 4 is formed in a shape of a circular tube in a sectional shape thereof intersecting with the longitudinal direction of the core wire 3. The electric wire 2 is formed in a circular shape in a section thereof by the core wire 3 and the sheath portion 4.

The connector housing 101 is made of an insulating synthetic resin. As shown by FIG. 10 and FIG. 11, the connector housing 101 is provided with a terminal receiving portion 113 and a cover 114 connected to the terminal receiving portion 113 via a hinge.

The terminal receiving portion 113 is provided with a plate portion 115 substantially in a rectangular shape, a plurality of terminal receiving grooves 102 and a ceil wall 116 opposed to the plate portion 115 with an interval therebetween. The plate portion 115 is provided with a lock groove or a lock arm, not illustrated, for preventing the press contact terminal 100 inserted into the terminal receiving groove 102 from drawing out.

The terminal receiving grooves 102 are respectively formed to be recessed from a surface of the plate portion 115 and aligned. The terminal receiving groove 102 is extended substantially in a linear shape. The terminal receiving groove 102 is inserted with the press contact terminal 100 along a longitudinal direction thereof. In the illustrated example, four of the terminal receiving grooves 102 are provided.

The ceil wall 116 is formed substantially in a rectangular shape in a planar shape thereof. The ceil wall 116 exposes an electric wire connecting portion 104 of the press contact terminal 100 contained in the terminal receiving groove 102 and covers an electric contact portion 103. An edge portion of the plate portion 115 remote from the ceil wall 116 is provided with an engaging projection 117 projected in an outer direction.

The cover 114 is provided with a plurality of projected streaks 118 for holding electric wires coinciding with the terminal receiving groove 102 of the terminal receiving portion 113. The cover 114 is provided with a cover lock arm 119 engageable with the engaging projection 117. The cover 114 is made pivotable relative to the terminal receiving portion 113 by a hinge, not illustrated, provided at an edge portion of the ceil wall 116.

According to the connector housing 101, in a state before having been integrated, the terminal receiving groove 102 of the terminal receiving portion 113 and the projected streak 118 of the cover 114 are connected by a band, not illustrated, in a state of disposing opening portions thereof in the same direction. That is, the terminal receiving portion 113 and the cover 114 are connected by the band in a state of turning back the cover 114 relative to the terminal receiving portion 113.

The press contact terminal 100 is provided by bending a conductive sheet metal. As shown by FIG. 12, the press contact terminal 100 is provided with the electric contact portion 103 and the electric wire connecting portion 104.

The electric contact portion 103 is provided with a cylindrical portion 105 in a cylindrical shape and an elastic contact piece 106 for connecting with a male terminal, not illustrated. The cylindrical portion 105 is continuous to a bottom wall 108, mentioned later, and side walls 109 of the electric wire connecting portion 104. The elastic contact piece 106 is provided at inside of the cylindrical portion 105 for urging the male terminal advanced into the cylindrical portion 105 to an inner face of the cylindrical portion 105 to thereby prevent the male terminal from drawing out from the cylindrical portion 105.

The electric wire connecting portion 104 is provided with the bottom wall 108 at which the electric wire 2 is placed on a surface 108*a* (shown in FIG. 6, FIG. 7, for example) thereof, the pair of side walls 109, a press contact portion 104*a* and a pair of fastening pieces 112. The bottom wall 108 is formed substantially in flat strip-like shape at a surface thereof. The side walls 109 are respectively continuous to opposite edges in a width direction of the bottom wall 108. The side walls 109 are respectively erected from the side wall 108 and are opposed to each other with an interval therebetween.

The press contact portion 104*a* is provided with three pairs of the press contact blades 111*a*, 111*b*, 111*c*. The three pairs of press contact blades 111*a*, 111*b*, 111*c* are respectively erected from the bottom wall 108. The pair of press contact blades 111*a*are extended from the side walls 109 in directions of approaching each other. The pair of press contact blades 111*a* are aligned along an arrow mark S in FIG. 6 with an interval therebetween.

The arrow mark S designates the direction in which the pair of side walls 109 are opposed to each other, constitutes a direction of aligning the pair of press contact blades 111*a* described in the specification and is orthogonal to surfaces of the pair of side walls 109. The pair of press contact blades 111*a*are brought into contact with the core wire 3 of the electric wire 2 by cutting the sheath portion 4 of each electric wire 2 of the flat cable 2 by inserting the electric wire 2 therebetween.

The pair of press contact blades 111*b* are extended from the side walls 109 in directions of approaching each other. The pair of press contact blades 111*b* are aligned along the arrow mark S in FIG. 6 with an interval therebetween. The arrow mark S is the direction of opposing the pair of side walls 109 to each other, constitutes the direction of aligning the pair of press contact blades 111*b* described in the specification and is orthogonal to the surfaces of the pair of side walls 109. The pair of press contact blades 111*b* are brought into contact with the core wire 3 of the electric wire 2 by cutting the sheath portion 4 of the electric wire 2 by inserting the electric wire 2 therebetween.

The pair of press contact blades 111*c* are extended from the side walls 109 in directions of approaching each other. The pair of press contact blades 111*c* are aligned along the arrow mark S in FIG. 6 with an interval therebetween. The allow mark S is the direction of opposing the pair of side walls 109 to each other, constitutes the direction of aligning the pair of press contact blades 111*c* described in the specification and is orthogonal to the surface of the pair of side walls 109. The pair of press contact blades 111*c* are brought into contact with the core wire 3 of the electric wire 2 by cutting the sheath portion 4 of the electric wire 2 by inserting the electric wire 2 therebetween. The three pairs of press contact blades 111*a*, 111*b*, 111*c* are electrically connected with the electric wire 2. That is, the three pair of press contact blades 111*a*, 111*b*, 111*c* are brought into press contact with the electric wire 2.

An interval D (shown in FIG. 8, for example) between the pair of press contact blades 111*a* and an interval D (shown in FIG. 16) between the pair of press contact blades 111*b* and an interval between the pair of press contact blades 111*c* are equal. The interval D between the press contact blades 111*a*, 111*b*, 111*c* is narrower than an outer diameter R (shown in FIG. 8, for example) of the core wire 3.

The pair of fastening pieces 112 are continuous to opposite edges in the width direction of the bottom wall 108. The pair of fastening pieces 112 are respectively erected from the bottom wall 108. The pair of fastening pieces 112 are opposed to each other with an interval therebetween. By bending the fastening pieces 112 toward the bottom wall 108, the fastening pieces 112 pinch the electric wire 2 between the bottom wall 108 and the fastening pieces 112. That is, the pair of fastening pieces 112 fasten the electric wire 2. In this way, the pair of fastening pieces 112 fix the electric wire 2 to the electric wire connecting portion 104.

The connector 120 constituted by the connector housing 101 and the press contact terminal 100 is attached to a distal end of the electric wire 2. In attaching the connector to the distal end of the electric wire 2, first, the electric wire is inserted between the press contact blades 111*a*, 111*b*, 111*c* of the press contact portion 104*a* of the press contact terminal 100. Simultaneously with inserting, that is, press contacting the electric wire 2, the fastening pieces 112 are bent toward the bottom wall 108 and the electric wire 2 is fastened by the fastening pieces 112.

Thereafter, the press contact terminal 100 is inserted into the terminal receiving groove 102 along the longitudinal direction of the terminal receiving groove 102. The press contact terminal 100 is fixed (attached) to the connector housing 101 in a state of being contained in the terminal receiving groove 102. The band is removed from the connector housing 101.

In this way, the electric wire 2 is fixed (attached) to the press contact terminal 100. An operator rotates the cover 114 along an arrow mark K in FIG. 11 centering on the hinge. The terminal receiving portion 113 and the cover 114 are fixed to each other by engaging the cover lock arm 119 to the engaging projection 117. In this way, the connector 120 having the constitution is integrated.

Figure 6:
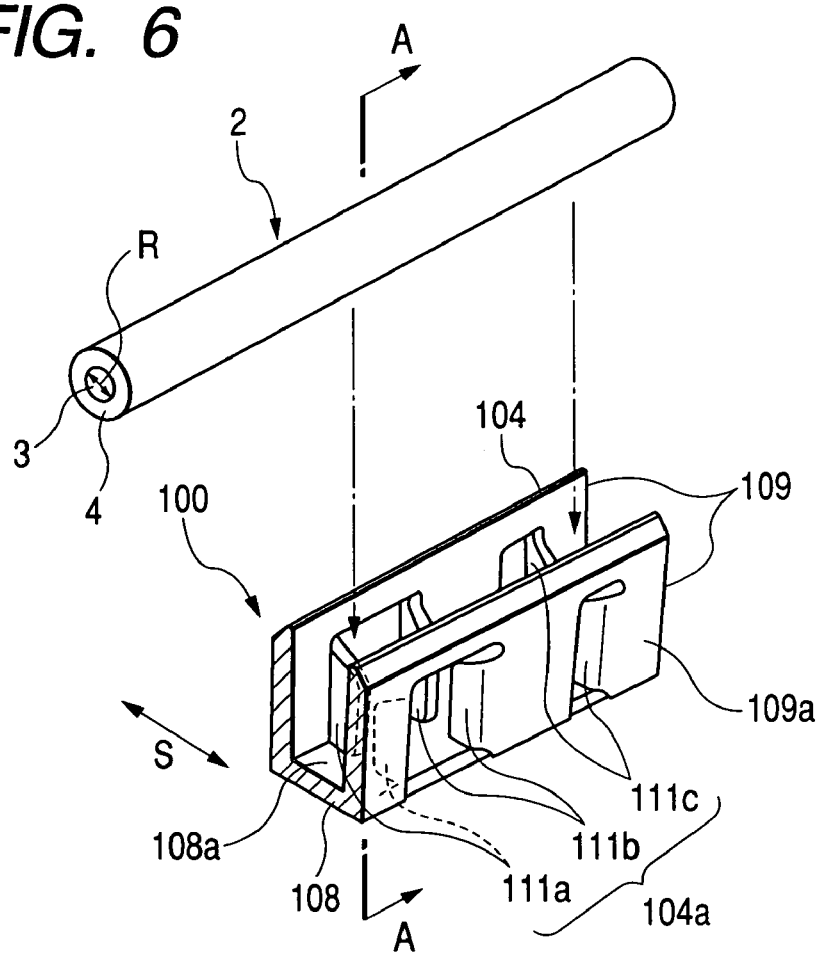
FIG. 6 is a perspective view showing an essential portion of an electric wire connecting portion before press contact of a press contact terminal acceptability of which is determined by the determining apparatuses shown in FIGS. 1, 47 and 56.
Figure 8:
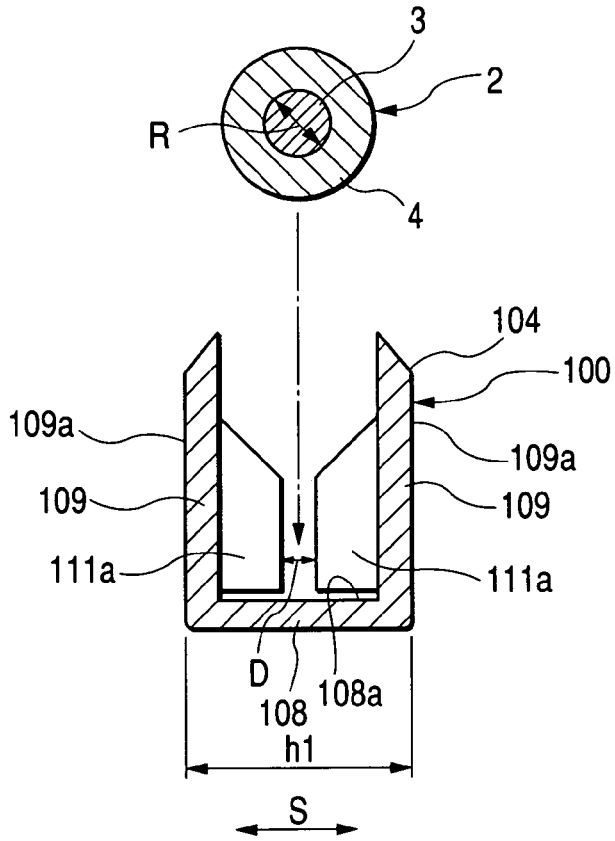
FIG. 8 is a sectional view taken along a line A-A of FIG. 6.

In bringing the electric wire 2 into press contact with the press contact portion 104*a*, that is, the press contact terminal 100, first, as shown by FIG. 6 and FIG. 8, the intervals between the press contact blades 111*a*, 111*b*, 111*c* and the electric wire 2 are made to be opposed to each other. The electric wire 2 is inserted into the intervals between the press contact blades 111*a*, 111*b*, 111*c* along one-dotted chain lines in FIG. 6 and FIG. 8. Then, the press contact blades 111*a*, 111*b*, 111*c* are brought into contact with the core wire 3 by cutting the sheath portion 4 of the electric wire 2.

Figure 7:
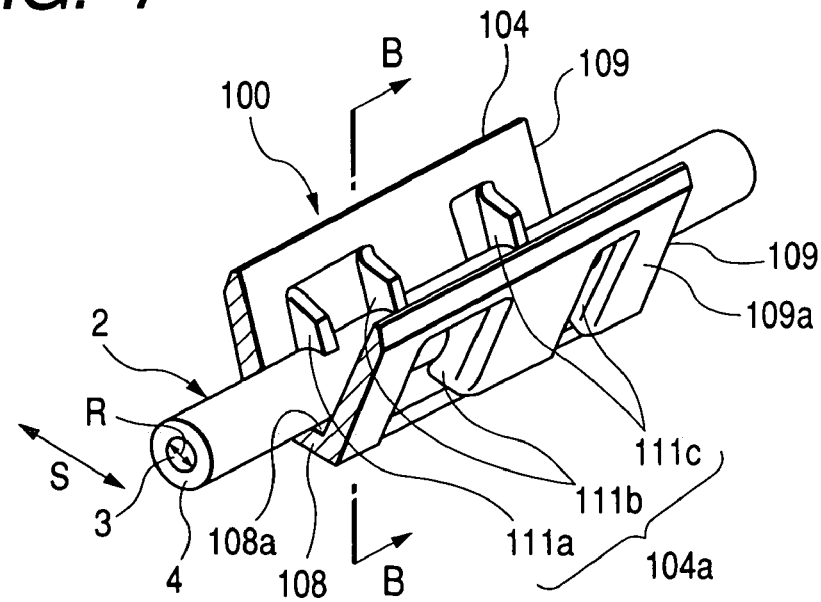
FIG. 7 is a perspective view showing a state of bringing an electric wire into press contact with the electric wire connecting portion of the press contact terminal shown in FIG. 6.
Figure 9:
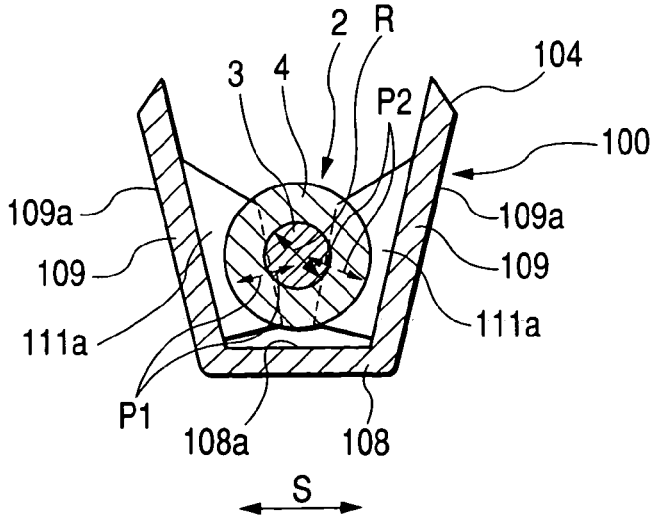
FIG. 9 is a sectional view taken along a line B-B of FIG. 7.

When the electric wire 2 is inserted between the press contact blades 111*a*, 111*b*, 111*c*, as shown by FIG. 7 and FIG. 9, the interval between the pair of side walls 109 is expanded. That is, the pair of side walls 109 are separated from each other. In this way, when the electric wire 2 is brought into press contact therewith, the press contact blades 111*a*, 111*b*, 111*c* are separated from each other. At this occasion, naturally, edges of the side walls 109 remote from the bottom 108 are separated from each other. In FIG. 6 and FIG. 7, only an essential portion of the electric wire connecting portion 104 of the press contact terminal 100 is illustrated and other portion of the press contact terminal 100 is omitted.

In the above explanation of the press contact terminal 100 and the connector housing 101, the electric wire 2 is brought into press contact with the press contact terminal 100 before the press contact terminal 100 is received in the connector housing 101. However, the reverse sequence is performed in some cases, that is, the electric wire 2 is brought into press contact with the press contact terminal 100 after the press contact terminal 100 has been received in the connector housing 101. The description of this sequence will be described.

At the time of attaching the end of the wire 2 to the connector 120, the press contact terminal 100 is firstly inserted in the terminal receiving groove 102 along the longitudinal direction thereof. The press contact terminal 100 is fixed (attached) to the connector housing 100 in a state of being receiving in the terminal receiving groove 102.

Thereafter, the electric wire 2 is brought into press contact with the press contact blades 111*a*, 111*b*, 111*c* of the press contact portion 104*a* of the press contact 100 attached to each terminal receiving groove 102 of the connector housing. At the time of bringing the electric wire 2 into press contact, the fastening pieces 112 are bent toward the bottom wall 108 thereby fastening the electric wire 2. The band is removed from the connector housing 101.

Figure 2:
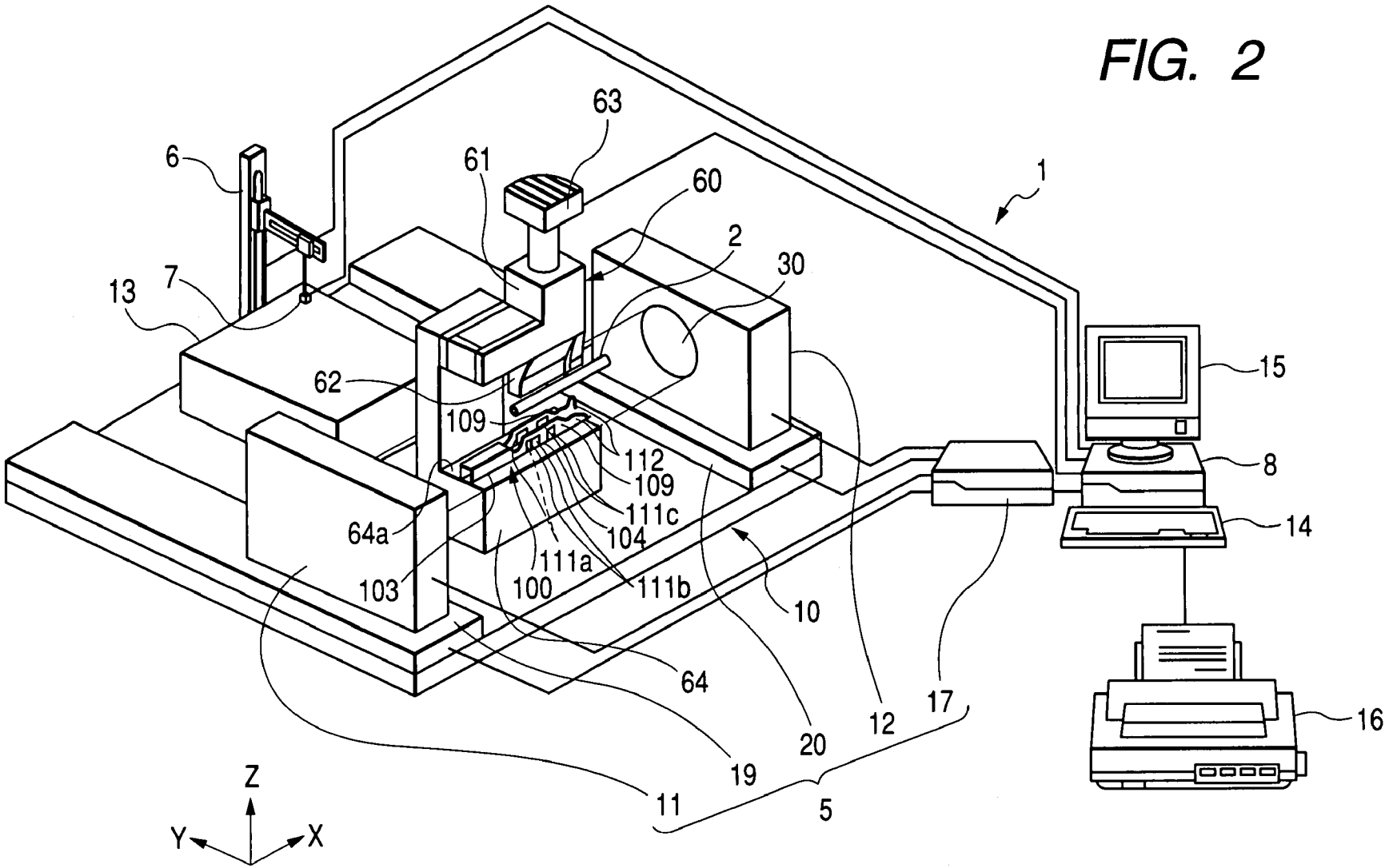
FIG. 2 is an explanatory view showing a state in which a light emitting portion and an image pickup portion of the determining apparatus shown in FIG. 1 are positioned at a second position.

The terminal apparatus 1 shown in FIG. 1, FIG. 2 ad the like reproduces to bring the electric wire 2 between the press contact blades 111*a*, 111*b*, 111*c* of the press contact terminal 100 as the object to be inspected by inserting the piezoelectric element 7 between the press contact blades 111*a*, 111*b*, 111*c*. The determining apparatus 1 measures a distance Ha (shown in FIG. 17 and FIG. 20) between outer faces 109*a* of the side walls 109 and calculates a difference between the distance Ha and a distance h1 (shown in FIG. 8) between the outer faces 109*a* of the side walls 109 before press contact. The difference between the distance Ha and the distance h1 constitutes displacements of the pair of side walls 109 and constitutes displacements of the press contact blades 111*a*, 111*b*, 111*c* described in the specification. Therefore, the displacements of the press contact blades 111*a*, 111*b*, 111*c* described in the specification designate an amount of expanding the interval between the outer faces 109*a* of the pair of side walls 109.

Figure 22:
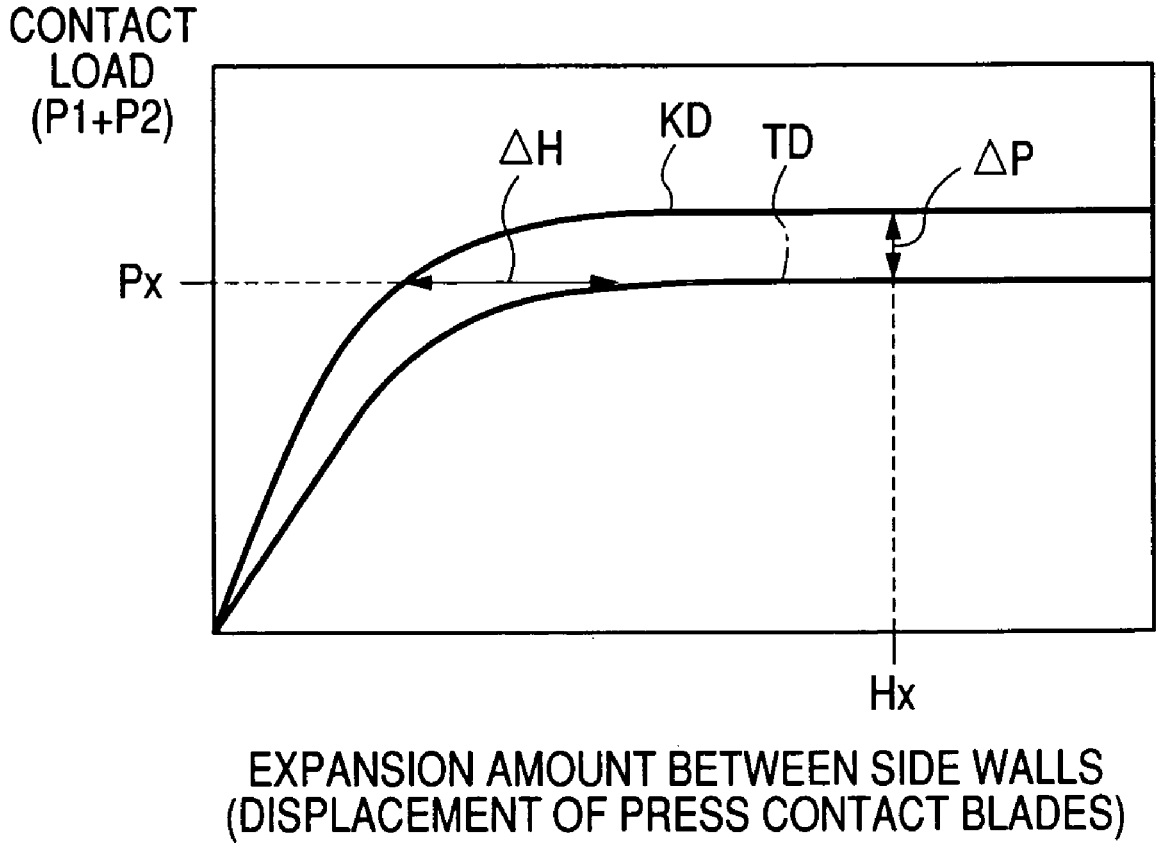
FIG. 22 is an explanatory view showing the reference data shown in FIG. 21 and a characteristic data provided at step S7 of FIG. 13.
Figure 23:
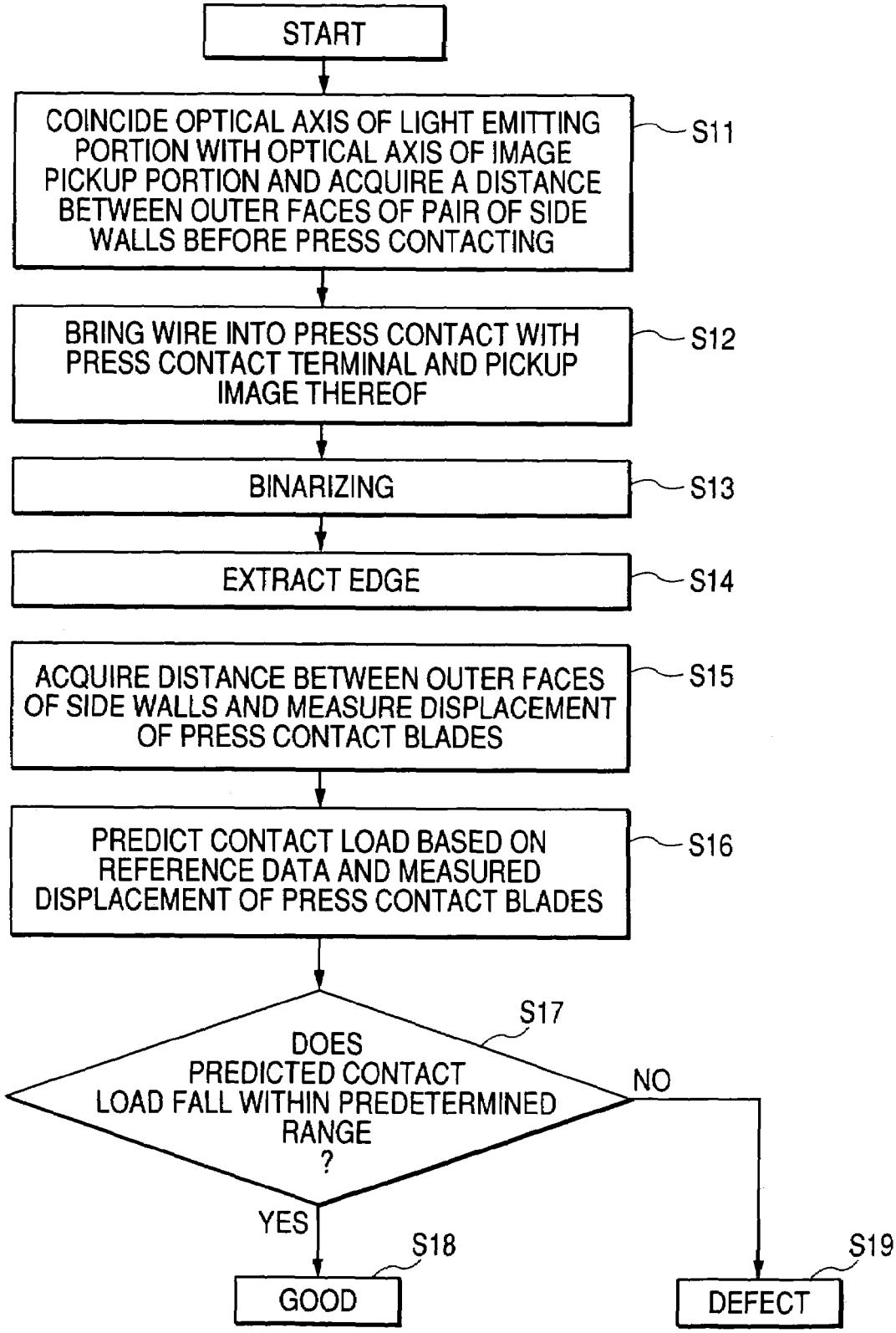
FIG. 23 is a flowchart showing a procedure of inserting the electric wire between the press contact blades and determining acceptability of the press contact terminal by the determining apparatus shown in FIG. 1.

The determining apparatus 1 reproduces to press-fit the electric wire 2 into the intervals between the press contact blades 111*a*, 111*b*, 111*c* and measures the contact loads P1, P2 (shown in FIG. 17, for example) between the piezoelectric element 7 and the press contact blades 111*a*, 111*b*, 111*c*. The relationship between the distance h1, that is, the displacements of the press contact blades 111*a*, 111*b*, 111*c* and the sum of the contact loads P1, P2, that is, the characteristic data TD shown in FIG. 22 is acquired.

The contact loads between the press contact blades 111*a* and the piezoelectric element 7, the contact loads P1, P2 between the press contact blades 111*b* and the piezoelectric element 7 and the contact load between the press contact blades 111*c* and the piezoelectric element 7 are substantially equal. Therefore, according to the embodiment, the contact loads P1, P2 between the press contact blade 111*b* and the piezoelectric element 7 are measured by representing the press contact blades 111*a*, 111*b*, 111*c*.

The determining apparatus 1 measures a distance Hb (shown in FIG. 26) between the outer faces 109*a* of the pair of side walls 109, that is, the displacements of the press contact blades 111*a*, 111*b*, 111*c* by actually inserting the electric wire between the press contact blades 111*a*, 111*b*, 111*c* of the press contact terminal 100 as the object to be inspected.

As shown by FIG. 1 through FIG. 5, the determining apparatus 1 is provided with an apparatus main body 10, a terminal holding portion 13 (shown in FIG. 1 and FIG. 2) as a holding portion, a measuring apparatus 5 as a measuring unit, a detector moving portion 6, the piezoelectric element 7 as a detector, a press contact apparatus 60, an input apparatus 14, a display apparatus 15, an output apparatus 16, and a control apparatus 8.

The apparatus main body 10 is formed in a shape of a flat plate and installed on a floor of a factory. The terminal holding portion 13 is attached at a central portion of the apparatus main body 10. The holding portion 13 is provided between a light emitting moving portion 19 and an image picking moving portion 20, mentioned later, of the measuring apparatus 5. The press contact terminal 100 shown in, for example, FIG. 12 is made to be attachable and detachable to and from the terminal holding portion 13. The terminal holding portion 13 is attached with the press contact terminal 100 in a state in which the longitudinal direction of the electric wire 2 brought into press contact with the electric wire connecting portion 104 and an optical axis of light emitted from a light emitting portion 11 to an image pickup portion 12, mentioned later, are in parallel with each other.

The terminal holding portion 13 is attached with the press contact terminal 100 in a state in which a total of the press contact terminal 100 is disposed at inside of the light emitted from the light emitting portion 11 at a first position to the image pickup portion 12. In this way, the terminal holding portion 13 holds the press contact blades 111*a*, 111*b*, 111*c* in the state in which the longitudinal direction of the electric wire 2 and the optical axis of the light are in parallel with each other.

As shown by FIG. 1 through FIG. 5, the measuring apparatus 5 is provided with the light emitting moving portion 19, the image pickup moving portion 20, the light emitting portion 11, the image pickup portion 12, and a processing apparatus 17 as a processing portion. The light emitting moving portion 19 is attached to an upper face of the apparatus main body 10 and moves the light emitting portion 11 along arrow marks X, Y, Z orthogonal to each other shown in FIG. 1 and FIG. 2.

The image pickup moving portion 20 is attached to an upper face of the apparatus main body 10 and moves the image pickup portion 12 along the arrow marks X, Y, Z orthogonal to each other shown in FIG. 1 and FIG. 2. The light emitting moving portion 19 is provided at one end portion of the apparatus main body 10 and the image pickup moving portion 20 is provided at other end portion of the apparatus main body 10.

Figure 4:
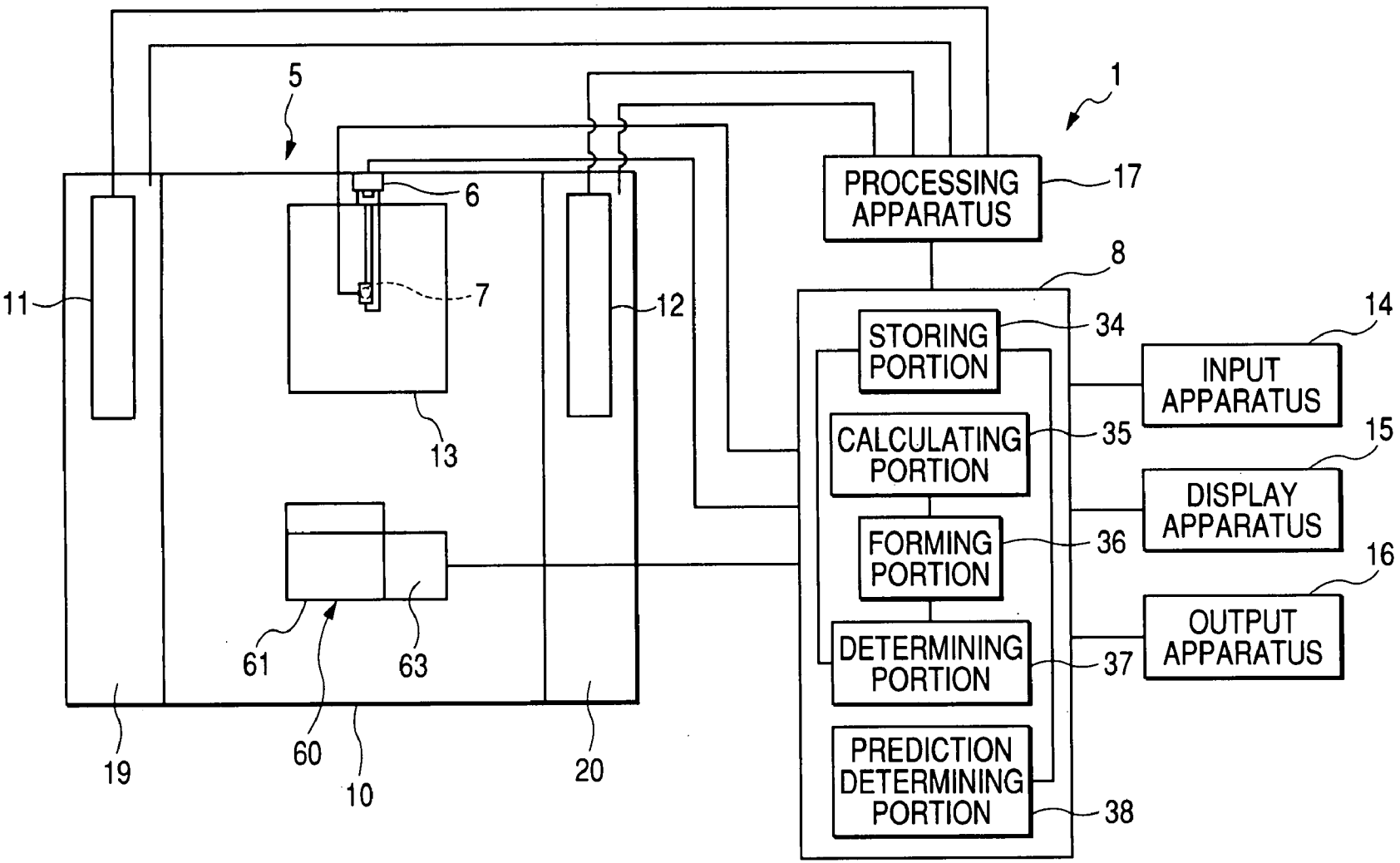
FIG. 4 is an explanatory view showing a total constitution of the determining apparatus shown in FIG. 1.
Figure 5:
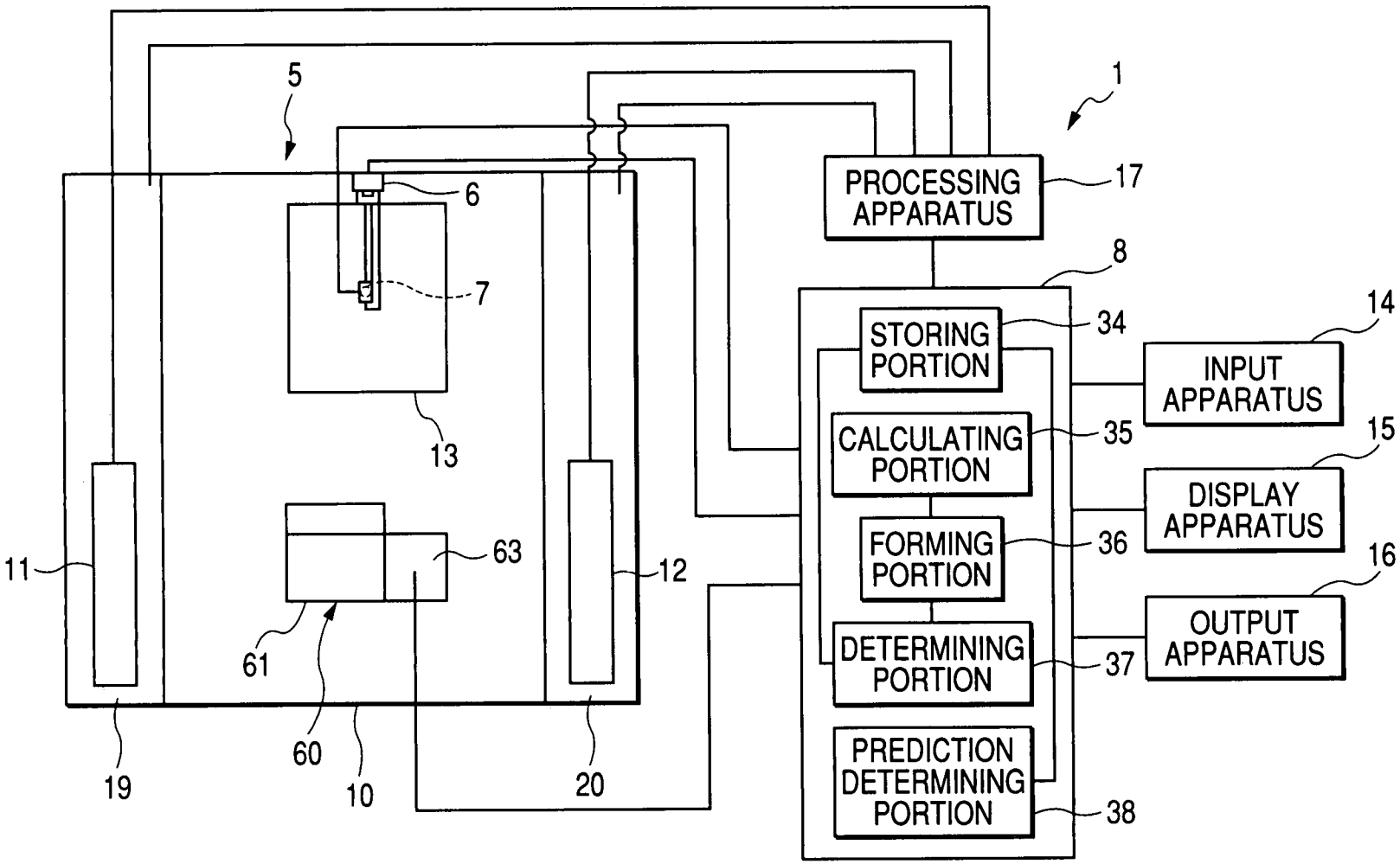
FIG. 5 is an explanatory view showing a state in which the light emitting portion and the image pickup portion of the determining apparatus shown in FIG. 4 are disposed at the second position.

The light emitting moving portion 19 and the image pickup moving portion 20 move the light emitting portion 11 and the image pickup portion 12 from the first position positioning the terminal holding portion 13 between the light emitting portion 11 and the image pickup portion 12 as shown by FIG. 1 and FIG. 4 over to a second position positioning the press contact apparatus 60 between the light emitting portion 11 and the image pickup portion 12 as shown by FIG. 2 and FIG. 5.

Figure 3:
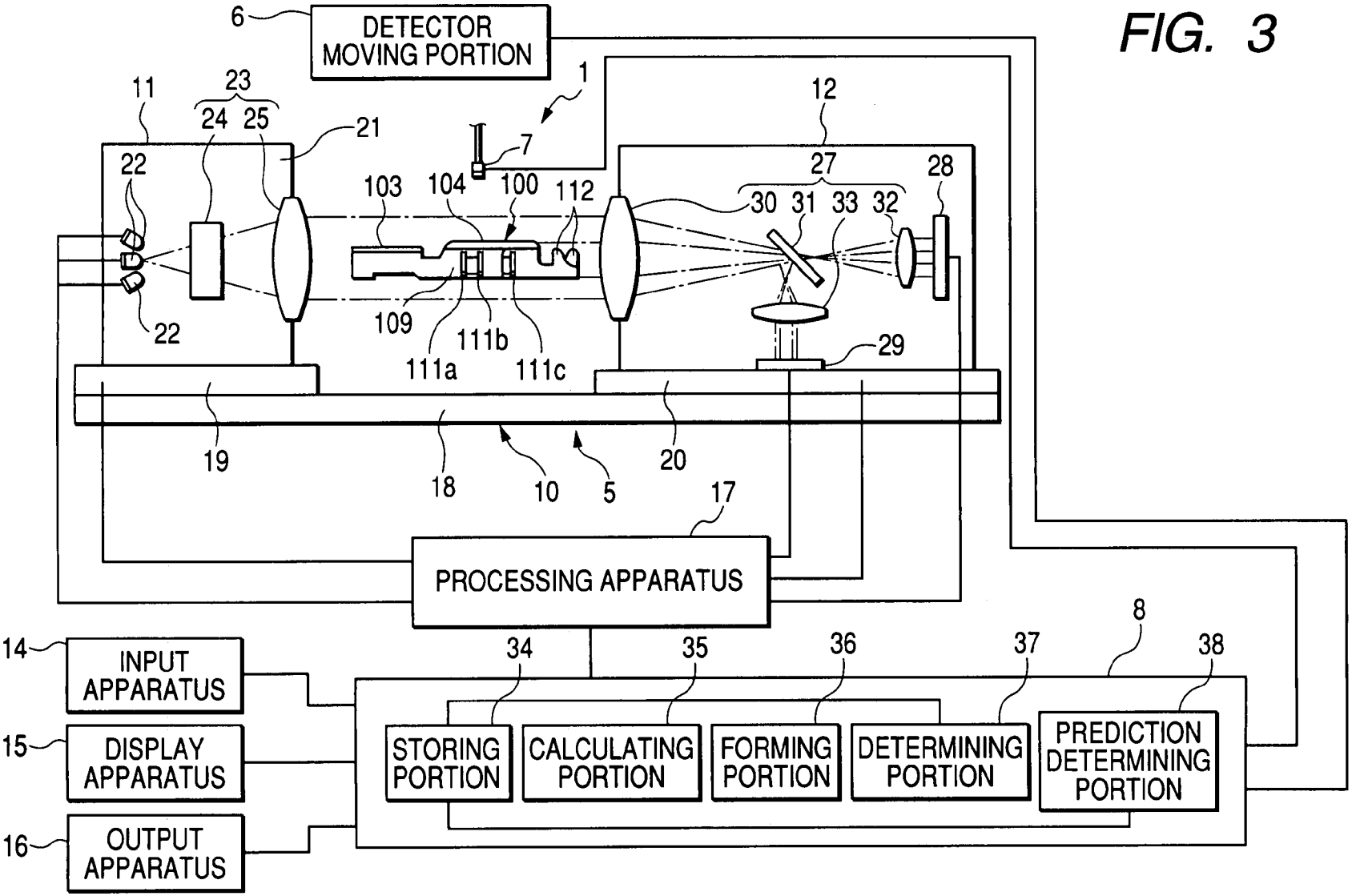
FIG. 3 is a block diagram showing a constitution of a measuring apparatus of the determining apparatus shown in FIG. 1.

The light emitting portion 11 is installed above the light emitting moving portion 19. As shown by FIG. 3, the light emitting portion 11 is provided with a main body portion 21, a plurality of light emitting diodes (hereinafter, described as LED) 22 as a light source provided at inside of the main body portion 21, and an optical portion 23.

The main body portion 21 is formed in a box-like shape and installed above the light emitting moving portion 19. The plurality of LEDs 22 are contained at inside of the main body portion 21 and emit fluxes of light, that is, become luminescent to a diffusing unit, mentioned later, of the optical portion 23 along one-dotted chain lines in FIG. 3. The optical portion 23 is provided with the diffusing unit 24 and a collimator 25. The diffusing unit 24 is contained at inside of the main body portion 21 for making intensities of the fluxes of light from the plurality of LEDs 22 uniform to guide to the collimator 25 along the one-dotted chain lines in FIG. 3.

The collimator 25 is attached to an outer wall of the main body portion 21. The collimator 25 converts light from the diffusing unit 24 into parallel light to emit to outside of the main body portion 21, that is, outside of the light emitting portion 11 along one-dotted chain lines in FIG. 3. In this way, the light emitting portion 11 emits light converted into parallel light to the image pickup portion 12 along one-dotted chain lines in FIG. 3. In this way, the light emitting portion 11 becomes luminescent.

The image pickup portion 12 is installed above the image pickup moving portion 20. As shown by FIG. 3, the image pickup portion 12 is provided with a main body portion 26, an optical portion 27, an optical axis matching image pickup element 28, and an image pickup element 29. The main body portion 26 is formed in a box-like shape and is installed above the image pickup moving portion 20.

The optical portion 27 is provided with a collimator 30, a beam splitter 31, a collimator for optical axis 32, and a collimator for image pickup 33. The collimator 30 is attached to an outer wall of the main body portion 26. The collimator 30 guides light from the light emitting portion 11 into the main body portion 26, that is, into the image pickup portion 12 along one-dotted chain lines in FIG. 3. The collimator 30 guides light from the light emitting portion 11 to the beam splitter 31.

The beam splitter 31 is contained at inside of the main body portion 26. The beam splitter 31 transmits a portion of light guided from the collimator 30 to guide to the collimator for optical axis 32 along one-dotted chain lines in FIG. 3. The beam splitter 31 reflects a remaining portion of the light to guide to the collimator for image pickup 32 along one-dotted chain lines in FIG. 3.

The collimator for optical axis 32 is contained at inside of the main body portion 26. The collimator for optical axis 32 converts light transmitted through the beam splitter 31 into parallel light to guide to the optical axis matching image pickup element 28 along one-dotted chain lines in FIG. 3. The collimator for image pickup 33 is contained at inside of the main body portion 26. The collimator for image pickup 33 converts light reflected by the beam splitter 31 into parallel light to guide to the image pickup element 29 along one-dotted chain lines in FIG. 3.

The optical axis matching image pickup element 28 is contained at inside of the main body portion 26. The optical axis matching image pickup element 28 comprises CMOS (Complementary Metal Oxide Semiconductor) and receives light guided from the beam splitter 31. The optical axis matching image pickup element 28 calculates a position of an optical axis of light guided from the beam splitter 31. The optical axis matching image pickup element 28 outputs the position of the calculated optical axis of light to the processing apparatus 17.

The image pickup element 29 is contained at inside of the main body portion 26. The image pickup portion 29 comprises CCDs (Charge Coupled Devices) for receiving light reflected by the beam splitter 31. The image pickup element 29 picks up images of the terminal holding portion 13 positioned between the light emitting portion 11 and the image pickup portion 12. The image pickup element 29 outputs picked-up images G1*a*, G1*b* (shown in FIG. 18 and FIG. 24) to the processing apparatus 17.

Images G1*a*, G1*b* provided by being picked up by the image pickup element 29 comprise intensities of respective fluxes of light at respective pixels aligned on a plane. Therefore, the images G1*a*, G1*b* provided by being picked up by the image pickup element 29 constitute plane monochrome images. In this way, the image pickup portion 29 receives light from the light emitting portion 11 and picks up an image of the press contact terminal 100 attached to the terminal holding portion 13 or a holding portion 64, mentioned later.

Since the terminal holding portion 13 holds the press contact terminal 100 in a state in which the longitudinal direction of the electric wire 2 and the optical axis are in parallel with each other, the image pickup portion 12 at the first position picks up images of the pair of side walls 109, the press contact blades 111*a*, 111*b*, 111*c* viewed from a position along the longitudinal direction of the press contact terminal 100 and the electric wire 2 at an interval therefrom. That is, the image pickup portion 12 at the first position acquires outer shapes of the press contact blades 111*a*, 111*b*, 111*c* viewed from the position along the longitudinal direction of the press contact terminal 100 and the electric wire 2 are disposed at an interval therefrom.

The processing apparatus 17 is a computer provided with CPU (Central Processing Unit), ROM (Read-only Memory) and RAM (Random Access Memory) which are well known. The processing apparatus 17 is connected with the light emitting moving portion 19, LEDs 22 of the light emitting portion 11, the image pickup moving portion 20, the optical axis matching image pickup element 28 of the image pickup portion, the image pickup element 29 of the image pickup portion 12 for controlling operation of these. The processing apparatus 17 governs to control a total of the measuring apparatus 5.

The processing apparatus 17 is stored with programs for operating the measuring apparatus 5. The processing apparatus 17 makes the light emitting portion 11 emit light and makes the image pickup portion 12 receive light from the light emitting portion 11 before attaching the press contact terminal 100 to the terminal holding portion 13. The processing apparatus 17 coincides an optical axis of the light emitting portion 11 with an optical axis of the image pickup portion 12 by driving the respective moving portions 19, 20.

The processing apparatus 17 binarizes the images G1*a*, G1*b* (shown in FIG. 18 and FIG. 24) provided by being picked up by the image pickup element 29. As shown by FIG. 20 and FIG. 26, the processing apparatus 17 is provided with images G3*a*, G3*b* constituted by extracting outer shapes (edges) of the pair of side walls 109 and the press contact blades 111*a*, 111*b*, 111*c* of the electric wire connecting portion 104 of the press contact terminal 100 from binarized images G2*a*, G2*b* (shown in FIG. 19 and FIG. 25) provided by binarization.

In the edges of the images G3*a*, G3*b*, the surface 108*a* of the bottom wall 108 along the horizontal direction is extracted. Widths H1, H2 . . . Hn in a direction in parallel with the surface 108*a* of the bottom wall 108 are calculated and a maximum one Hmax among these is calculated. The Hmax is outputted to the control apparatus 8 as distances Ha, Hb between the outer faces 109*a* of the pair of side walls 109. The measuring apparatus 5 can measure displacements of the press contact blades 111*a*, 111*b*, 111*c* by measuring the distances Ha, Hb, h1. In this way, the measuring apparatus 5 can measure the displacements of the press contact blades 111*a*, 111*b*, 111*c* when the piezoelectric element 7 is inserted between the press contact blades 111*a*, 111*b*, 111*c* of the press contact terminal 100 in which the piezoelectric element 7 is held by the terminal holding portion 13. The measuring apparatus 5 can measure the displacements of the press contact blades 111*a*, 111*b*, 111*c* when the electric wire 2 is inserted between the press contact blades 111*a*, 111*b*, 111*c* of the press contact terminal 100 held by the press contact apparatus 60.

The detector moving portion 6 is installed above the apparatus main body 10. The detector moving portion 6 moves the piezoelectric element 7 along arrow marks X, Y, Z in FIG. 1. The detector moving portion 6 positions the piezoelectric element 7 right above between the press contact blades 111*b* of the press contact terminal 100 attached to the terminal holding portion 13. The detector moving portion 6 makes the piezoelectric element 7 positioned right above between the press contact blades 111*b* proximate to the press contact terminal 100. The detector moving portion 6 inserts the piezoelectric element 7 between the press contact blades 111*b*.

The piezoelectric element 7 is supported by the detector moving portion 6. The piezoelectric element 7 is moved by the detector moving portion 6 along the arrow marks X, Y, Z in FIG. 1. The piezoelectric element 7 is made of, for example, a material having high rigidity and having piezoelectricity of lead titanate (PT), lead titanate zirconate (PZT), quartz. The piezoelectric element 7 is connected to the control apparatus 8. The piezoelectric element 7 is positioned right above between the press contact blades 111*b* by the detector moving portion 6 and thereafter inserted between the press contact blades 111*b*.

The piezoelectric element 7 generates an electromotive force when the piezoelectric element 7 is strained and outputs an output current in accordance with the electromotive force to the control apparatus 8. The output current constitutes information in accordance with the contact loads P1, P2 described in the specification. A width W (shown in FIG. 16) in the direction (shown by an arrow mark S in FIG. 17) of aligning the pair of press contact blades 111*b* of the piezoelectric element 7 is equal to or larger than an interval D (shown in FIG. 16) between the press contact blades 111*a*, 111*b*, 111*c* and equal to or smaller than an outer diameter R (shown in FIG. 8) of the core wire 3 of the electric wire 2. In the illustrated example, the width W of the piezoelectric element 7 is equal to the outer diameter R of the core wire 3 of the electric wire 2. In this way, when the piezoelectric element 7 is brought into contact with the press contact blades 111*b*, the piezoelectric element 7 is strained and generates the output current. Therefore, when the piezoelectric element 7 is inserted between the press contact blades 111*b*, the piezoelectric element 7 is brought into contact with the press contact blades 111*b* and generates the output current.

The press contact apparatus 60 is attached to a central portion of the apparatus main body 10. The press contact apparatus 60 is provided between the light emitting moving portion 19 and the image pickup moving portion 20 of the measuring apparatus 5. The press contact apparatus 60 is aligned with the terminal holding portion 13. The press contact apparatus 60 is provided with a main body portion 61, a press contact blade 62 and a lifting cylinder 63. The main body portion 61 is attached to the apparatus main body 10. The main body portion 61 is provided with a holding portion 64 for positioning the press contact terminal 100 on a surface 64*a* thereof. The surface 64*a* of the holding portion 64 is flat along a horizontal direction.

The holding portion 64 is attached with the press contact terminal 100 in a state in which a total of the press contact terminal 100 is disposed at inside of light emitted from the light emitting portion 11 to the image pickup portion 12 at the second position. The holding portion 64 holds the press contact terminal 100 above the surface 64*a* in a state in which the longitudinal direction of the electric wire 2 inserted between the press contact blades 111*a*, 111*b*, 111*c* is in parallel with the optical axis of light from the light emitting portion 11. That is, the press contact apparatus 60 holds the press contact terminal 100. Since the holding portion 64 holds the press contact terminal 100 in the state in which the longitudinal direction of the electric wire 2 and the optical axis are in parallel with each other, the image pickup portion 12 at the second position picks up images of the pair of side walls 109, the press contact blades 111*a*, 111*b*, 111*c* viewed from the position along the longitudinal direction of the press contact terminal 100 and the electric wire 2 at an interval therefrom. That is, the image pickup portion 12 at the second position acquires outer shapes of the press contact blades 111*a*, 111*b*, 111*c* viewed from the position along the longitudinal direction of the press contact terminal 100 and the electric wire 2 at an interval therefrom.

The press contact blade 62 is formed in a blade-like shape. A longitudinal direction of the press contact blade 62 is in parallel with the longitudinal direction of the press contact terminal 100 held above the surface 64*a* of the holding portion 64, that is, the optical axis of light from the light emitting portion 11. A thickness of the press contact blade 62 is thinner than an interval between the side walls 109 of the press contact terminal 100 before press contact. The press contact blade 62 is supported by the main body portion 61 contactably and separatably to and from the press contact terminal 100 held above the surface 64*a* of the holding portion 64. Contact and separation signifies that the press contact blade 62 becomes proximate to the press contact terminal 100 and separated therefrom. The press contact blade 62 is liftably supported by the main body portion 61.

The press contact blade 62 positions the electric wire 2 between the press contact blade 62 and the press contact terminal 100 positioned above the surface 64*a* of the holding. portion 64. The press contact blade 62 faces (inserts) the electric wire 2 in between the press contact blades 111*a*, 111*b*, 111*c* by becoming proximate, that is, moving down to the press contact terminal 100 above the surface 64*a* of the holding portion 64. The press contact blade 62 bends the fastening pieces 112 toward the bottom wall 108 to thereby fasten the electric wire 2 by the fastening pieces 112 by becoming proximate, that is, moving down to the press contact terminal 100 of the surface 64*a* of the holding portion 64. The lifting cylinder 63 brings the press contact blade 62 into contact with the surface 64*a* of the holding portion 64 and separates the press contact blade 62 therefrom. That is, the lifting cylinder 63 moves the press contact blade 62 up and down.

According to the press contact apparatus 60 having the above-described constitution, the press contact terminal 100 is attached above the surface 64*a* of the holding portion 64. The electric wire 2 is positioned between the press contact blade 62 and the press contact terminal 100 above the surface 64*a* of the holding portion 64 in a state in which the press contact blade 62 is separated from the surface 64*a* of the holding portion 64, that is, in a state in which the press contact blade 62 is lifted therefrom. The press contact blade 62 becomes proximate, that is, is moved down to the surface 64*a* of the holding portion 64 by the lifting cylinder 63. The press contact blade 62 inserts (presses) the electric wire 2 between the press contact blades 111*a*, 111*b*, 111*c* and fastens the electric wire 2 by the fastening pieces 112. In this way, the press contact apparatus 60 inserts the electric wire 2 between the press contact blades 111*a*, 111*b*, 111*c* to thereby bring the electric wire 2 into press contact with the press contact terminal 100.

The input apparatus 14 is used for variously operating the determining apparatus 1. The input apparatus 14 is used for inputting the reference data KD to a storing portion 34, mentioned later, of the control apparatus 8. As the input apparatus 14, various record medium drive apparatus of a keyboard, a mouse, various switches, an operation button and a DVD-ROM drive apparatus which are well known can be used. In the illustrated example, a keyboard is used as the input apparatus 14.

The display apparatus 15 displays an operating state of the determining apparatus 1, the images G1*a*, G1*b* picked up by the pickup element 29 and a result of determination. As the display apparatus 15, various display apparatus of a CRT (Cathode Ray Tube) display and a liquid crystal display which are well known can be used. In the illustrated example, a liquid crystal display is used as the display apparatus 15.

The output apparatus 16 outputs the result of determination of the determining apparatus 1, the images G11*a*, G1*b* picked up by the image pickup element 29. As the output apparatus 16, a well known printer for printing the result of determination and the images G1*a*, G1*b*, a DVD-ROM drive apparatus capable of writing the result of determination and the images G1*a*, G1*b* to various record media such as DVD-ROM as electronic information can be used. As illustrated example, a printer is used as the output apparatus 16.

The control apparatus 8 is a computer provided with CPU (Central Processing Unit), ROM (Read-only Memory) and RAM (Random Access Memory) which are well known. The control apparatus is connected with the processing apparatus 17, the detector moving portion 6, the detector 7, the press contact apparatus 60, the input apparatus 14, the display apparatus 15 and the output apparatus 16 of the measuring apparatus 5 to control operation of these. The control apparatus 8 governs to control a total of the determining apparatus 1.

As shown by FIG. 3 through FIG. 5, the control apparatus 8 is provided with the storing portion 34 as a storing unit, a calculating portion 35 as a calculating unit, a forming portion 36 as a forming unit, a determining portion 37 as a determining unit and a prediction determining portion 38 as a prediction determining unit.

Figure 21:
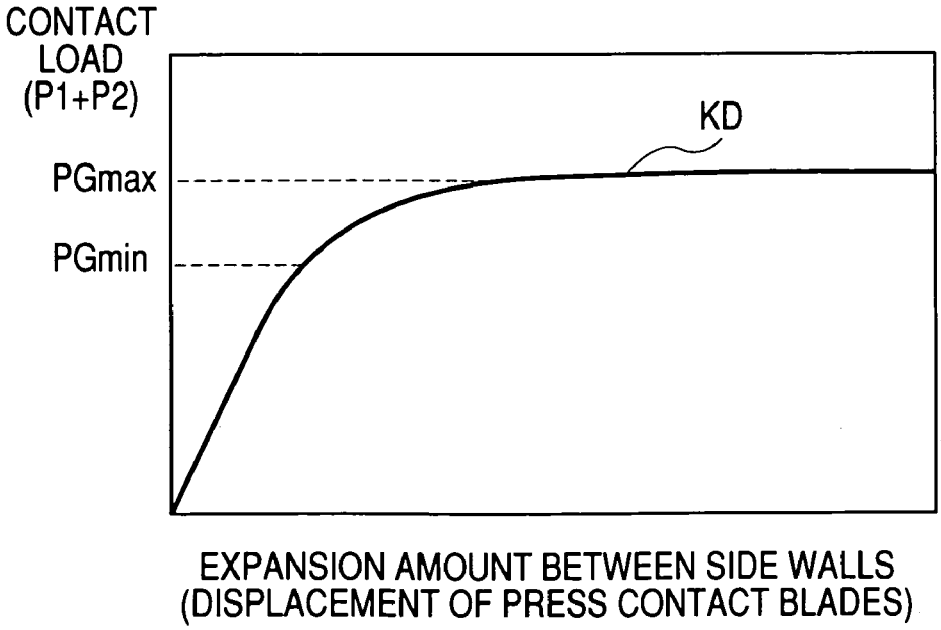
FIG. 21 is an explanatory view showing a reference data stored to a storing portion of the determining apparatus shown in FIG. 1.

The storing portion 34 is stored with the reference data KD (shown in FIG. 21). Therefore, the storing portion 34 is stored with the relationship between the displacements of the press contact blades 111*a*, 111*b*, 111*c* and the contact loads P1, P2 between the press contact blades 111*a*, 111*b*, 111*c* and the core wire 3 of the electric wire 2 when the electric wire 2 is brought into press contact with a normal one of the press contact terminal 100. The storing portion 34 is stored with a program for operating the determining apparatus 1.

The program stored in the storing portion 34 makes the processing apparatus 17 of the measuring apparatus 5 coincide the optical axis of the collimators 25, 30 before positioning the light emitting portion 11 and the image pickup portion 12 at the first position and inserting the piezoelectric element 7 between the press contact blades 111*b* of the press contact terminal 100. The program makes the processing apparatus 17 pick up an image of the press contact terminal 100 when the press contact terminal 100 is attached to the terminal holding portion 13.

The program makes the processing apparatus 17 binarize the picked up image and thereafter calculate the distance h1 (shown in FIG. 16) between the outer faces 109*a* of the pair of side walls 109. The distance h1 constitutes the width of the press contact terminal 100 before press contact. The control apparatus 8 temporarily stores the width h1 to the storing portion 34.

The program makes the detector moving portion 6 position the piezoelectric element 7 right above between the press contact blades 111*b* and thereafter makes the piezoelectric element 7 gradually proximate to the electric wire connecting portion 104 of the press contact terminal 100. When the output current is inputted from the piezoelectric element 7, the program stops the detector moving portion 6 and makes the measuring apparatus 5 measure the distance Ha between the outer faces 109*a* of the pair of side walls 109. The program calculates a difference between the measured distance Ha and the distance h1 to thereby calculate the displacements of the pair of side walls, 109, that is, the press contact blades 111*b*.

The calculating portion 35 calculates the contact loads P1, P2 between the piezoelectric element 7 and the press contact blades 111*b* based on the output current inputted from the piezoelectric element 7. In this way, the calculating portion 35 calculates the contact loads P1, P2 between the piezoelectric element 7 and the press contact blades 111*a*, 111*b*, 111*c* when the piezoelectric element 7 is inserted between the press contact blades 111*a*, 111*b*, 111*c* of the press contact terminal 100 held by the terminal holding portion 13. The calculating portion 35 outputs the calculated contact loads P1, P2 to the forming portion 36.

The program makes the detector moving portion 6 bring the piezoelectric element 7 proximate to the electric wire connecting portion 104 of the press contact terminal 100 by a previously determined distance. That is, the program makes the detector moving portion 6 insert the piezoelectric element 7 to a further depth side between the pair of press contact blades 111*b*. Thereafter, the program calculates the displacements of the press contact blades 111*b* as described above and makes the calculating portion 35 calculate the contact loads P1, P2 to output to the forming portion 36.

The program makes the piezoelectric element 7 insert to the further depth side between the pair of press contact blades 111*b* until positioning the piezoelectric element 7 to a predetermined position. The program calculates the displacements of the press contact blades 111*b* until positioning the piezoelectric element 7 to the predetermined position and makes, the calculating portion calculate the contact loads P1, P2 to output to the forming portion 36. When the piezoelectric element 7 is positioned to the predetermined position, the program makes the detector moving portion 6 separate the piezoelectric element 7 from the electric wire connecting portion 104 of the press contact terminal 100.

The forming portion 36 calculates the sum of the contact loads P1, P2. The forming portion 36 forms the characteristic data TD shown in FIG. 22 showing the relationship between the displacements of the press contact blades 111*a*, 111*b*, 111*c* and the sum of the contact loads P1, P2 calculated based on the distances Ha, h1 inputted from the measuring apparatus 5. The forming portion 36 outputs the formed characteristic data TD to the determining portion 37.

The determining portion 37 calculates differences ΔP, ΔH between the reference data KD shown by a bold line in FIG. 22 and the characteristic data TD shown in FIG. 22 by a one-dotted chain line. The determining portion 37 determines whether ΔP, ΔH, mentioned above, are equal to or larger than previously determined values. The determining portion 37 determines the press contact terminal 100 as an unacceptable product when ΔP, ΔH, mentioned above, are equal to or larger than the previously determined values. The determining portion 37 determines the press contact terminal 100 as an acceptable product when ΔP, ΔH, mentioned above, are less than the previously determined values.

In this way, the control apparatus 8 positions the light emitting portion 11 and the image pickup portion 12 at the first position and acquires the characteristic data TD shown in FIG. 22 by the one-dotted chain line. The control apparatus 8 determines acceptability of the press contact terminal 100 based on the characteristic data TD and the reference data KD.

The program stored to the storing portion 34 of the control apparatus 8 makes the processing apparatus 17 of the measuring apparatus 5 coincide the optical axes of the collimators 25, 30 for positioning the light emitting portion 11 and the image pickup portion 12 to the second position and bringing the electric wire 2 into press contact with the press contact terminal 100. The program makes the processing apparatus 17 pick up the image of the press contact terminal 100 when the press contact terminal 100 is held above the surface 64*a* of the holding portion 64 of the press contact apparatus 60.

The program makes the processing apparatus 17 binarize the picked-up image and thereafter calculate the distance h1 (shown in FIG. 16) between the outer faces 109*a* of the pair of side walls 109. The distance h1 constitutes the width of the press contact terminal 100 before press contact. The control apparatus 8 temporarily stores the width h1 to the storing portion 34.

After measuring the distance h1, the program makes the press contact apparatus 60 operate to insert the electric wire 2 between the press contact blades 111*a*, 111*b*, 111*c*. The electric wire 2 is brought into press contact with the press contact terminal 100. After finishing to bring the electric wire 2 into press contact therewith, the program makes the measuring apparatus 5 measure the distance Hb (shown in FIG. 26) between the outer faces 109*a* of the pair of side walls 109. The program calculates the difference between the measured distance Hb and the distance h1 and calculates the displacement Hs (shown in FIG. 27) between the pair of side walls 109, that is, the press contact blades 111*b*.

The prediction determining portion 38 predicts the contact load Ps (shown in FIG. 27) between the core wire 3 of the electric wire 2 and the press contact blades 111*a*, 111*b*, 111*c* when the displacements of the press contact blades 111*a*, 111*b*, 111*c* are the displacements of Hs. The predication determining portion 38 determines whether the predicted contact load Ps falls in a previously determined allowable range (equal to or larger than PGmin and equal to or smaller than PGmax). The prediction determining portion 38 determines the press contact terminal 100 as an acceptable product when the predicted contact load Ps is equal to or larger than PGmin and equal to or smaller than PGmax. The prediction determining portion 38 determines the press contact terminal 100 as an unacceptable product when the predicted contact load Ps is less than PGmin or exceeds PGmax.

In this way, the control apparatus 8 positions the light emitting portion 11 and the image pickup portion 12 at the second position and actually brings the electric wire 2 into contact with the press contact terminal 100 as the object to the inspected by the press contact apparatus 60. The prediction determining portion 38 of the control apparatus 8 predicts the contact load Ps between the press contact terminals 111*a*, 111*b*, 111*c* of the press contact terminal 100 as the object to be inspected and the core wire 3 of the electric wire 2 based on the displacement Hs of the press contact blades 111*a*, 111*b*, 111*c* measured by the measuring apparatus 5 when the electric wire 2 is inserted between the press contact blades 111*a*, 111*b*, 111*c* and the reference data KD. The prediction determining portion 38 of the control apparatus 8 determines acceptability of the press contact terminal 100 by predicting the contact load Ps.

Next, an explanation will be given of a procedure of determining acceptability of the press contact terminal 100 by the determining apparatus 1 of the above-described embodiment.

First, in determining acceptability of, for example, the designed and trially fabricated press contact terminal 100, the light emitting portion 11 and the image pickup portion 12 are disposed at the first position shown in FIG. 1 and FIG. 4. At step S1 in FIG. 13, the control apparatus 8 makes the measuring apparatus 5 emit light from the light emitting portion 11 to the image pickup portion 12. The control apparatus 8 makes the processing apparatus 17 coincide the optical axis of the collimator 25 of the light emitting portion 11 and the optical axis of the collimator 30 of the image pickup portion 12 based on the optical axis of light provided by receiving the light by the optical axis matching image pickup element 28.

Figure 14:
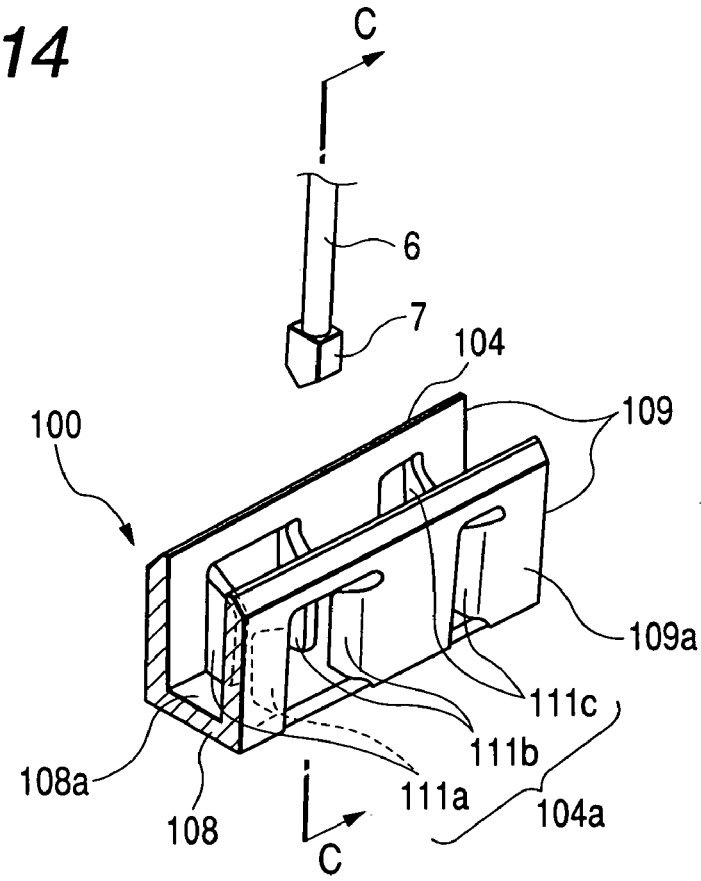
FIG. 14 is a perspective view showing a state of positioning the piezoelectric element of the determining apparatuses shown in FIGS. 1, 47 and 56 right above between the press contact blades.
Figure 16:
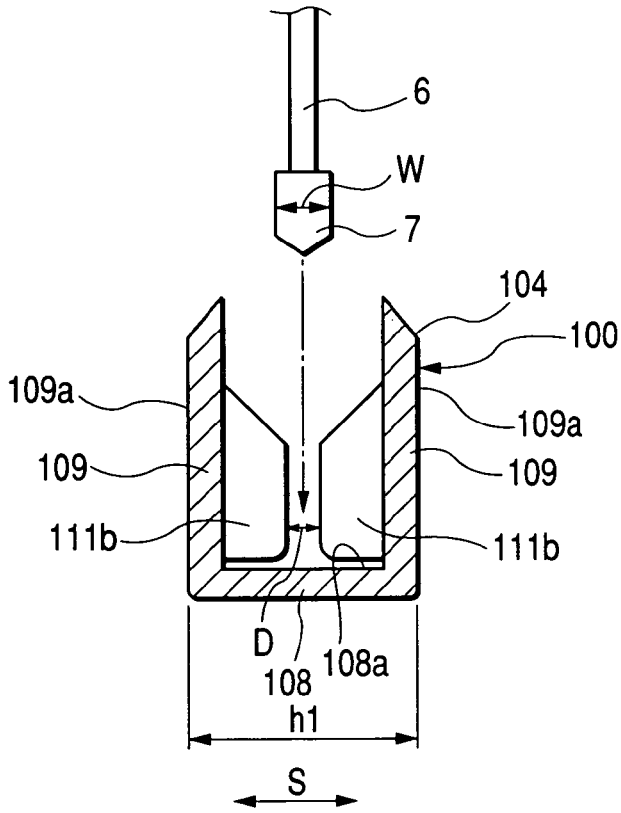
FIG. 16 is a sectional view taken along a line C-C of FIG. 14.

The press contact terminal 100, that is, the press contact blades 111*a*, 111*b*, 111 are attached to the terminal holding portion 13. At this occasion, the press contact terminal 100, that is, the press contact blades 111*a*, 111*b*, 111 are attached to the terminal holding portion 13 in a state in which the longitudinal direction of the electric wire 2 inserted between the press contact blades 111*a*, 111*b*, 111 and the optical axis of light emitted by the light emitting portion 11 are in parallel with each other. At this occasion, the electric wire connecting portion 104 of the press contact terminal 100 is brought into a state before press contact as shown by FIG. 14 and FIG. 16.

The control apparatus 8 makes the processing apparatus 17 emit light from the light emitting portion 11 to the image pickup portion 12 and make the image pickup portion 12 pick up the image. The control apparatus 8 makes the processing apparatus 17 calculate the distance h1 between the outer faces 109*a* of the pair of side walls 109 and store the calculated distance h1. In this way, at step S1, the distance h1 between the outer faces 109*a* of the pair of side walls 109 of the press contact terminal 100 before press contact is calculated by aligning the optical axis of the light emitting portion 11 and the optical axis of the image pickup portion 12. The operation proceeds to step S2.

At step S2, the control apparatus 8 makes the detector moving portion 6 move the piezoelectric element 7 and insert the piezoelectric element 7 gradually between the press contact blades 111*b*. When the output current is inputted from the piezoelectric element 7 to the control apparatus 8, the pair of side walls 109, that is, the press contact blades 111*b* are gradually separated from each other. The control apparatus 8 stops the detector moving portion 6. The control apparatus 8 makes the processing apparatus 17 emit light from the light emitting portion 11 to the image pickup portion 12 and makes the image pickup portion 12 pick up the image. The image pickup portion 12 provides the image G1*a* (shown in FIG. 18) showing the outer shapes of the press contact blades 111*a*, 111*b*, 111*c* viewed from the position along the longitudinal direction of the electric wire 2 at an interval therefrom.

At this occasion, light is emitted from the light emitting portion 11 to the image pickup portion 12 and therefore, in the image G1*a* provided by the image pickup portion 12, the terminal holding portion 13, the pair of side walls 109 and the press contact blades 111*a*, 111*b*, 111*c* become dark by constituting shadow and the other portion becomes bright. In this way, at step S2, the images of the press contact blades 111*a*, 111*b*, 111*c* of the press contact terminal 100 are picked up. In this way, at step S2, the piezoelectric element 7 is made to be proximate to the electric wire connecting portion 104 of the press contact terminal 100 and images of these are picked up. The operation proceeds to step S3.

Figure 18:
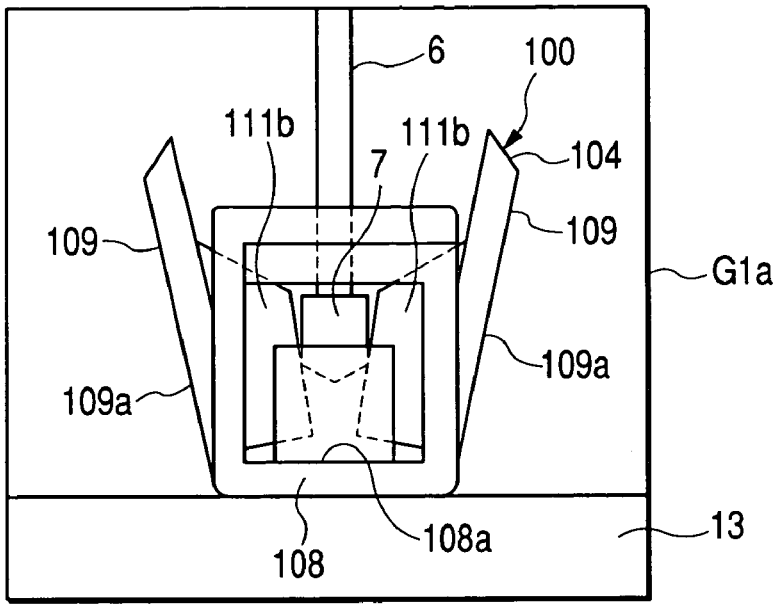
FIG. 18 is an explanatory view showing an image provided at step S2 of the flowchart shown in FIG. 13.
Figure 19:
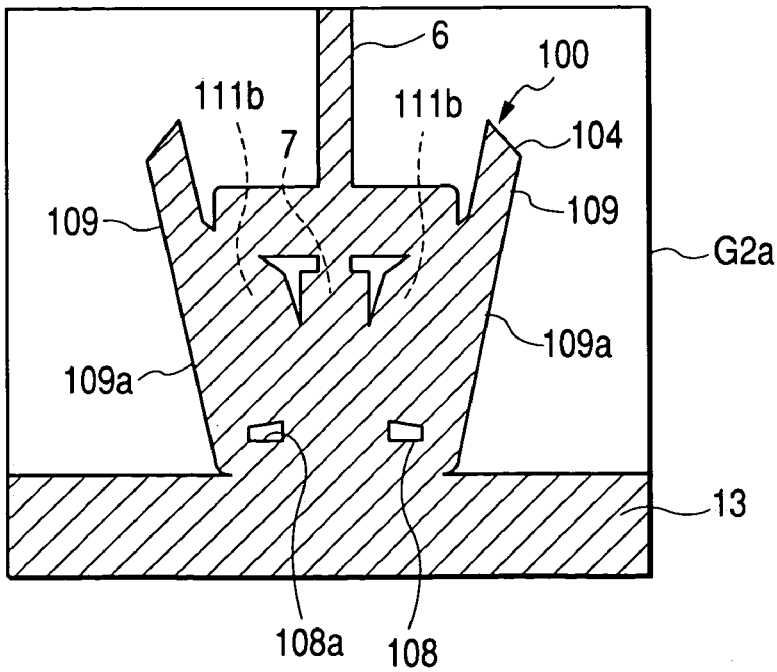
FIG. 19 is an explanatory view showing a binarized image provided by binarizing the image shown in FIG. 18.
Figure 20:
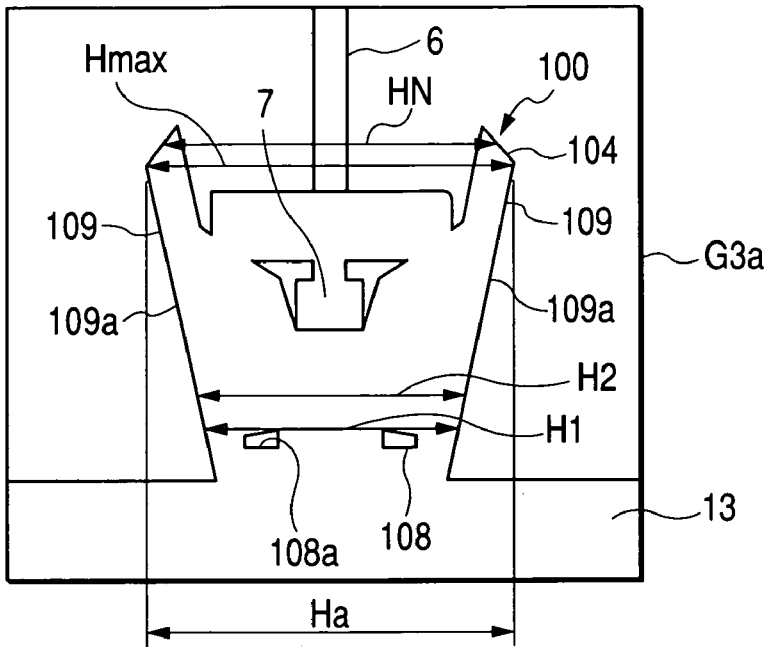
FIG. 20 is an explanatory view showing an image provided by extracting an outer shape (edge) from the binarized image shown in FIG. 19.

At step S3, the image G1*a* shown in FIG. 18 is binarized by a predetermined threshold to provide the binarized image G2*a* shown in FIG. 19. In the binarized image G2*a* shown in FIG. 19, the terminal holding portion 13, the pair of side walls 109 and the press contact blades 111*a*, 111*b*, 111*c* shown by parallel hatched lines become black and the other portion becomes white. In this way, at step S3, the binarization is carried out and the operation proceeds to step S4.

At step S4, a boundary of white and black of the binarized image G2*a*, that is, the outer shapes (edges) of the pair of side walls 109, the press contact blades 111*a*, 111*b*, 111*c* and the terminal holding portion 13 are extracted to provide the image G3*a* shown in FIG. 20. The operation proceeds to step S5.

At step S5, the processing apparatus 17 extracts the surface 108*a* of the bottom wall 108 from the extracted outer shapes (edges) calculates the widths H1, H2 . . . HN of the outer shapes (edges) along the surface 108*a* to calculate the maximum width Hmax. The processing apparatus 17 outputs the maximum width Hmax to the control apparatus 8 as the distance Ha between the outer faces 109*a* of the pair of side walls 109. The control apparatus 8 calculates the difference between the distance Ha and the h1 and stores the difference as the displacements of the press contact blades 111*b*.

At step S5, the calculating portion 38 of the control apparatus 8 calculates the contact loads P1, P2 between the piezoelectric element 7 and the press contact blades 111*b* based on the output current from the piezoelectric element 7. The control apparatus 8 stores the sum of the contact loads P1, P2. In this way, at step S5, the distance Ha between the outer faces 109*a* of the side walls 109 is calculated. The displacements of the press contact blades 111*b* are measured and the contact loads P1, P2 between the piezoelectric element 7 and the press contact blades 111*b* are calculated. The operation proceeds to step 6.

Figure 15:
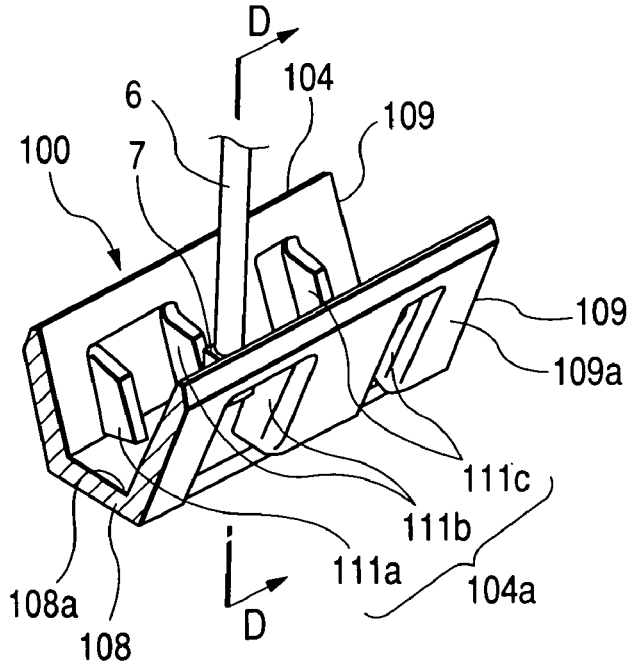
FIG. 15 is a perspective view showing a state of inserting the piezoelectric element shown in FIG. 14 between the press contact blades.
Figure 17:
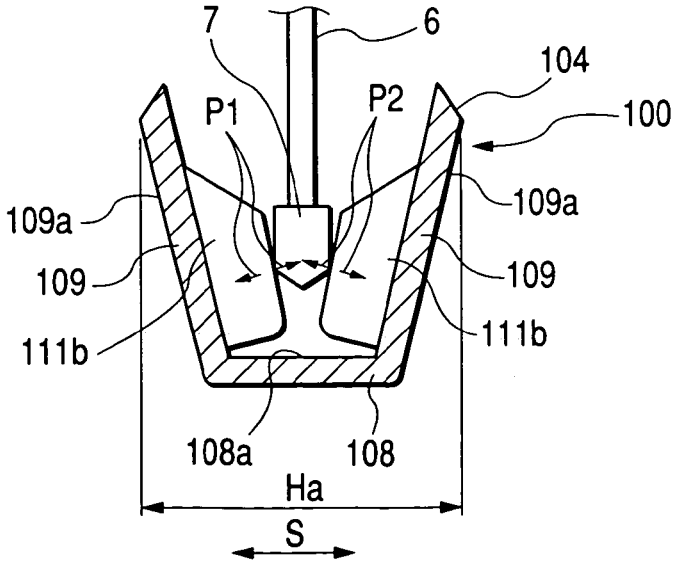
FIG. 17 is a sectional view taken along a line D-D of FIG. 15.

At step S6, the control apparatus 8 determines whether the piezoelectric element 7 is inserted between the press contact blades 111*b* to the predetermined position shown in FIG. 15 and FIG. 17. When it is determined that the piezoelectric element 7 is not inserted between the press contact blades 111*b* to the predetermined position, the operation returns to step S2.

At step S2, the control apparatus 8 inserts again the piezoelectric element 7 to the depth side between the press contact blades 111*b* by driving the detector moving portion 6. The operation successively proceeds from step S2 to step S5 and calculates the displacements of the press contact blades 111*b* and the sum of the contact loads P1, P2 to store. In this way, the displacements of the press contact blades 111*b* and the sum of the contact loads P1, P2 are calculated by gradually inserting the piezoelectric element 7 at the depth side between the piezoelectric element 7 and the press contact blades 111*b* until the piezoelectric element 7 is positioned at the predetermined position shown in FIG. 15 and FIG. 17.

When it is determined at step S6 that the piezoelectric element 7 is inserted between the press contact blades 111*b* to the predetermined position, the operation proceeds to step S7. At step S7, the forming portion 36 acquires (forms) the characteristic data KD shown in FIG. 22 by the one-dotted chain line based on the displacements of the press contact blades 111*b* and the contact loads P1, P2 stored as described above. When the characteristic data KD is formed at step S7, the operation proceeds to step S8.

At step S8, the determining portion 37 calculates the differences ΔP, ΔH between the reference data KD and the characteristic data TD in the case of the predetermined displacement Hx and the predetermined contact load Px. The determining portion 37 determines whether the differences ΔP, ΔH are equal to or larger than predetermine values. When it is determined that the differences ΔP, ΔH are less than the predetermined values, the operation proceeds to step S9 and the determining portion 37 determines the press contact terminal 100 as the object to be inspected as an acceptable product. When it is determined that the differences ΔP, ΔH are equal to or larger than the predetermined values, the operation proceeds to step S10 and the determining portion 37 determines the press contact terminal 100 as the object to be inspected as an unacceptable product.

Next, in determining acceptability of the press contact terminal 100 in mass production, or in determining acceptability thereof by actually bringing the electric wire 2 into press contact with the trially fabricated press contact terminal 100, first, the light emitting portion 11 and the image pickup portion 12 are disposed at the second position shown in FIG. 2 and FIG. 5. At step S11 in FIG. 23, the control apparatus 8 makes the measuring apparatus 5 emit light from the light emitting portion 11 to the image pickup portion 12. The control apparatus 8 makes the processing apparatus 17 drive the respective moving portions 19, 20 to coincide the optical axis of the collimator 25 of the light emitting portion 11 and the optical axis of the collimator 30 of the image pickup portion 12 based on the optical axis of light provided by receiving light by the optical axis matching image pickup element 28.

The press contact terminal 100 is positioned above the surface 64*a* of the holding portion 64 of the press contact apparatus 60. At this occasion, the press contact terminal 100, that is, the press contact blades 111*a*, 111*b*, 111 are held at the press contact apparatus 60 in a state in which the longitudinal direction of the electric wire 2 inserted between the press contact blades 111*a*, 111*b*, 111 and the optical axis of light emitted by the light emitting portion 11 are in parallel with each other. At this occasion, the electric wire connecting portion 104 of the press contact terminal 100 is brought into the state before press contact.

The control apparatus 8 makes the processing apparatus 17 emit light from the light emitting portion 11 to the image pickup portion 12 and make the image pickup portion 12 pick up the image. The control apparatus 8 makes the processing apparatus 17 calculate the distance h1 between the outer faces 109*a* of the pair of side walls 109 and store the calculated distance h1. In this way, at step S11, the distance h1 between the outer faces 109*a* of the pair of side walls 109 of the press contact terminal 100 before press contact is calculated by aligning the optical axis of the light emitting portion 11 and the optical axis of the image pickup portion 12. The operation proceeds to step S12.

At step S12, the control apparatus 8 makes the press contact apparatus 60 bring the electric wire 2 into press contact with the press contact terminal 100 and fasten the fastening pieces 112. Then, the pair of side walls 109, that is, the press contact blades 111*b* are separated from each other. The control apparatus 8 makes the processing apparatus 17 emit light from the light emitting portion 11 to the image pickup portion 12 and make the image pickup portion 12 pick up the image. The image pickup portion 12 provides the image G1*b* (shown in FIG. 24) showing the outer shapes of the press contact blades 111*a*, 111*b*, 111*c* viewed from the position along the longitudinal direction of the electric wire 2 at an interval therefrom.

At this occasion, light is emitted from the light emitting portion 11 to the image pickup portion 12 and therefore, in the image G1*b* provided by the image pickup portion 12, the holding portion 64, the pair of side walls 109 and the press contact blades 111*a*, 111*b*, 111*c* become dark by constituting shadow and the other portion becomes bright. In this way, at step S12, the images of the press contact blades 111*a*, 111*b*, 111*c* of the press contact terminal 100 are picked up. In this way, at step S12, the electric wire 12 is brought into press contact with the press contact terminal 100 and images thereof are picked up. The operation proceeds to step S13.

Figure 24:
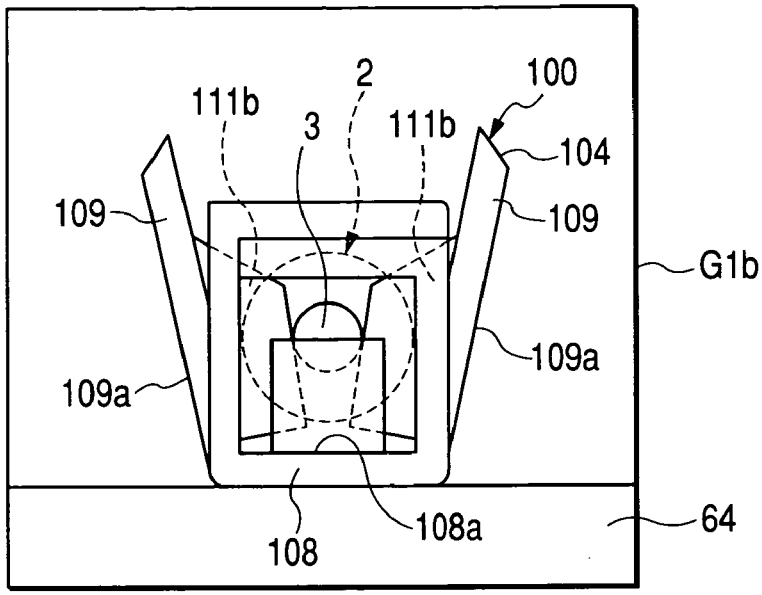
FIG. 24 is an explanatory view showing an image provided at step S12 of the flowchart shown in FIG. 23.
Figure 25:
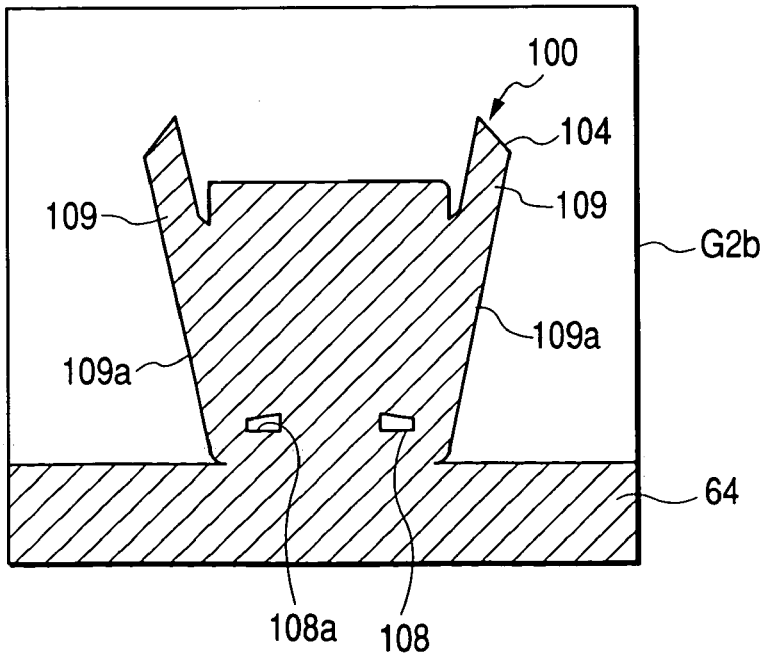
FIG. 25 is an explanatory view showing a binarized image provided by binarizing the image shown in FIG. 24.
Figure 26:
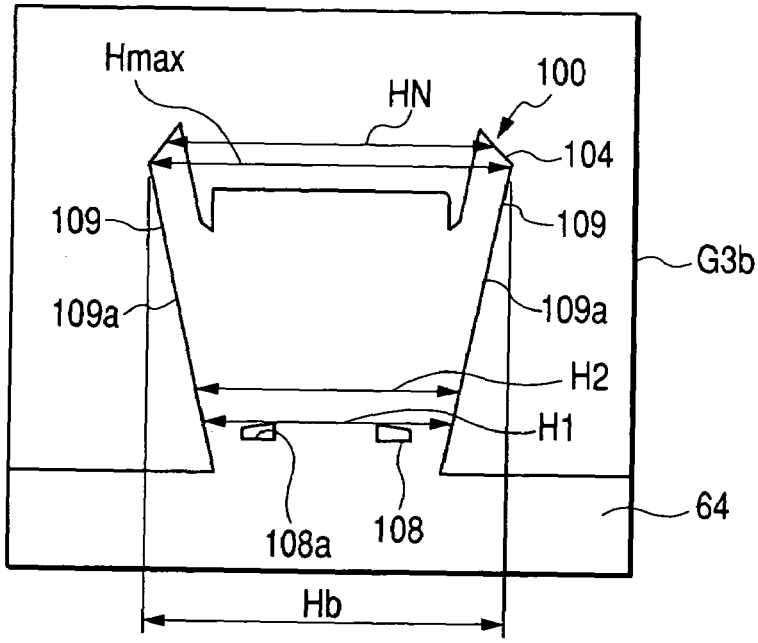
FIG. 26 is an explanatory view showing an image provided by extracting an outer shape (edge) from the binarized image shown in FIG. 25.
Figure 27:
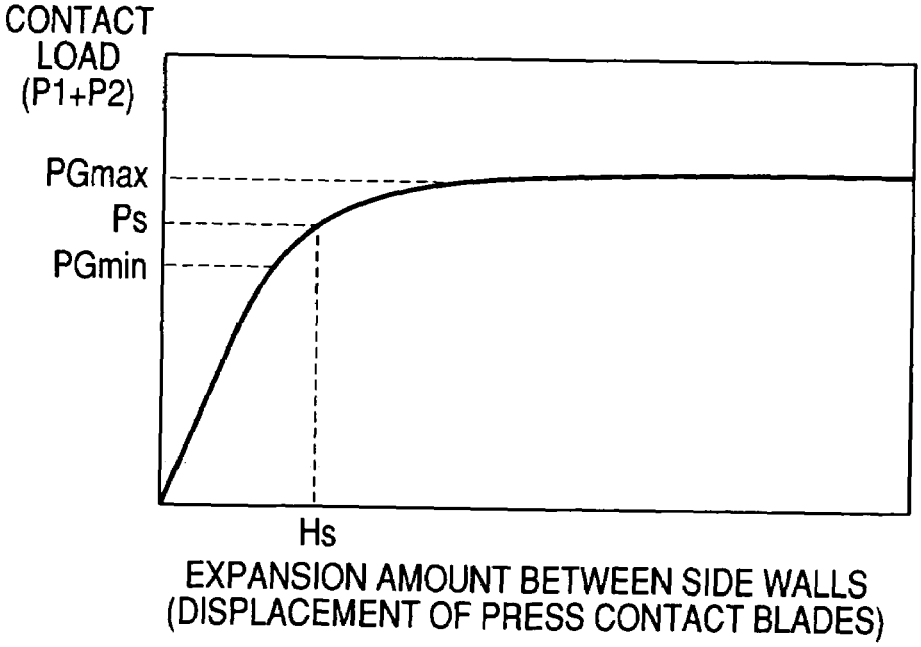
FIG. 27 is an explanatory view showing a procedure of predicting a contact load at step S16 of the flowchart shown in FIG. 23.

At step S13, the image G1*b* shown in FIG. 24 is binarized by a predetermined threshold to provide the binarized image G2*b* shown in FIG. 25. In the binarized image G2*b* shown in FIG. 25, the holding portion 64, the pair of side walls 109 and the press contact blades 111*a*, 111*b*, 111*c* shown by parallel hatched lines become black and the other portion becomes white. In this way, at step S13, the binarization is carried out and the operation proceeds to step S14.

At step S14, a boundary of white and black of the binarized image G2*b*, that is, the outer shapes (edges) of the pair of side walls 109, the press contact blades 111*a*, 111*b*, 111*c* and the holding portion 64 are extracted to provide the image G3*b* shown in FIG. 26. The operation proceeds to step S15.

At step S15, the processing apparatus 17 extracts the surface 108*a* of the bottom wall 108 from the extracted outer shapes (edges), calculates the widths (H1, H2 . . . HN) of the outer shapes (edges) along the surface 108*a* and calculates the maximum width Hmax. The processing apparatus 17 outputs the maximum width Hmax to the control apparatus 8 as the distance Hb between the outer faces 109*a* of the pair of side walls 109. The control apparatus 8 calculates the difference Hs between the distance Hb and the h1 and stores the difference as the displacement Hs of the press contact blades 111*b*. The operation proceeds to step S16.

At step S16, the prediction determining portion 38 of the control apparatus 38 predicts the contact load Ps (shown in FIG. 27) between the press contact blades 111*a*, 111*b*, 111*c* and the core wire 3 of the electric wire 2 based on the reference data KD and the measured displacement Hs of the press contact blades 111*b*. The operation proceeds to step S17.

At step S17, the predication determining portion 38 of the control apparatus 8 determines whether the predicted contact load Ps is equal to or larger than PGmin and equal to or smaller than PGmax. That is, it is determined whether the predicated contact load Ps falls in a predetermined range. When it is determined that the predicted contact load Ps is equal to or larger than PGmin and equal to or smaller than PGmax, that is, it is determined that the predicted contact load Ps falls in the predetermined range, the prediction determining portion 38 proceeds to step S18 and determines the press contact terminal 100 as the object to be inspected as an acceptable product. When it is determined that the predicted contact load Ps is less than PGmin or exceeds PGmax, that is, when it is determined that the predicted contact load Ps does not fall in the predetermined range, the prediction determining portion 38 proceeds to step S19 and determines the press contact terminal 100 as the object to be inspected as an unacceptable product.

According to the embodiment, the piezoelectric element 7 as the detector is inserted between the press contact blades 111*b*. Therefore, in inserting the piezoelectric element 7 between the pair of press contact blades 111*b*, the press contact blades 111*b*, that is, the pair of side walls 109 are not hampered from separating from each other. Therefore, information in accordance with the contact loads P1, P2 between the press contact blades 111*b* detected by the piezoelectric element 7 becomes proximate to the contact loads when the electric wire 2 is inserted between the pair of press contact blades 111*b*. Therefore, the contact loads P1, P2 calculated by the calculating portion 35 of the control apparatus 8 become proximate to the contact loads when the electric wire 2 is inserted between the pair of press contact blades 111*b*.

In inserting the piezoelectric element 7 as the detector between the press contact blades 111*b*, the press contact blades 111*b*, that is, the pair of side walls 109 are not hampered from separating from each other. Therefore, the characteristic data TD showing the relationship between information in accordance with the contact loads P1, P2 between the piezoelectric element 7 and the press contact blades 111*b* produced thereby and the displacements of the press contact blades 111*b* measured by the measuring apparatus 5 becomes proximate to the data when the electric wire 2 is actually brought into press contact with the press contact terminal 100 as the object to be inspected.

The determining portion 37 of the control apparatus 8 determines acceptability of the press contact terminal 100 based on the characteristic data TD and the reference data KD. Since the characteristic data TD is accurate, acceptability of the press contact terminal 100 can accurately be determined.

The measuring apparatus 5 measures the displacement Hs of the press contact blades 111*a*, 111*b*, 111*c* when the electric wire 2 is inserted between the press contact blades 111*a*, 111*b*, 111*c* of the press contact terminal 100 by the press contact apparatus 60. Therefore, there is measured the displacement Hs of the press contact blades 111*a*, 111*b*, 111*c* in a state in which the pair of side walls 109 are not hampered from separating from each other. Therefore, the measured displacement Hs of the press contact blades 111*a*, 111*b*, 111*c* is accurate.

The prediction determining portion 38 of the control apparatus 8 predicts the contact load Ps between the core wire 3 of the electric wire 2 and the press contact blades 111*a*, 111*b*, 111*c* based on the reference data KD stored to the storing portion 34 and the displacement Hs of the press contact blades 111*a*, 111*b*, 111*c* measured by the measuring apparatus 5. Therefore, the predicted contact load Ps becomes proximate to an actual value. That is, the predicted contact load Ps becomes accurate.

The prediction determining portion 38 determines acceptability of the press contact terminal 100 based on the predicted contact load Ps. Since the predicted contact load Ps is accurate, acceptability of the press contact terminal 100 can accurately be determined.

The terminal holding portion 13 holding the press contact terminal 100 is positioned in the state in which the optical axis of the light emitted by the light emitting portion 11 between the light emitting portion 11 and the image pickup portion 12 and the electric wire 2 are in parallel with each other. Therefore, the image pickup portion 12 acquires the outer shapes of the press contact blades 111*a*, 111*b*, 111*c* viewed from the position along the longitudinal direction of the electric wire 2 inserted between the press contact blades 111*a*, 111*b*, 111*c* at an interval therefrom.

Since the displacements of the press contact blades 111*a*, 111*b*, 111*c* are measured from the outer shapes acquired by the processing apparatus 17, the measured displacements of the press contact blades 111*a*, 111*b*, 111*c* become accurate. Therefore, acceptability of the press contact terminal 100 can further accurately be determined.

The press contact terminal 100 held by the press contact apparatus 60 is positioned in the state in which the optical axis of light emitted by the light emitting portion 11 between the light emitting portion 11 and the image pickup portion 12 and the electric wire 2 are in parallel with each other. Therefore, the image pickup portion 12 acquires the outer shapes of the press contact blades 111*a*, 111*b*, 111*c* viewed from the position along the longitudinal direction of the electric wire inserted between the press contact blades 111*a*, 111*b*, 111*c* at an interval therefrom.

Since the displacement Hs of the press contact blades 111*a*, 111*b*, 111*c* is measured from the outer shapes acquired from the processing apparatus 17, the measured displacement Hs of the press contact blades 111*a*, 111*b*, 111*c* become accurate. Therefore, acceptability of the press contact terminal 100 can further accurately be determined.

The piezoelectric element 7 is used as the detector. The width W of the piezoelectric element 7 is equal to or larger than the interval D between the press contact blades 111*a*, 111*b*, 111*c* and equal to or smaller than the outer diameter R of the core wire 3 of the electric wire 2. Therefore, a state of the press contact blades 111*b* when the piezoelectric element 7 is inserted between the pair of press contact blades 111*b* and a state of the press contact blades 111*a*, 111*b*, 111*c* when the electric wire 2 is inserted between the pair of press contact blades 111*a*, 111*b*, 111*c* become proximate to each other. The control apparatus 8 calculates the contact loads P1, P2 based on the output current of the piezoelectric element 7 by using the piezoelectric element 7 as the detector. Therefore, the accurate contact loads P1, P2 can be provided. Therefore, not only the further accurate characteristic data TD can be provided but also acceptability of the press contact terminal 100 can further accurately be determined.

Second Embodiment

Next, an explanation will be given of the determining apparatus 1 according to a second embodiment of the invention in reference to FIG. 28 through FIG. 36. Portions thereof the same as those of the first embodiment are attached with the same notations and an explanation thereof will be omitted.

Figure 28:
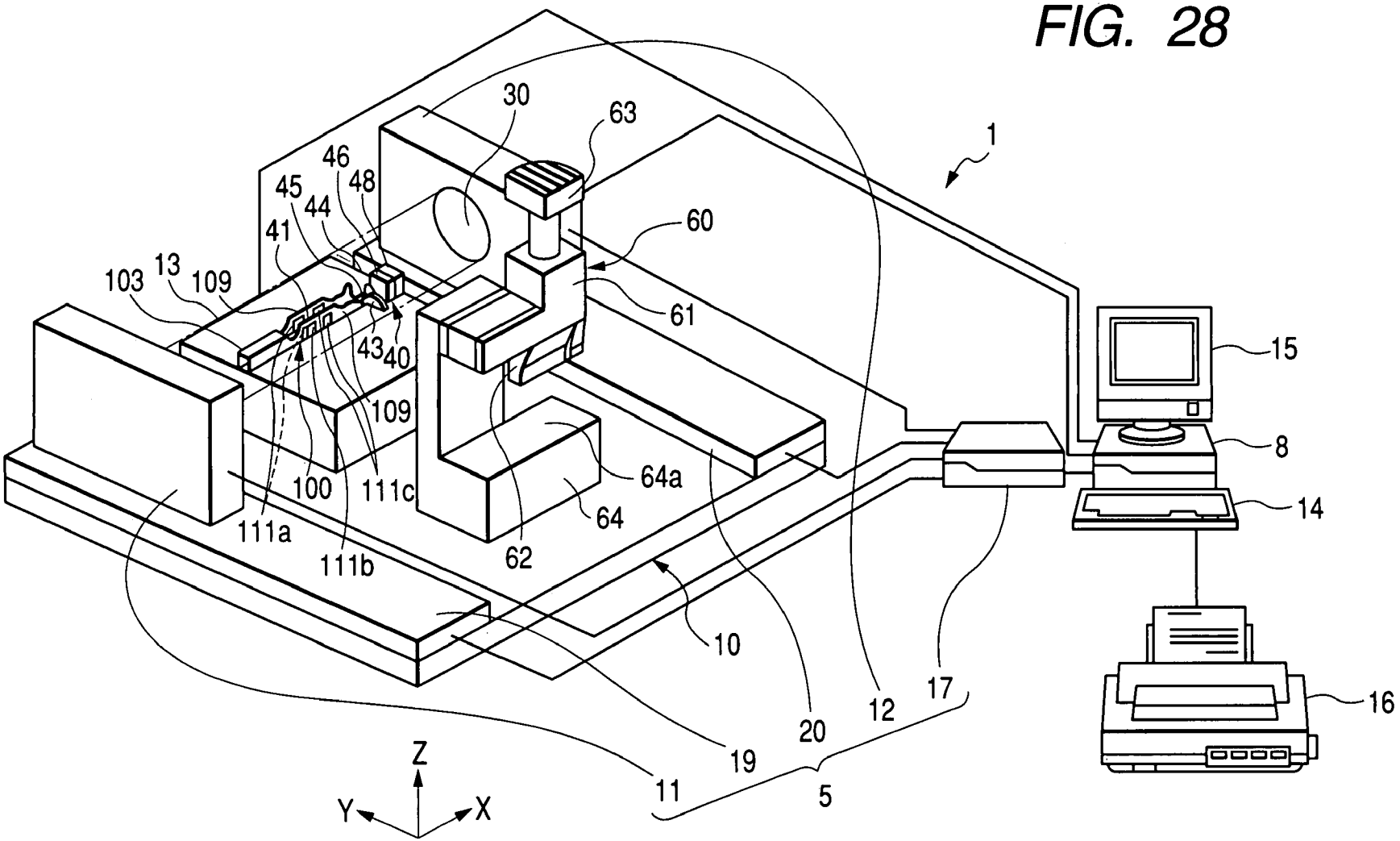
FIG. 28 is an explanatory view showing a constitution of a determining apparatus according to a second embodiment of the invention.
Figure 29:
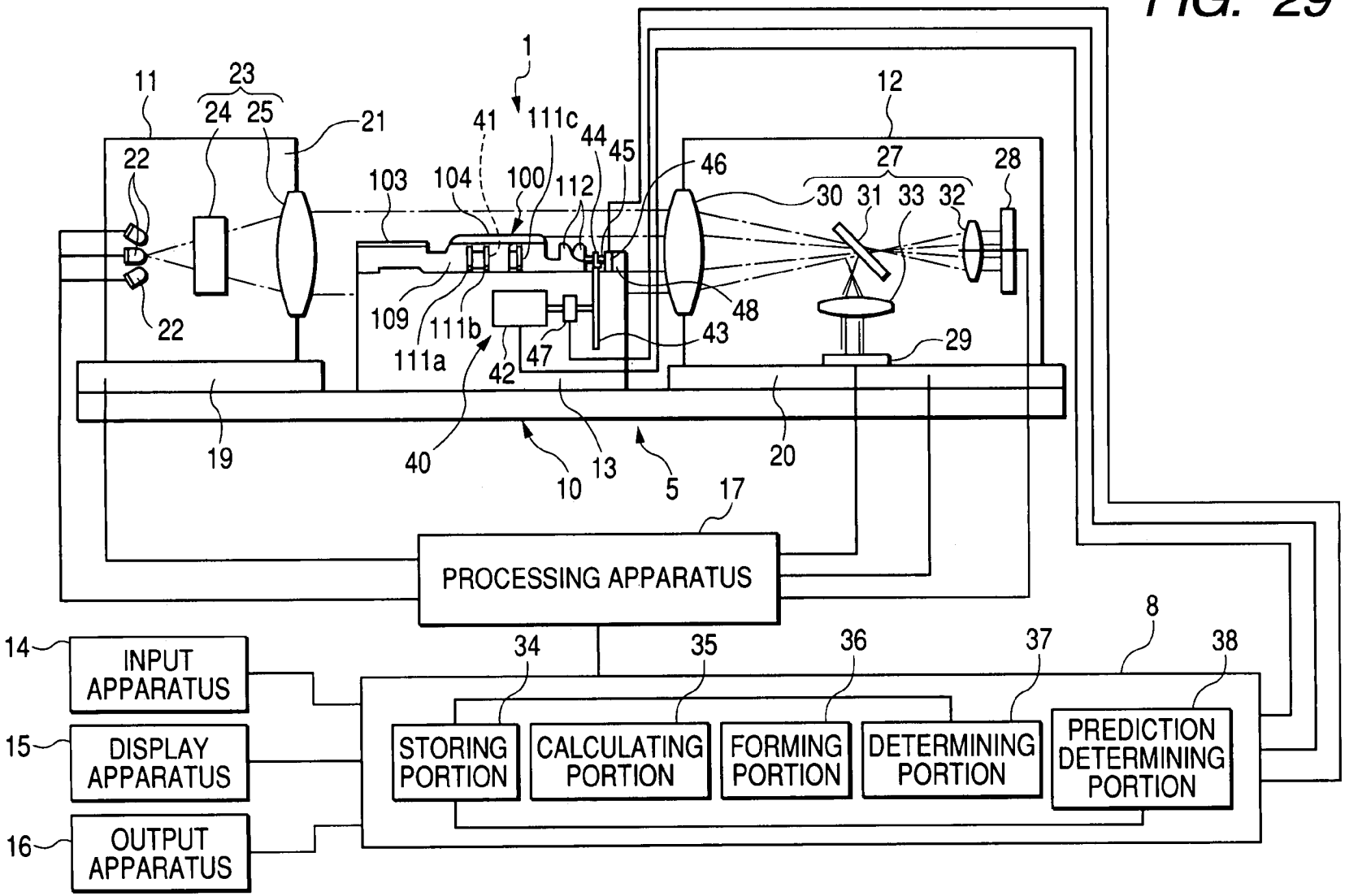
FIG. 29 is a block diagram showing a constitution of a measuring apparatus of the determining apparatus shown in FIG. 28.

As shown by FIG. 28 and FIG. 29, the determining apparatus 1 of the embodiment is provided with a rotating mechanism 40 and a rotor 41 in place of the detector moving portion 6 and the piezoelectric element 7. The rotor 41 constitutes the detector described in the specification. As shown by FIG. 29, the rotating mechanism 40 is provided with a motor 42 as a drive source, a large diameter gear 43, a small diameter gear 44, a rotating shaft 45, a revolution counter 46, and a torque meter 47. The motor 42 is attached to the terminal holding portion 13. An output shaft of the motor 42 is in parallel with the optical axis of light emitted by the light emitting portion 11.

The large diameter gear 43 is attached to the output shaft of the motor 42. The large diameter gear 43 and the output shaft of the motor 42 are coaxial. The small diameter gear 44 is brought in mesh with the large diameter gear 43. An outer diameter of the small diameter gear 44 is smaller than an outer diameter of the large diameter gear 43. The rotating shaft 45 is formed in a rod like shape and is rotatably supported by the terminal holding portion 13 by a bearing 48. The rotating shaft 45 is attached with the small diameter gear 44. The rotating shaft 45 and the small diameter gear 44 are coaxial.

The revolution counter 46 is attached to the rotating shaft 45. The resolution counter 46 detects a rotational angle of the rotating shaft 45. The revolution counter 46 is connected to the control apparatus 8 and outputs information in accordance with the rotational angle of the rotating shaft 45 to the control apparatus 8.

The torque meter 47 is attached to the output shaft of the motor 42. The torque meter 47 detects a torque of the output shaft of the motor 42. The torque meter 47 is connected to the control apparatus 8 and outputs information in accordance with the torque of the output shaft of the motor 42, that is, the torque of the rotating shaft 45 to the control apparatus 8. The torque constitutes information in accordance with the contact loads P1, P2 described in the specification.

Figure 34:
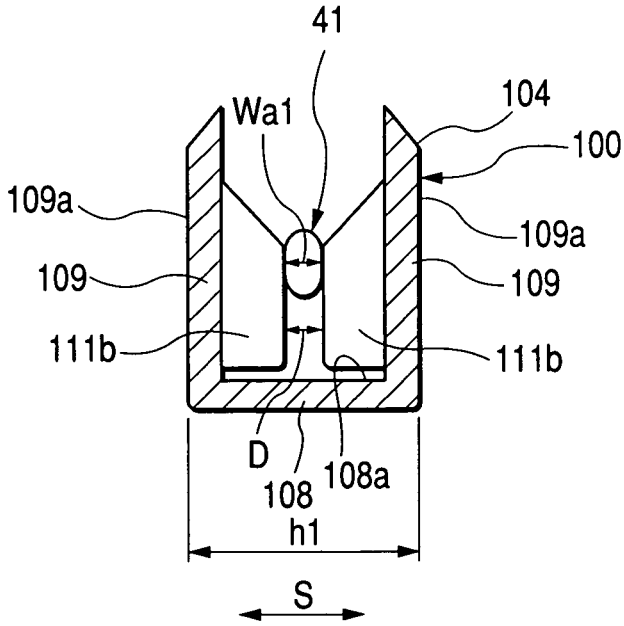
FIG. 34 is a sectional view taken along a line E-E of FIG. 32.
Figure 35:
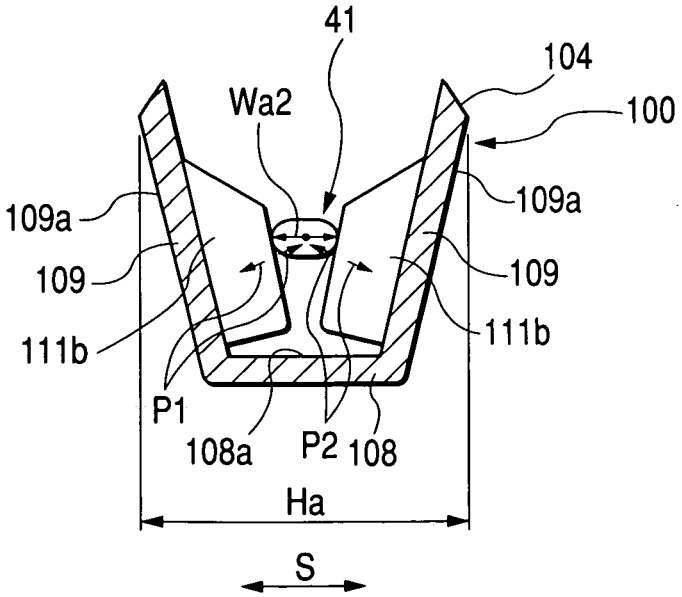
FIG. 35 is a sectional view taken along a line F-F of FIG. 33.
Figure 36:
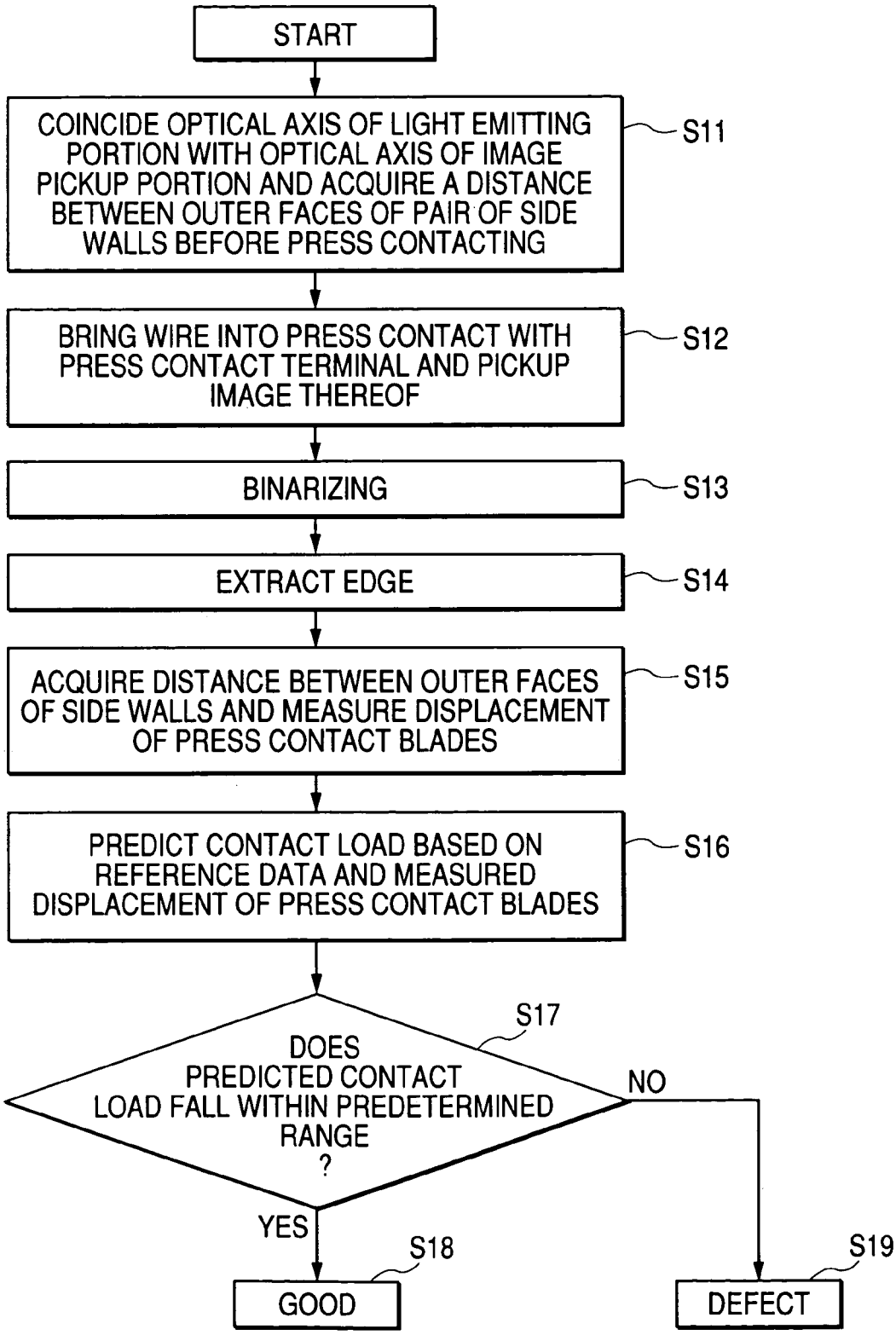
FIG. 36 is a flowchart showing a procedure of determining the acceptability of the press contact terminal by inserting an electric wire between the press contact blades by the determining apparatus shown in FIG. 28.

As shown by FIG. 34 and FIG. 35, the rotor 41 is formed in an oval shape in a plane shape thereof. A center of the rotor 41 is attached with the rotating shaft 45. Therefore, the rotor 41 is rotated by the motor 42. The rotor 46 is inserted between the press contact blades 111*b* of the electric wire connecting portion 104 of the press contact terminal 100 attached to the terminal holding portion 13. A width Wa1 (shown in FIG. 34) in a direction of a short diameter of the rotor 41 constitutes a minimum width of the rotor 41 described in the specification. A width Wa2 (shown in FIG. 35) in a direction of a long diameter of the rotor 41 constitutes a maximum width of the rotor 41 described in the specification.

The width Wa1 in the direction of the short diameter of the rotor 41 and the width Wa2 in the direction of the long diameter thereof are equal to or larger than the interval between the press contact blades 111*a*, 111*b*, 111*c* and equal to or smaller than the outer diameter R of the core wire 3 of the electric wire 2. In the illustrated example, the width Wa1 in the direction of the short diameter is equal to the interval D between the press contact blades 111*a*, 111*b*, 111*c* and the width Wa2 in the direction of the long diameter is equal to the outer diameter R of the core wire 3 of the electric wire 2. The rotor 41 produces information in accordance with the torque, that is, the contact loads P1, P2 by being brought into contact with the press contact blades 111*b* by being inserted between the press contact blades 111*b* and rotated by the motor 42.

The control apparatus 8 of the embodiment is connected with the motor 42, the resolution counter 46 and the torque meter 47 of the rotating mechanism 40. The control apparatus 8 controls the motor 42 based on information in accordance with the rotational angle of the rotating shaft 45 from the revolution counter 46. The calculating portion 35 of the control apparatus 8 calculates the contact loads P1, P2 based on information in accordance with the torque inputted from the torque meter 47.

A program stored to the storing portion 34 of the control apparatus 8 makes the processing apparatus 17 of the measuring apparatus 5 coincide the optical axes of the collimators 25, 30 before the light emitting portion 11 and the image pickup portion 12 are disposed at both of the first position and the second position to determine acceptability of the press contact terminal 100.

The program makes the processing apparatus 17 pick up the image of the press contact terminal 100 when the light emitting portion 11 and the image pickup portion 12 are disposed at the first position, the press contact terminal 100 is attached to the terminal holding portion 13 and the rotor 41 is inserted between the press contact blades 111*b*. At this occasion, as shown by FIG. 34, the long diameter of the rotor 41 is made to be along the vertical direction, that is, the outer face 109*a* of the side wall 109. The program makes the processing apparatus 17 binarize the picked up image and thereafter calculate the distance h1 (shown in FIG. 34) between the outer faces 109*a* of the pair of side walls 109. The distance h1 constitutes the width of the press contact terminal 100 before press contact. The control apparatus 8 is stored with the width h1.

The program gradually rotates the rotor 41 by driving the motor 42 of the rotating mechanism 40. When rotation of the rotor 41 is recognized based on information from the revolution counter 46, the program stops the rotating mechanism 40 and makes the measuring apparatus 5 measure the distance Ha (shown in FIG. 35) between the outer faces 109*a* of the pair of side walls 109. The program calculates the difference between the measured distance Ha and the distance h1 to thereby calculate the deformations of the pair or side walls 109, that is, the press contact blades 111*b*.

The calculating portion 35 of the control apparatus 8 calculates the contact loads P1, P2 (shown in FIG. 35) between the rotor 41 and the press contact blades 111*b* by dividing the torque inputted from the torque meter 47 by a half value of the width Wa2 in the direction of the long diameter of the rotor 41. The calculating portion 35 outputs the calculated contact loads P1, P2 to the forming portion 36.

The program makes the rotating mechanism 40 rotate the rotor 41 by a previously determined angle. That is, the program rotates further the rotor 41. Thereafter, the program calculates the deformation of the press contact blades 111*b* as described above and makes the calculating portion 35 calculate the contact loads P1, P2 to output to the forming portion 36.

The program rotates the rotor 41 between the pair of press contact blades 111*b* until the rotor 41 is rotated by a predetermined angle (until the long diameter shown in FIG. 35 becomes in parallel with the arrow mark S). The program calculates the deformation of the press contact blades 111*b* until the rotor 41 is rotated by the predetermined angle (until the long diameter becomes in parallel with the arrow mark S)

and makes the calculating portion 35 calculate the contact loads P1, P2 to output to the forming portion 36. When the rotor 41 is rotated by the predetermined angle, the program makes the rotating mechanism 40 stop rotating the rotor 41.

The forming portion 36 calculates the sum of the contact loads P1, P2. The forming portion 36 forms the characteristic data TD similar to the first embodiment and outputs the formed characteristic data TD to the determining portion 37. The determining portion 37 determines acceptability of the press contact terminal 100 based on the characteristic data TD and the reference data KD similar to the first embodiment.

In this way, the control apparatus 8 positions the light emitting portion 11 and the image pickup portion 12 to the first position, acquires the characteristic data TD and determines acceptability of the press contact terminal 100 based on the characteristic data TD and the reference data KD.

The control apparatus 8 positions the light emitting portion 11 and the image pickup portion 12 at the second position and determines acceptability of the press contact terminal 100 brought into press contact with the electric wire 2 by the press contact apparatus 60 similar to the first embodiment.

Next, an explanation will be given of a procedure of examining acceptability of the press contact terminal 100 by the determining apparatus 1 of the embodiment.

Figure 30:
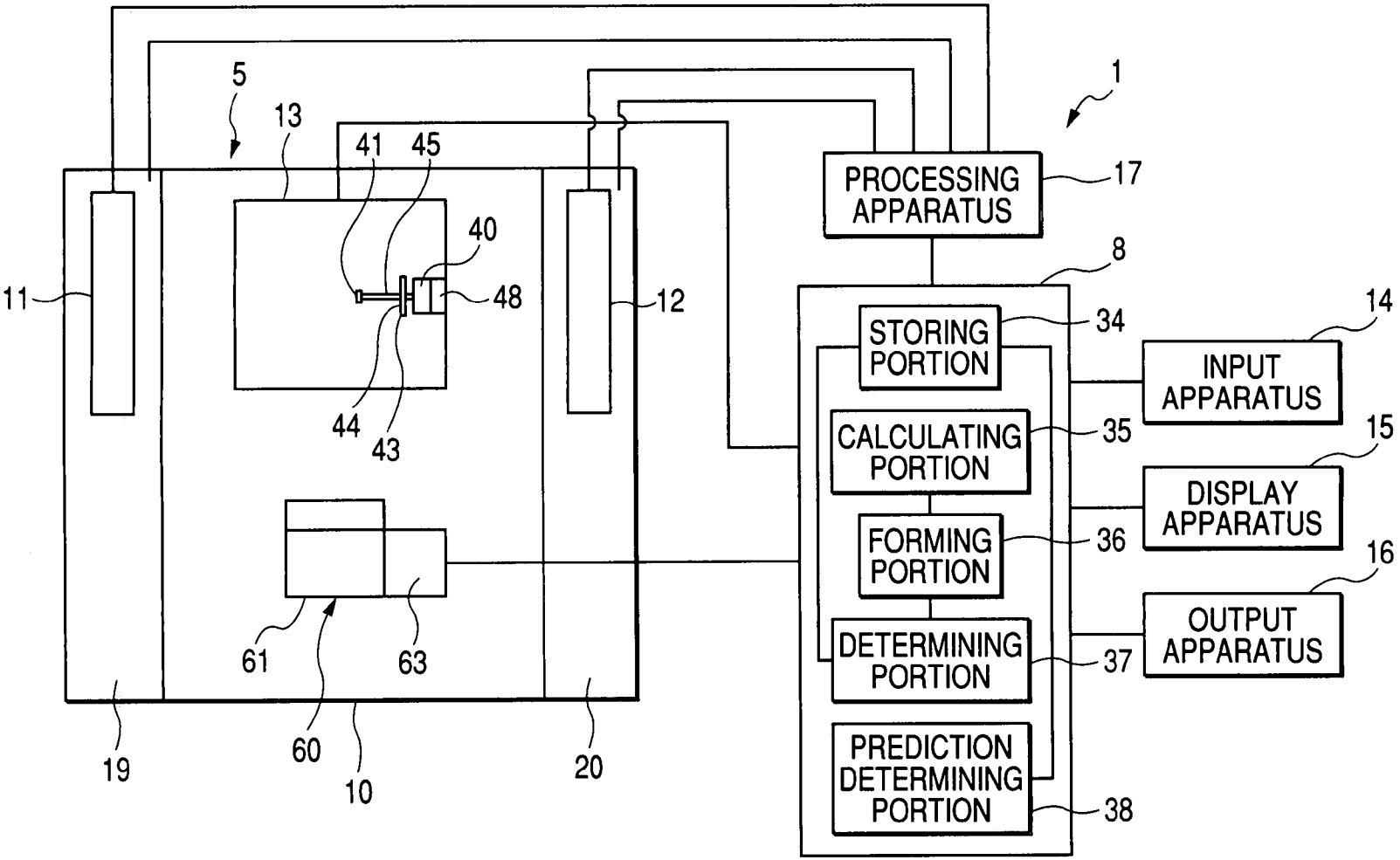
FIG. 30 is an explanatory view showing a total constitution of the determining apparatus shown in FIG. 28.
Figure 31:
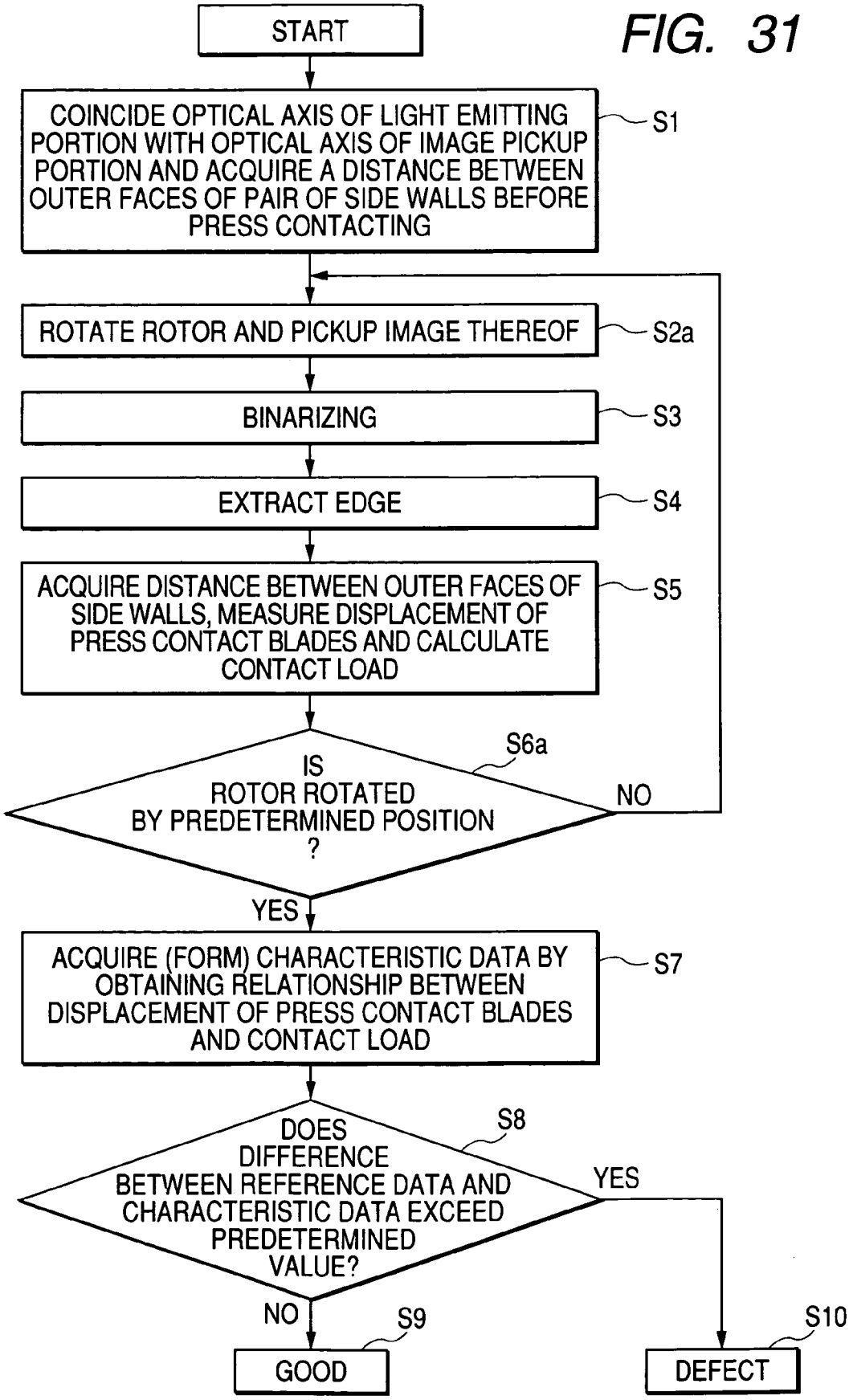
FIG. 31 is a flowchart showing a procedure of determining acceptability of a press contact terminal by rotating a rotor inserted between press contact blades by the determining apparatus shown in FIG. 28.

First, in determining acceptability of, for example, the designed and trially produced press contact terminal 100, the light emitting portion 11 and the image pickup portion 12 are positioned at the first position shown in FIG. 28 and FIG. 30. At step S1 in FIG. 31, the control apparatus 8 makes the measuring apparatus 5 emit light from the light emitting portion 11 to the image pickup portion 12. The control apparatus 8 makes the processing portion 17 coincide the optical axis of the collimator 25 of the light emitting portion 11 and the optical axis of the collimator 30 of the image pickup portion 12 by driving the respective moving portions 19, 20 based on the optical axis of light provided by receiving light by the optical axis matching image pickup element 28.

Figure 32:
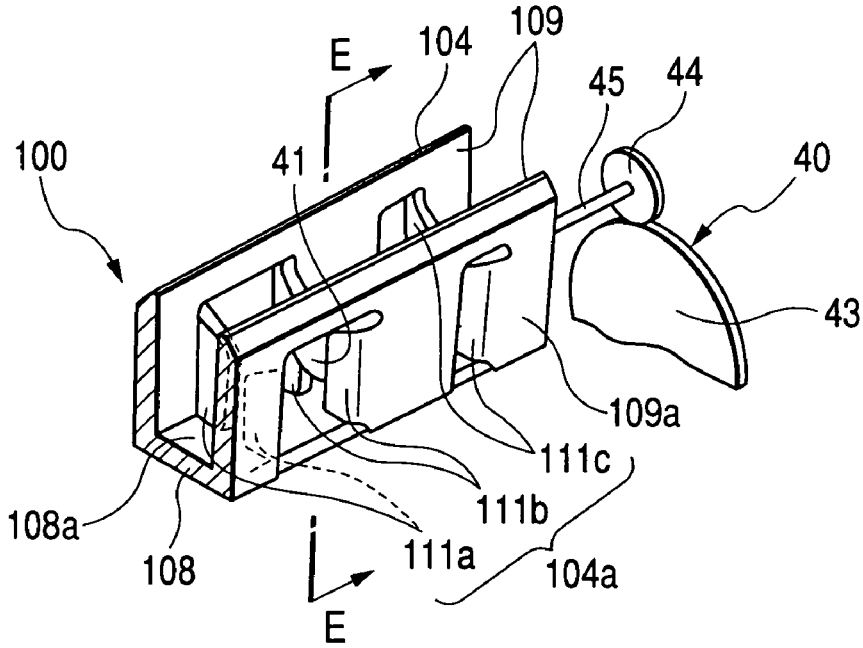
FIG. 32 is a perspective view showing a state of positioning the rotor of the determining apparatuses shown in FIGS. 28 and 63 between the press contact blades.

The terminal holding portion 13 is attached with the press contact terminal 100, that is, the press contact blades 111*a*, 111*b*, 111 and the rotor 41 is inserted between the press contact blades 111*b*. At this occasion, the long diameter of the rotor 41 is made to be along the vertical direction and as shown by FIG. 32 and FIG. 34, the electric wire connecting portion 104 of the press contact terminal 100 is brought into a state before press contact. The press contact terminal 100, that is, the press contact blades 111*a*, 111*b*, 111 are attached to the terminal holding portion 13 in a state in which the longitudinal direction of the electric wire 2 inserted between the press contact blades 111*a*, 111*b*, 111 and the optical axis of light emitted by the light emitting portion 11 are in parallel with each other.

The control apparatus 8 makes the processing portion 17 emit light from the light emitting portion 11 to the image pickup portion 12 and makes the image pickup portion 12 pick up the image. The control apparatus 8 makes the processing apparatus 17 calculate the distance Hi between the outer faces 109*a* of the pair of side walls 109 and store the calculated distance h1. In this way, at step S1, the distance h1 between the outer faces 109*a* of the pair of side walls 109 of the press contact terminal 100 before press contact is calculated by aligning the optical axis of the light emitting portion 11 and the optical axis of the image pickup portion 12. The operation proceeds to step S2*a*.

At step S2*a*, the control apparatus 8 makes the rotating mechanism 40 gradually rotate the rotor 41 between the press contact blades 111*b*. When the control apparatus 8 is inputted with information indicating rotation of the rotating shaft 45 from the revolution counter 46, the pair of side walls 109, that is, the press contact blades 111*b* are gradually separated from each other. Then, the control apparatus 8 stops the rotating mechanism 40. The control apparatus 8 makes the processing apparatus 17 emit light from the light emitting portion 11 to the image pickup portion 12 and makes the image pickup portion 12 pick up the image and the operation proceeds to step S3.

At step S3, the picked-up image is binarized by the predetermined threshold and the operation proceeds to step S4. At step S4, the operation extracts the outer shapes (edges) of the pair of side walls 109, the press contact blades 111*a*, 111*b*, 111*c* and the terminal holding portion 13 of the image provided by the binarization and proceeds to step S5.

At step S5, the processing apparatus 17 calculates the distance Ha between the outer faces 109*a* of the pair of side walls 109 to output to the control apparatus 8. The control apparatus 8 calculates the difference between the distance Ha and the h1 and stores the difference as the displacements of the press contact blades 111*b*.

At step S5, the calculating portion 35 of the control apparatus 8 calculates the contact loads P1, P2 between the rotor 41 and the press contact blades 111*b* by dividing the torque from the torque meter 47 by the half value of the width Wa2 in the direction of the long diameter of the rotor 41. The control apparatus 8 stores the sum of the contact loads P1, P2. In this way, at step S5, the distance Ha between the outer faces 109*a* of the side walls 109 is calculated, the displacements of the press contact blades 111*b* are measured and the contact loads P1, P2 between the rotor 41 and the press contact blades 111*b* are calculated. The operation proceeds to step S6*a*.

At step S6*a*, the control apparatus 8 determines whether the rotor 41 is rotated to the predetermined angle. When it is determined that the rotor 41 is not rotated to the predetermined angle, the operation returns to step S2*a*. At step S2*a*, the control apparatus 8 drives again the rotating mechanism 40 and rotates the rotor 41 between the press contact blades 111*b*. The operation successively proceeds from step S2*a* to step S5 and calculates the displacements of the press contact blades 111*b* and the sum of the press contact loads P1, P2 to store. In this way, the control apparatus 8 calculates the displacements of the press contact blades 111*b* and the sum of the contact loads P1, P2 by gradually rotating the rotor 41 between the press contact blades 111*b* until the rotor 41 is rotated by the predetermine angle shown in FIG. 33 and FIG. 35.

When it is determined at step S6*a* that the rotor 41 is rotated between the press contact blade 111*b* to the predetermined angle, the operation proceeds to step S7. At step S7, the forming portion 36 acquires (forms) the characteristic data TD based on the displacements of the press contact blades 111*b* and the contact loads P1, P2 which are stored as described above. When the characteristic data TD is formed at step S7, the operation proceeds to step S8.

At step S8, the determining portion 37 calculates the differences ΔP, ΔH between the reference data KD and the characteristic data TD in the case of the predetermined displacement Hx and the predetermined contact load Px. The determining portion 37 determines whether the differences ΔP, ΔH are equal to or larger than the predetermined values. When it is determined that the difference ΔP, ΔH are less than the predetermined values, the operation proceeds to step S9 and the determining portion 37 determines the press contact terminal 100 as the object to be inspected as an acceptable product. When it is determined that the differences ΔP, ΔH are equal to or larger than the predetermined values, the operation proceeds to step S10 and the determining portion 37 determines the press contact terminal as the object to be inspected as an unacceptable product.

Next, for example, in determining acceptability of the press contact terminal 100 in mass production, or in determining acceptability thereof by actually bringing the electric wire 2 into press contact with the trially fabricated press contact terminal 100, first, the light emitting portion 11 and the image pickup portion 12 are positioned to the second position. At step S11 in FIG. 36, the control apparatus 8 makes the measuring apparatus 5 emit light from the light emitting portion 11 to the image pickup portion 12. The control apparatus 8 makes the processing portion 17 coincide the optical axis of the collimator 25 of the light emitting portion 11 and the optical axis of the collimator 30 of the image pickup portion 12 by driving the respective moving portions 19, 21 based on the optical axis of light provided by receiving light by the optical axis matching image pickup element 28.

The press contact terminal 100 is positioned above the surface 64*a* of the holding portion 64 of the press contact apparatus 60. At this occasion, the press contact terminal 100, that is, the press contact blades 111*a*, 111*b*, 111 are held at the press contact apparatus 60 in a state in which the longitudinal direction of the electric wire 2 inserted between the press contact blades 111*a*, 111*b*, 111 and the optical axis of light emitted by the light emitting portion 11 are in parallel with each other. At this occasion, the electric wire connecting portion 104 of the press contact terminal 100 is brought into a state before press contact.

The control apparatus 8 makes the processing apparatus 17 emit light from the light emitting portion 11 to the image pickup portion 12 and makes the image pickup portion 12 pick up the image. The control apparatus 8 makes the processing apparatus 17 calculate the distance h1 between the outer faces 109*a* of the pair of side walls 109 to store the calculated distance h1. In this way, at step S11, the distance h1 between the outer faces 109*a* of the pair of side walls 209 of the press contact terminal 100 before press contact is calculated by aligning the optical axis of the light emitting portion 11 and the optical axis of the image pickup portion 12. The operation proceeds to step S12.

At step S12, the control apparatus 8 makes the press contact apparatus 60 bring the electric wire 2 into press contact with the press contact terminal 100. Then, the pair of side walls 109, that is, the press contact blades 111*b* are separated from each other. The control apparatus 8 makes the processing apparatus 17 emit light from the light emitting portion 11 to the image pickup portion 12 and the makes the image pickup portion 12 pick up the image. The image pickup portion 12 is provided with the image showing the outer shapes of the press contact blades 111*a*, 111*b*, 111*c* viewed from the position along the longitudinal direction of the electric wire 2 at an interval therefrom. In this way, at step S12, the images of the press contact blades 111*a*, 111*b*, 111*c* of the press contact terminal 100 are picked up. In this way, at step S12, the electric wire 2 is brought into press contact with the press contact terminal 100 and the images are picked up. The operation proceeds to step S13.

At step S13, the image is binarized by the predetermined threshold to thereby provide the binarized image. In the binarized image, the pair of side walls 109 and the press contact blades 111*a*, 111*b*, 111*c* become black and the other portion becomes white. In this way, at step S23, the binarization is carried out and the operation proceeds to step S14.

At step S14, the operation extracts the outer shapes (edges) of the pair of side walls 109, the press contact blades 111*a*, 111*b*, 111*c* and the holding portion 64 and proceeds to step S15. At step S15, the processing portion 17 extracts the surface 108*a* of the bottom wall 108 from the extracted outer shapes (edges) and calculates the distance Hb to output to the control apparatus 8. The control apparatus 8 calculates the difference Hs between the distance Hb and the h1 and stores the difference as the displacement Hs of the press contact blades 111*b*. The operation proceeds to step S26.

At step S16, the prediction determining portion 38 of the control apparatus 8 predicts the contact load Ps between the press contact blades 111*a*, 111*b*, 111*c* and the core wire 3 of the electric wire 2 based on the reference data KD and the measured displacement Hs of the press contact blades 111*b*. The operation proceeds to step S17.

At step S17, the prediction determining portion 38 of the control apparatus 8 determines whether the predicted contact load Ps falls in the predetermined range. When it is determined that the predicted contact load Ps falls in the predetermined range, the prediction determining portion 38 proceeds to step S18 and determines the press contact terminal 100 as the object to be inspected as an acceptable product. When it is determined that the predicted contact load Ps does not falls in the predetermined range, the prediction determining portion 38 proceeds to step S19 and determines the press contact terminal 100 as the object to be inspected as an unacceptable product.

According to the embodiment, the rotor 41 as the detector is inserted between the press contact blades 111*b*. Therefore, in inserting the rotor 41 between the pair of press contact blades 111*b* to rotate, the press contact blades 111*b*, that is, the pair of side walls 109 are not hampered from separating from each other. Therefore, information in accordance with the contact loads P1, P2 between the rotor 41 and the press contact blades 111*b* detected by rotating the rotor 41 becomes proximate to the contact loads when the electric wire 2 is inserted between the pair of press contact blades 111*b*. Therefore, the contact loads P1, P2 calculated by the calculating portion 35 of the control apparatus 8 become proximate to the contact loads when the electric wire 2 is inserted between the pair of press contact blades 111*b*.

In rotating the rotor 41 as the rotor between the press contact blades 111*b*, the press contact blades 111*b*, that is, the pair of side walls 109 are not hampered from separating from each other. Therefore, the characteristic data TD showing the relationship between information in accordance with the contact loads P1, P2 produced when the rotor 41 is rotated between the press contact blades 111*b* and the displacements of the press contact blades 111*b* measured by the measuring apparatus 5 becomes proximate to the data when the electric wire 2 is actually brought into, press contact with the press contact terminal 100 as the object to be inspected.

The determining portion 37 of the control apparatus 8 determines acceptability of the press contact terminal 100 based on the characteristic data TD and the reference data KD. Since the characteristic data TD is accurate, acceptability of the press contact terminal 100 can accurately be determined.

The measuring apparatus 5 measures the displacement Hs of the press contact blades 111*a*, 111*b*, 111*c* when the press contact apparatus 60 inserts the electric wire 2 between the press contact blades 111*a*, 111*b*, 111*c* of the press contact terminal 100. Therefore, there is measured the displacement Hs of the press contact blades 111*a*, 111*b*, 111*c* in a state in which the pair of side walls 109 are not hampered from separating from each other. Therefore, the measured displacement Hs of the press contact blades 111*a*, 111*b*, 111*c* is accurate.

The prediction determining portion 38 of the control apparatus 8 predicts the contact load Ps between the core wire 3 of the electric wire 2 and the press contact blades 111*a*, 111*b*, 111*c* based on the reference data KD stored to the storing portion 34 and the displacement Hs of the press contact blades 111*a*, 111*b*, 111*c* measured by the measuring apparatus 5. Therefore, the predicted contact load Ps becomes proximate to the actual value. That is, the predicted contact load Ps becomes accurate.

The prediction determining portion 38 determines acceptability of the press contact terminal 100 based on the predicted contact load Ps. Since the predicted contact load Ps is accurate, acceptability of the press contact terminal 100 can accurately be determined.

The terminal holding portion 13 for holding the press contact terminal 100 is positioned in the state in which the optical axis of light emitted by the light emitting portion 11 between the light emitting portion 11 and the image pickup portion 12 and the electric wire 2 are in parallel with each other. Therefore, the image pickup portion 12 acquires the outer shapes of the press contact blades 111*a*, 111*b*, 111*c* viewed from the position along the longitudinal direction of the electric wire 2 inserted between the press contact blades 111*a*, 111*b*, 111*c* at an interval therefrom.

Since the press apparatus 17 measures the displacement of the press contact blades 111*a*, 111*b*, 111*c* from the acquired outer shapes, the measured displacements of the press contact blades 111*a*, 111*b*, 111*c* become accurate. Therefore, acceptability of the press contact terminal 100 can further accurately be determined.

The press contact terminal 100 held by the press contact apparatus 60 is positioned in the state in which the optical axis of light emitted by the light emitting portion 11 between the light emitting portion 11 and the image pickup portion 12 and the electric wire 2 are in parallel with each other. Therefore, the image pickup portion 12 acquires the outer shapes of the press contact blades 111*a*, 111*b*, 111*c* viewed from the position along the longitudinal direction of the electric wire 2 inserted between the press contact blades 111*a*, 111*b*, 111*c* at an interval therefrom.

Since the displacement Hs of the press contact blades 111*a*, 111*b*, 111*c* is measured from the outer shapes acquired by the processing apparatus 17, the measured displacement Hs of the press contact blades 111*a*, 111*b*, 111*c* becomes accurate. Therefore, acceptability of the press contact terminal 100 can further accurately be determined.

There is used the rotor 41 producing information in accordance with the contact loads P1 and P2 by being inserted between the press contact blades 111*b* and driven to rotate by the motor 42 as the detector. Both of the width Wa2 in the direction of the long diameter of the rotor 41 and the width Wa1 in the direction of the short diameter are equal to or larger than the interval D between the press contact blades 111*b* and equal to or smaller than the outer diameter R of the core wire 3 of the electric wire 2. Therefore, the state of the press contact blades 111*b* when the rotor 41 is rotated between the press contact blades 111*b* and the state of the press contact blades 111*a*, 111*b*, 111*c* when the electric wire 2 is inserted between the pairs of the press contact blades 111*a*, 111*b*, 111*c* become proximate to each other.

The rotor 41 is used as the detector and the control apparatus 8 calculates the contract loads P1, P2 based on the torque of rotating the rotor 41. Therefore, the accurate contact loads P1, P2 can be provided. Therefore, not only the further accurate characteristic data TD can be provided but also acceptability of the press contact terminal 100 can further accurately be determined.

Third Embodiment

Next, an explanation will be given of a third embodiment of the invention in reference to FIG. 37 to FIG. 46. Portions thereof the same as those of the first embodiment are attached with same notations and an explanation thereof will be omitted.

Figure 37:
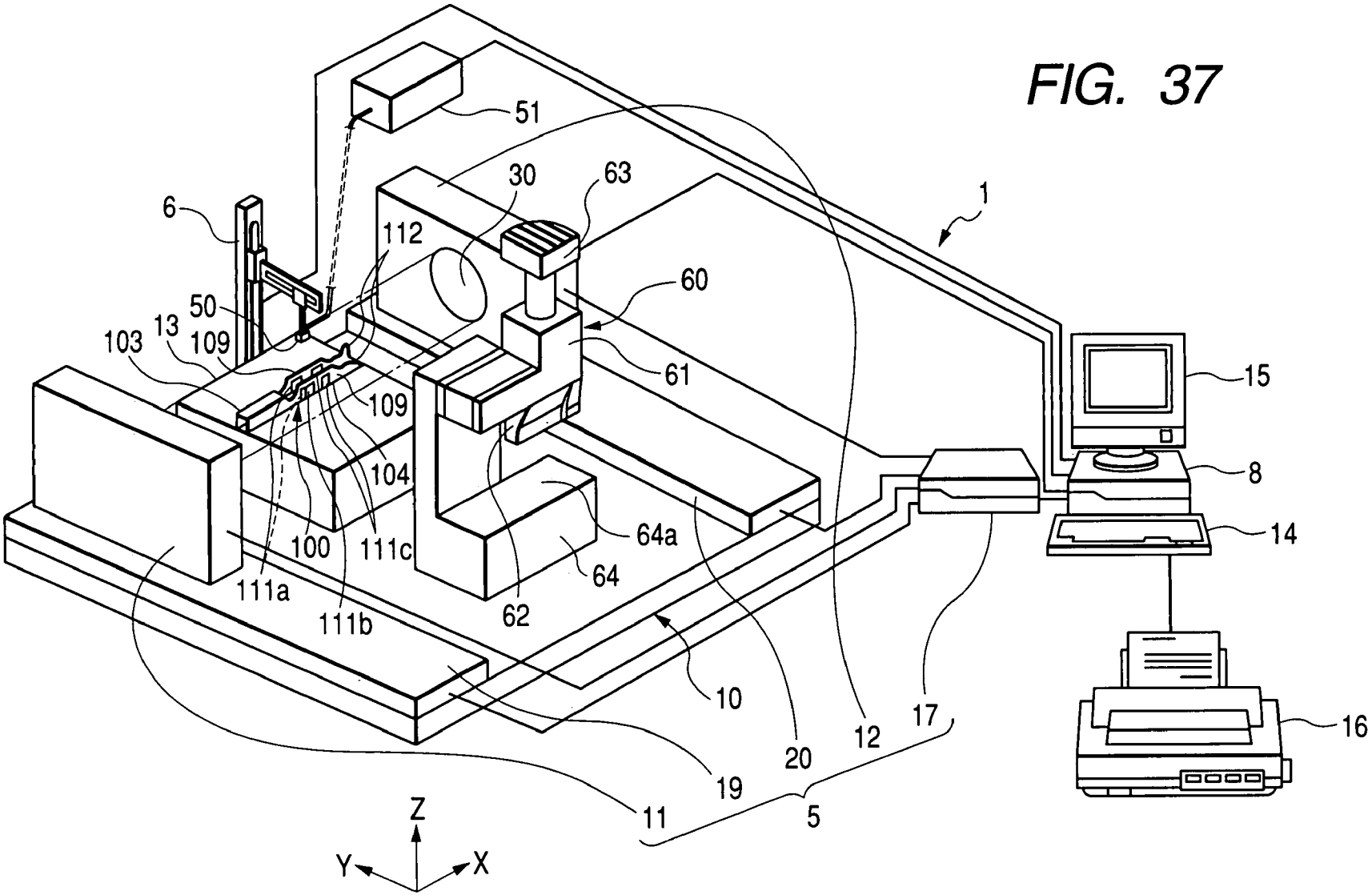
FIG. 37 is an explanatory view showing a constitution of a determining apparatus according to a third embodiment of the invention.
Figure 38:
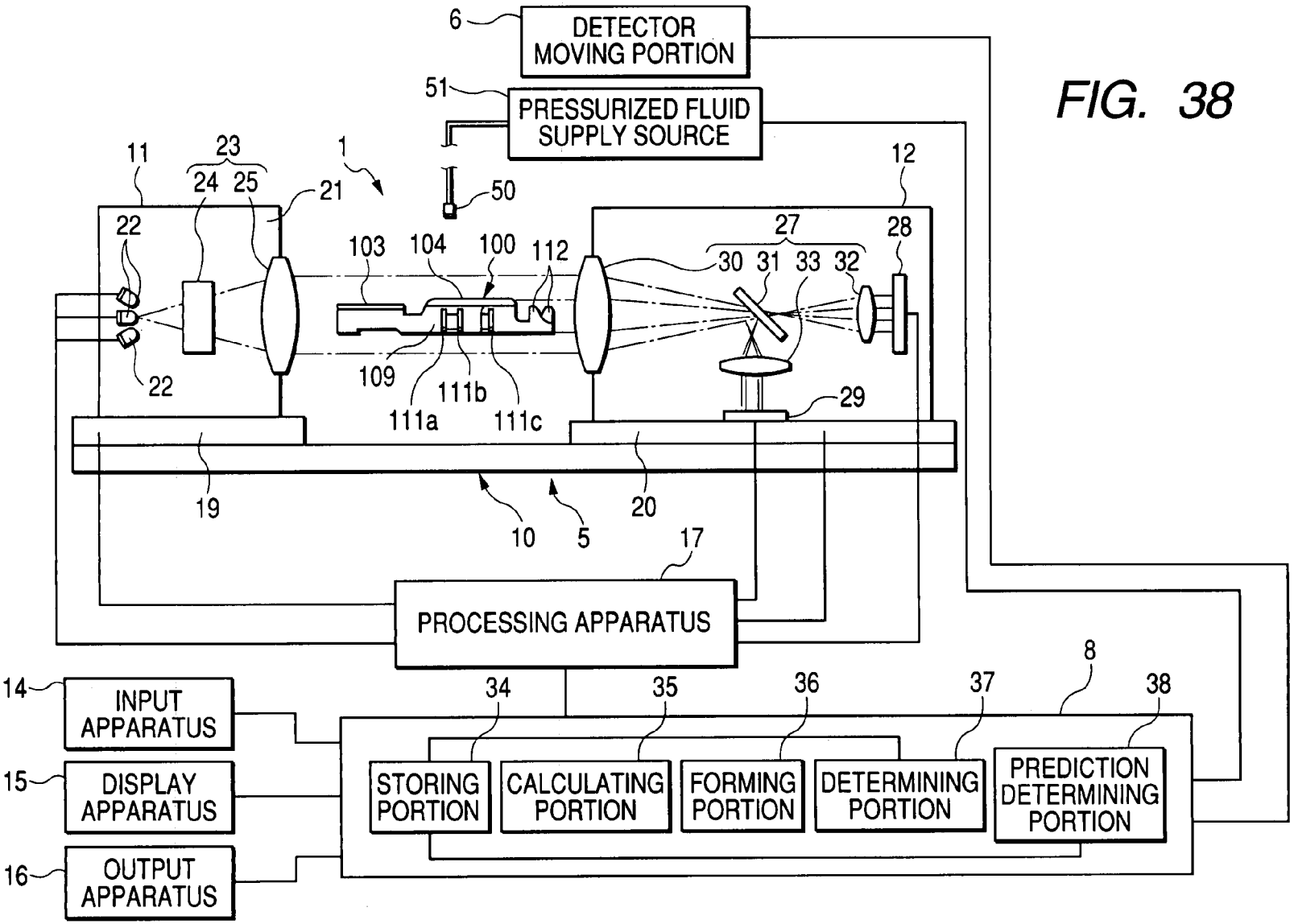
FIG. 38 is a block diagram showing a constitution of a measuring apparatus of the determining apparatus shown in FIG. 37.

According to the embodiment, an expander 50 is used as a detector as shown by FIG. 37 and FIG. 38. The expander 50 is supported by the detector moving portion 6 and is moved along the arrow marks X, Y, Z in FIG. 37 by the detector moving portion 6. The expander 50 is formed in a shape of an expandable and contractable bag. The expander 50 is connected with a pressurized fluid supply source 51.

The expander 50 is expanded by supplying a pressurized oil as a pressurized fluid from the pressurized fluid supply source 51. A width Wb (shown in FIG. 45) of the expander 50 in a maximally expanded state is equal to or larger than the interval D (shown in FIG. 43) between the press contact blades 111*a*, 111*b*, 111*c* and equal to or smaller than the outer diameter R of the core wire 3 of the electric wire 2. The width Wb is the maximum width of the expander 50. In the illustrated example, the width Wb of the expander 50 in the maximally expanded state is equal to the outer diameter R of the core wire 3 of the electric wire 2.

The pressurized fluid supply source 51 supplies the pressurized oil as the pressurized fluid to the expander 50. A pressure of the oil supplied into the expander 50 by the pressurized fluid supply source 51 constitutes information in accordance with the contact loads P1, P2 described in the specification. The expander 50 produces information in accordance with the pressure of the oil, that is, the contact loads P1, P2 by being brought into contact with the press contact blades 111*b* by being expanded between the press contact blades 11*b*.

The control apparatus 8 is connected to the pressurized fluid supply source 51. The control apparatus 8 controls the pressure of the oil supplied to the expander 50 by the pressurized fluid supply source 51. The control apparatus 8 is stored with thicknesses of the press contact blades 111*a*, 111*b*, 111*c*.

A program stored to the storing portion 34 of the control apparatus 8 makes the processing 17 of the measuring apparatus 5 coincide the optical axes of the collimators 25, 30 before the light emitting portion 11 and the image pickup portion 12 are positioned to both of the first position and the second position and acceptability of the press contact terminal 100 is determined.

When the light emitting portion 11 and the image pickup portion 12 are positioned to the first position and the press contact terminal 100 is attached to the terminal holding portion 13, the program makes the processing apparatus 17 pick up the image of the electric wire connecting portion 104. The control apparatus 8 makes the processing apparatus 17 binarize the pickup image and thereafter calculate the distance h1 (shown in FIG. 43 and FIG. 44) between the outer faces 109*a* of the pair of side walls 109. The distance h1 constitutes the width of the press contact terminal 100 before press contact. The control apparatus 8 is stored with the width h1.

Figure 41:
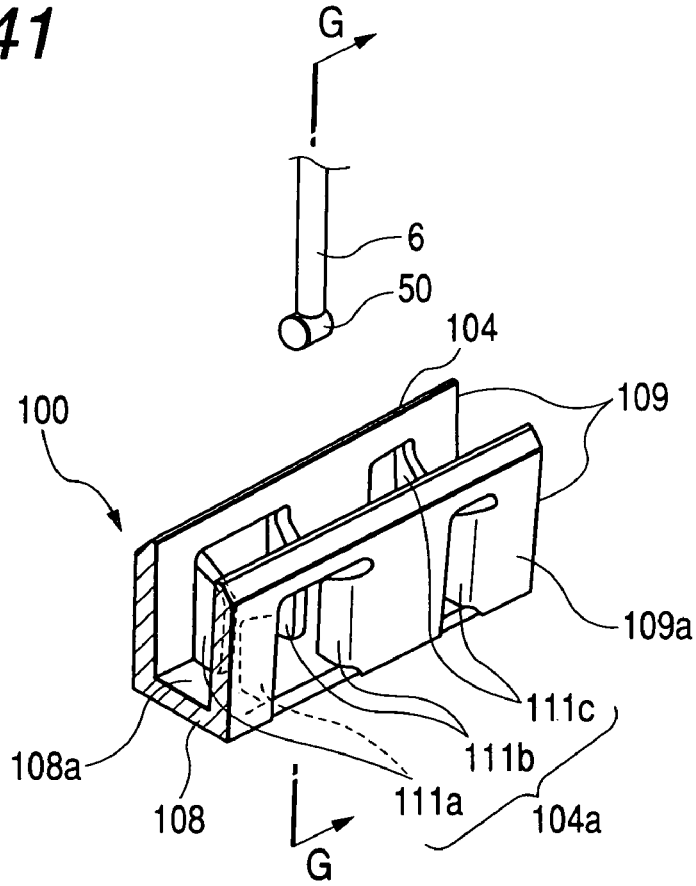
FIG. 41 is a perspective view showing a state of positioning the expander of the determining apparatuses shown in FIGS. 37 and 66 to right above between the press contact blades.
Figure 43:
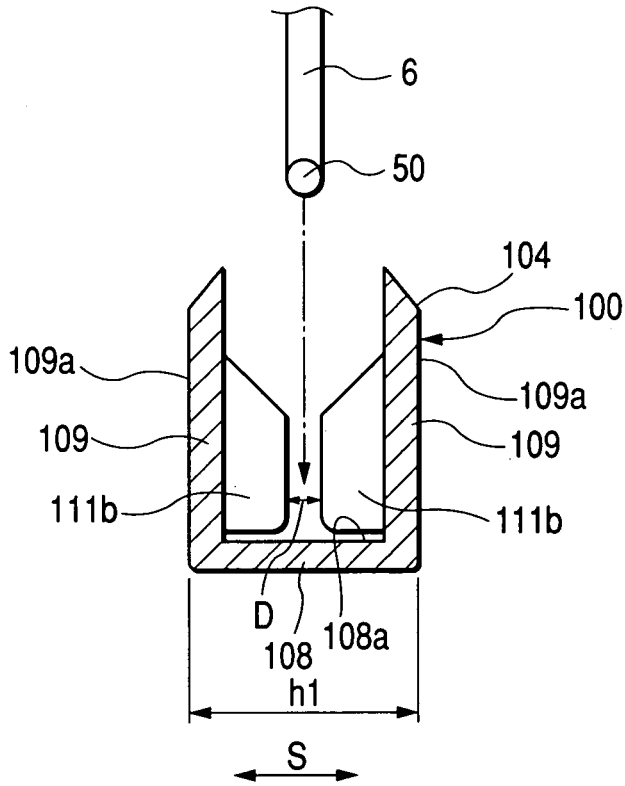
FIG. 43 is a sectional view taken along a line G-G of FIG. 41.
Figure 44:
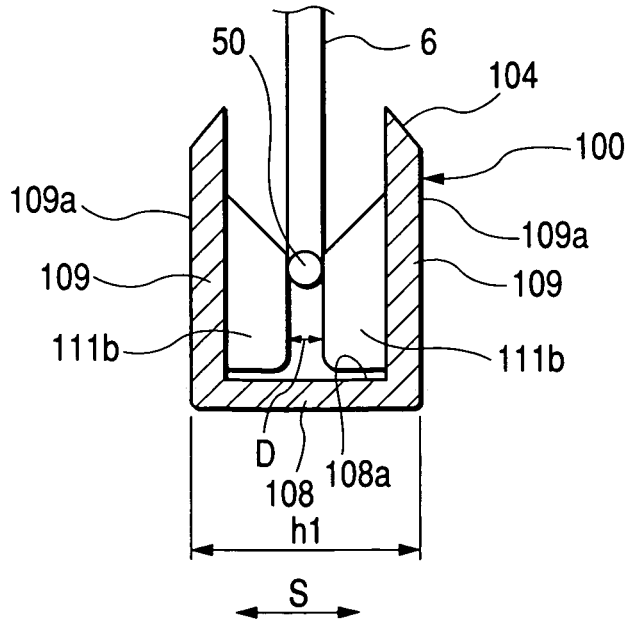
FIG. 44 is a sectional view showing a state of inserting the expander between the press contact blades from a state shown in FIG. 43.

As shown by FIG. 41 and FIG. 43, the program makes the detector moving portion 6 position the expander 50 right above between the press contact blades 111*b* and thereafter gradually approach the expander 50 to the electric wire connecting portion 104 of the press contact terminal 100 to insert between the press contact blades 111*b* as shown by FIG. 44. The program supplies the pressurized oil from the pressurized fluid supply source 51 to the expander 50.

When the expander 50 starts expanding, the program stop supplying the oil from the pressurized fluid supply source 51 to the expander 50 and makes the measuring apparatus 5 measure the distance Ha (shown in FIG. 45) between the outer faces 109*a* of the pair of side walls 109. The program calculates the difference between the measured distance Ha and the distance h1 and calculates the displacement of the pair of side walls 109 that is, the press contact blades 111*b*. The program measures a length L (shown in FIG. 45) of contact portions at which the press contact blades 111*b* and the expander 50 are brought into contact with each other.

The calculating portion 35 of the control apparatus 8 calculates the contact loads P1, P2 (shown in FIG. 45) between the expander 50 and the press contact blades 111*b* by calculating products of the length L of the contact portions and the thicknesses of the press contact blades 111*b* and the pressure of the oil supplied by the pressurized fluid supply source 51. In this way, the calculating portion 35 of the control apparatus 8 calculates the contact loads P1, P2 based on the pressure of the oil as the pressurized fluid supplied to the expander 50 by the pressurized fluid supply source 51 and the outer shapes of the press contact blades 111*a*, 111*b*, 111*c* the images of which are picked up by the image pickup portion 12 of the measuring apparatus 5.

The program expands the expander 50 to the previously determined size Wb by supplying the pressurized oil from the pressurized fluid supply source 51. That is, the control apparatus 8 further expands the expander 50 between the pair of press contact blades 111*b*. Thereafter, the control apparatus 8 calculates the displacements of the press contact blades 111*b* as described above, and the calculating portion 35 calculates the contact loads P1, P2 to output to the forming portion 36.

The program expands the expander 50 to the previously determined size Wb. The program calculates the displacements of the press contact blades 111*b* until the expander.50 is expanded to the previously determined size Wb and the calculating portion 35 calculates the contact loads P1, P2 to output to the forming portion 36. When the expander 50 is expanded to the previously determined size Wb, the program stops supplying the oil pressurized from the pressurized fluid supply source 51 to the expander 50.

The forming portion 36 calculates the sum of the contact loads P1, P2. The forming portion 36 forms the characteristic data TD similar to the first embodiment and outputs the formed characteristic data TD to the determining portion 37. The determining portion 37 determines acceptability of the press contact terminal 100 based on the characteristic data TD and the reference data KD similar to the first embodiment and the second embodiment described above.

In this way, the control apparatus 8 acquires the characteristic data TD by positioning the light emitting portion 11 and the image coupling portion 12 to the first position and determines acceptability of the press contact terminal 100 based on the characteristic data TD and the reference data KD.

The control apparatus 8 positions the light emitting portion 11 and the image pickup portion 12 to the second position and determines acceptability of the press contact terminal 100 brought into press contact with the electric wire 2 by the press contact apparatus 60 similar to the first embodiment and the second embodiment described above.

Next, an explanation will be given of a procedure of determining acceptability of the press contact terminal 100 by the determining apparatus 1 of the above-described embodiment.

Figure 39:
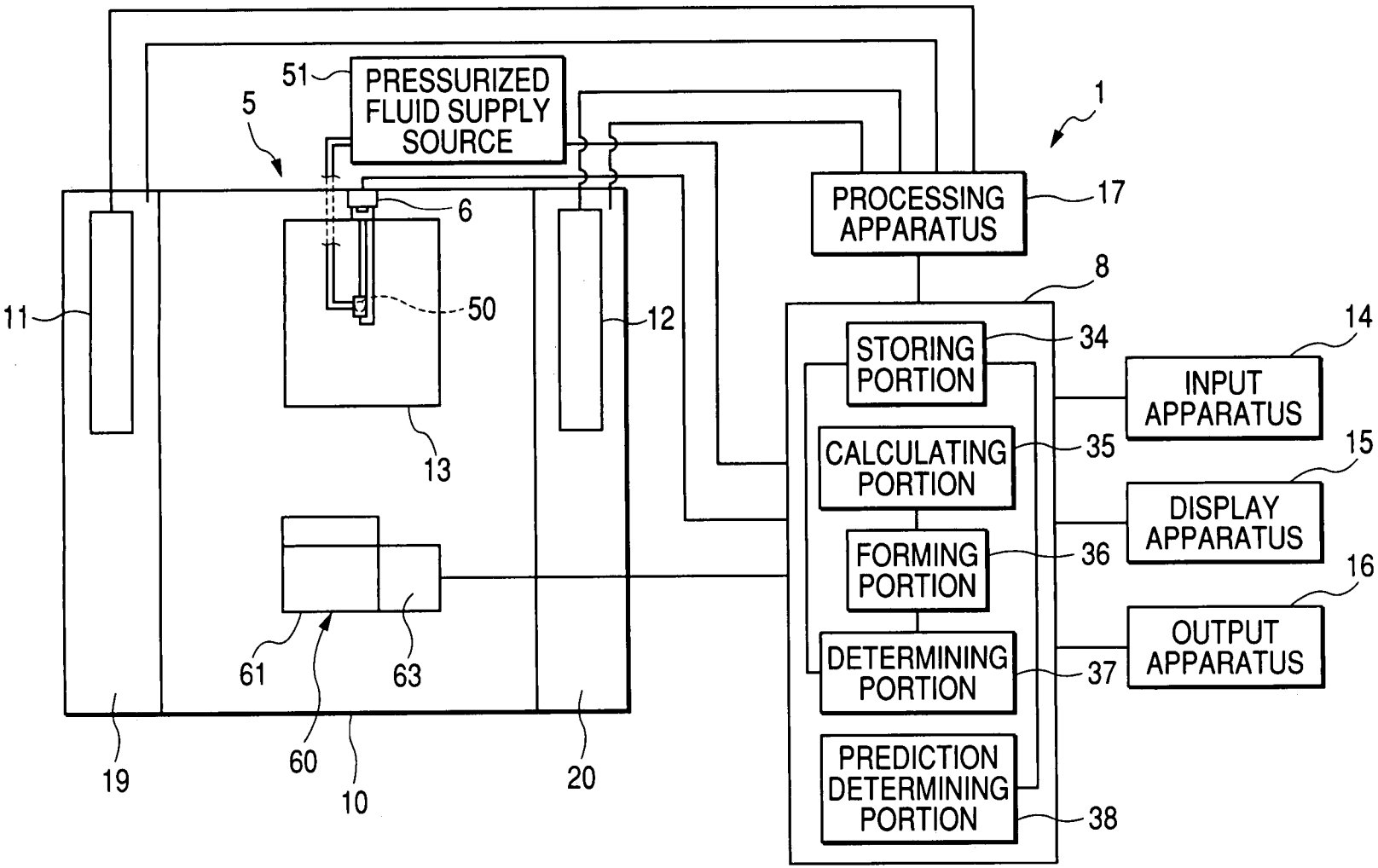
FIG. 39 is an explanatory view showing a total constitution of the determining apparatus shown in FIG. 37.

First, for example, in determining acceptability of the designed and trially produced press contact terminal 100, the light emitting portion 11 and the image pickup portion 12 are positioned to the first position shown in FIG. 37 and FIG. 39.

Figure 40:
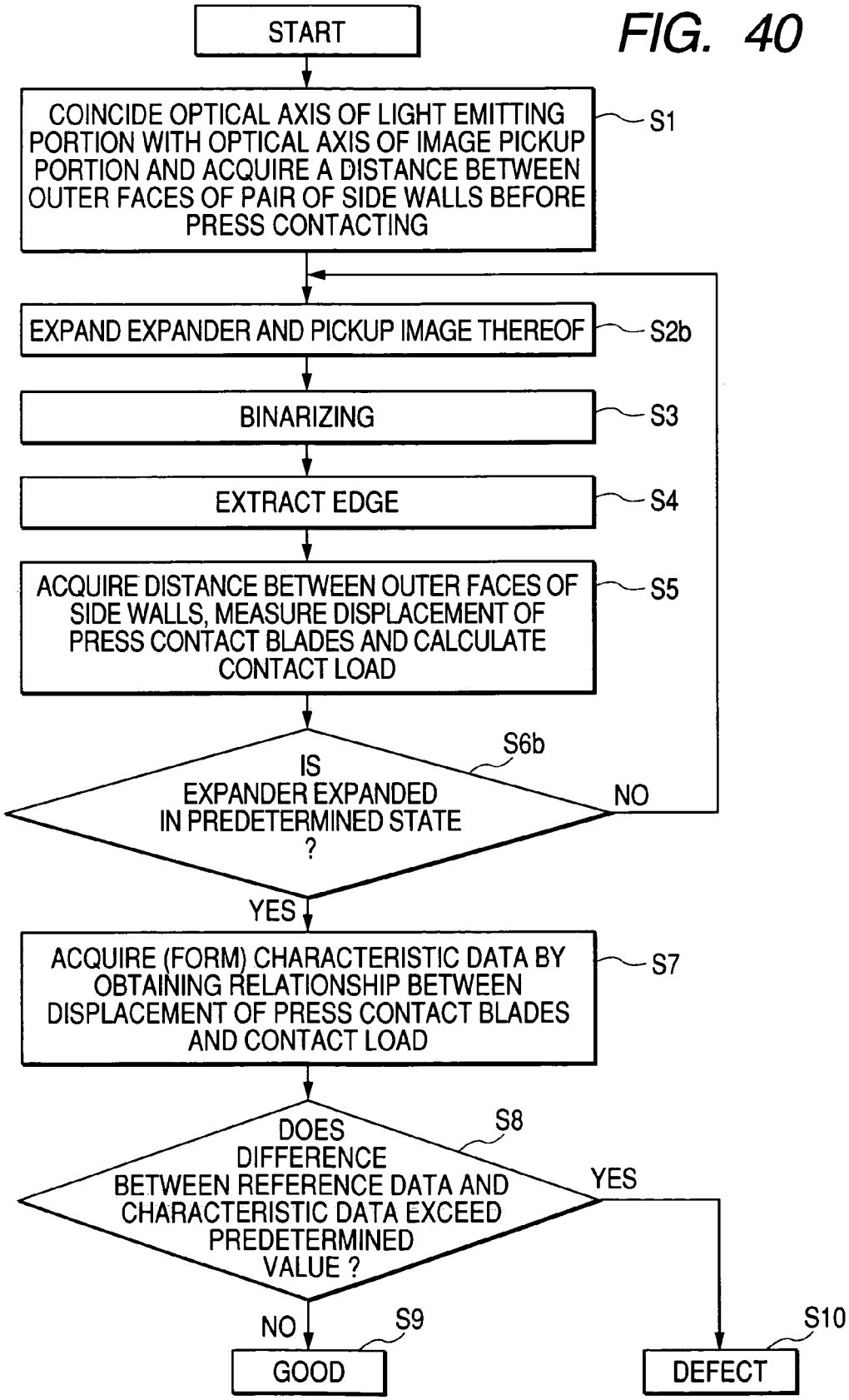
FIG. 40 is a flowchart showing a procedure of determining acceptability of a press contact terminal by inserting an expander between press contact blades by the determining apparatus shown in FIG. 37.

At step S1 in FIG. 40, the control apparatus 8 makes the measuring apparatus 5 emit light from the light emitting portion 11 to the image pickup portion 12. The control apparatus 8 makes the processing apparatus 17 coincide the optical axis of the collimator 25 of the light emitting portion 11 and the optical axis of the collimator 30 of the image pickup portion 12 by driving the respective moving portions 19, 20 based on the optical axis of light provided by receiving light by the optical axis matching image pickup element 28.

The press contact terminal 100, that is, the press contact blades 111*a*, 111*b*, 111 are attached to the terminal holding portion 13. At this occasion, the press contact terminal 100, that is, the press contact blades 111*a*, 111*b*, 111 are attached to the terminal holding portion 13 in the state in which the longitudinal direction of the electric wire 2 inserted between the press contact blades 111*a*, 111*b*, 111 and the optical axis of light emitted by the light emitting portion 11 are in parallel with each other. At this occasion, as shown by FIG. 41 and FIG. 43, the electric wire connecting portion 104 of the press contact terminal 100 is brought into a state before press contact.

The control apparatus 8 makes the processing apparatus 17 emit light from the light emitting portion 11 to the image pickup portion 12 and makes the image pickup portion 12 pick up the image. The control apparatus 8 makes the processing apparatus 17 calculate the distance h1 between the outer faces 109*a* of the pair of side walls 109 to store the calculated distance h1. In this way, at step S1, the distance h1 between the outer faces 109*a* of the pair of side walls 109 of the press contact terminal 100 before press contact is calculated by aligning the optical axis of the light emitting portion 11 and the optical axis of the image pickup portion 12. The operation proceeds to step S2*b*.

At step S2*b*, the control apparatus 8 makes the detector moving portion 6 move the expander 50 and position the expander 50 right above between the press contact blades 111*b* as shown by FIG. 41 and FIG. 43. Thereafter, as shown by FIG. 44, the expander 50 is inserted between the press contact blades 111*b*. The control apparatus 8 supplies the pressurized oil from the pressurized fluid supply source 51 to the expander 50. When the expander 50 is expanded, the pair of side walls 109, that is, the press contact blades 111*b* are gradually separated from each other. The control apparatus 8 stops supplying the oil from the pressurized fluid supply source 51.

The control apparatus 8 makes the processing apparatus 17 emit light from the light emitting portion 11 to the image pickup portion 12 and makes the image pickup portion 12 pick up the image and the operation proceeds to step S3. At the step S3, the picked-up image is binarized by the predetermined threshold and the operation proceeds to step S4. At step S4, the outer shapes (edges) of the pair of side walls 109, the press contact blades 111*a*, 111*b*, 111*c* and the terminal holding portion 13 of the image provided by the binarization are extracted and the operation proceeds to step S5.

At step S5, the processing apparatus 17 calculates the distance Ha between the outer faces 109*a* of the pair of side walls 109 to output to the control apparatus 8. The control apparatus 8 calculates the difference between the distance Ha and the h1 and is stored with the difference as displacements of the press contact blades 111*b*.

At step S5, the calculating portion 35 of the control apparatus 8 makes the processing apparatus 17 measure the length L (shown in FIG. 45) of the portions at which the expander 50 and the press contact blades 111*b* are brought into contact with each other. The control apparatus 8 calculates the contact loads P1, P2 between the expander 50 and the press contact blades 111*b* by calculating the products of the pressure of the oil supplied from the pressurized fluid supply source 51 to the expander 50, the length L of the contact portions and the thicknesses of the press contact blades 111*b*. The control apparatus 8 is stored with the sum of the contact loads P1, P2. In this way, at step S5, the distance Ha between the outer faces 109*a* of the side walls 109 is calculated, the displacements of the press contact blades 111*b* are measured and the contact loads P1, P2 between the expander 50 and the press contact blades 111*b* are calculated. The operation proceeds to S6*b*.

Figure 42:
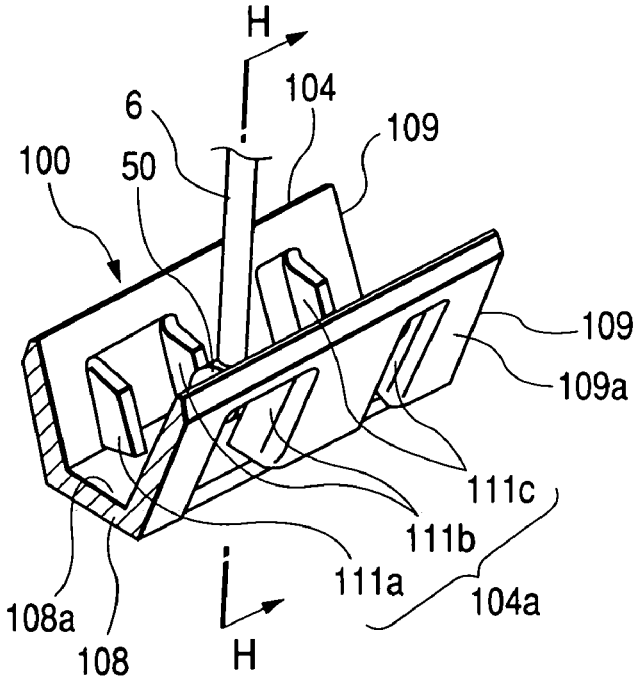
FIG. 42 is a perspective view showing a state of expanding the expander shown in FIG. 41 between the press contact blades.
Figure 45:
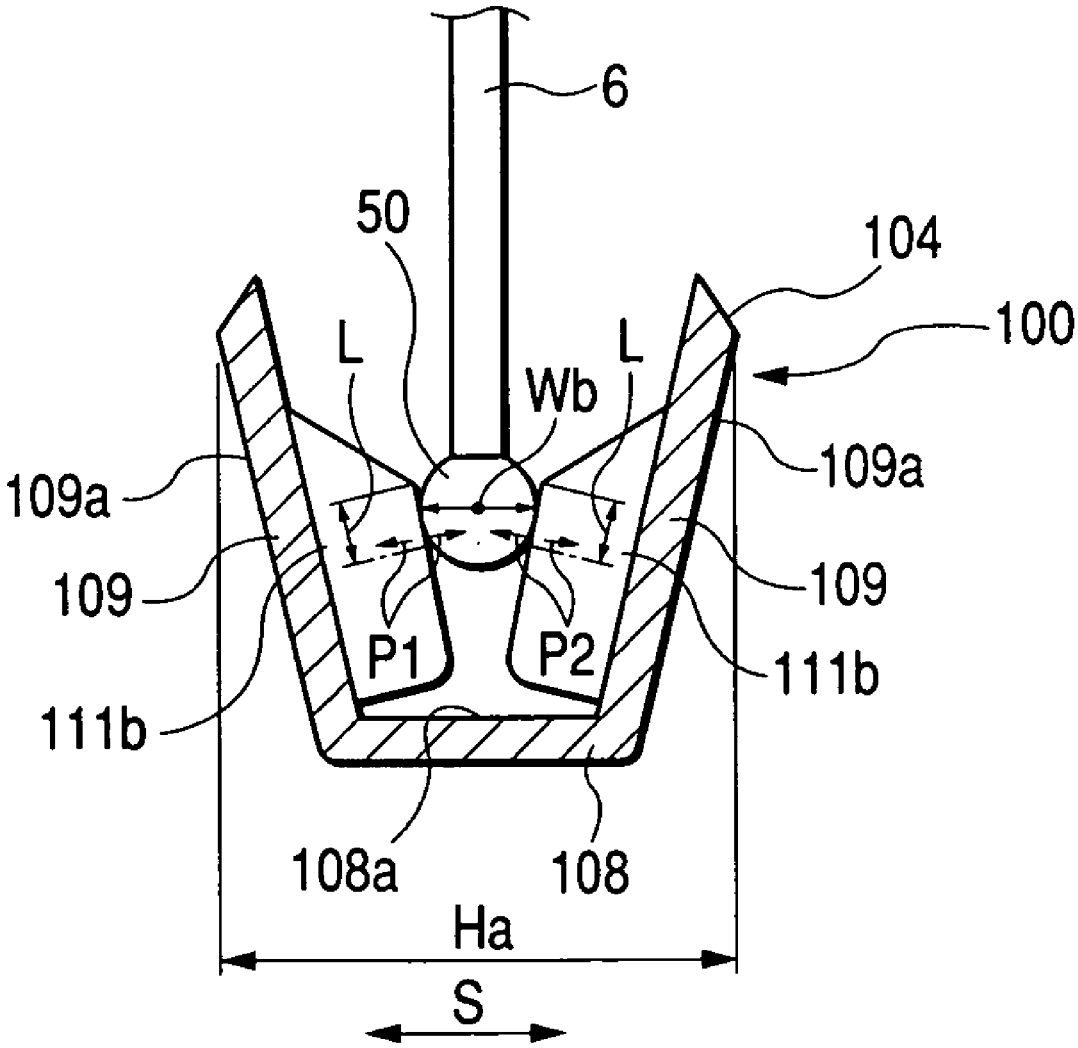
FIG. 45 is a sectional view taken along a line H-H of FIG. 42.
Figure 46:
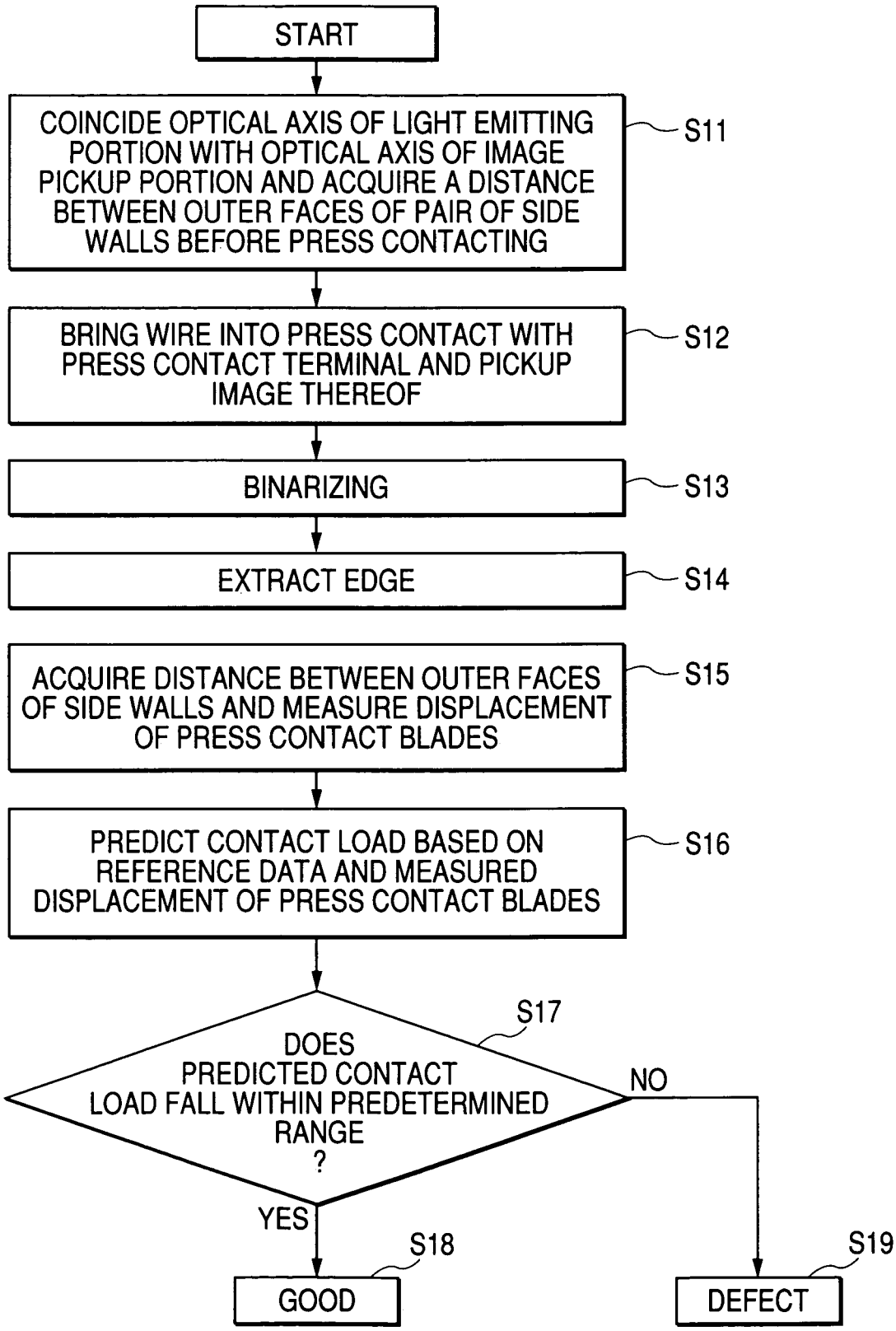
FIG. 46 is a flowchart showing a procedure of determining acceptability of a press contact terminal by inserting an electric wire between the press contact blades by the determining apparatus shown in FIG. 37.

At step S6*b*, the control apparatus 8 determines whether the expander 50 is expanded to the predetermined state (the width becomes Wb) shown in FIG. 42 and FIG. 45. When it is determined that the expander 50 is not expanded to the predetermined state (the width becomes Wb), the operation returns to step S2*b*. At step S2*b*, the control apparatus 8 supplies again the pressurized oil from the pressurized oil supply source 51 to the expander 50. The operation successively proceeds from step S2*b* to step S5 and calculates the displacements of the press contact blades 111*b* and the sum of the contact loads P1, P2 to store. In this way, the control apparatus 8 calculates the displacements of the press contact blades 111*b* and the sum of the contact loads P1, P2 by expanding the expander 50 between the press contact blades 111*b* until the expander 50 is expanded to the predetermined state (the width becomes Wb).

When it is determined at step S6*b* that the expander 50 is expanded between the press contact blades 111*b* to the predetermined state (the width becomes Wb), the operation proceeds to step S7. At step S7, the forming portion 36 acquires (forms) the characteristic data TD based on the displacements of the press contact blades 111*b* and the contact loads P1, P2 which are stored as described above. When the characteristic data TD is formed at step S7, the operation proceeds to step S8.

At step S8, the determining portion 37 calculates the differences ΔP, ΔH between the reference data KD and the characteristic data TD in the case of the predetermined displacement Hx and the predetermined contact load Px. The determining portion 37 determines whether the differences ΔP, ΔH are equal to or larger than predetermined values. When it is determined that the differences ΔP, ΔH are less than the predetermined values, the operation proceeds to step S9, and the determining portion 37 determines the press contact terminal 100 as the object to be inspected as an acceptable product. When it is determined that the differences ΔP, ΔH are equal to or larger than the predetermined values, the operation proceeds to step S10 and the determining portion 37 determines the press contact terminal 100 as the object to be inspected as an unacceptable product.

Next, in determining acceptability of the press contact terminal 100 in mass production, or in determining the acceptability by actually bringing the electric wire 2 into press contact with the trially produced press contact terminal 100, first, the light emitting portion 11 and the image pickup portion 12 are positioned to the second position. At step S11 in FIG. 46, the control apparatus 8 makes the measuring apparatus 5 emit light from the light emitting portion 11 to the image pickup portion 12. The control apparatus 8 makes the processing apparatus 17 coincide the optical axis of the collimator 25 of the light emitting portion 11 and the optical axis of the collimator 30 of the image pickup portion 12 by driving the respective moving portions 19, 20 based on the optical axis of light provided by receiving light by the optical axis matching image pickup element 28.

The press contact terminal 100 is positioned on the surface 64*a* of the holding portion 64 of the press contact apparatus 60. At this occasion, the press contact terminal 100, that is, the press contact blades 111*a*, 111*b*, 111 are held by the press contact apparatus 60 in the state in which the longitudinal direction of the electric wire 2 inserted between the press contact blades 111*a*, 111*b*, 111 and the optical axis of light emitted by the light emitting portion 11 are in parallel with each other. At this occasion, the electric wire connecting portion 104 of the press contact terminal 100 is brought into a state before press contact.

The control apparatus 8 makes the processing apparatus 17 emit light from the light emitting portion 11 to the image pickup portion 12 and makes the image pickup portion 12 pick up the image. The control apparatus 8 makes the processing apparatus 17 calculate the distance h1 between the outer faces 109*a* of the pair of side walls 109 to store the calculated distance h1. In this way, at step S11, the distance h1 between the outer faces 109*a* of the pair of side walls 109 of the press contact terminal 100 before press contact is calculated by aligning the optical axis of the light emitting portion 11 and the optical axis of the image pickup portion 12. The operation proceeds to step S12.

At step S12, the control apparatus 8 makes the press contact apparatus 60 bring the electric wire 2 into press contact with the press contact terminal 100. Then, the pair of side walls 109, that is, the press contact blades 111*b* are separated from each other. The control apparatus 8 makes the processing apparatus 17 emit light from the light emitting portion 11 to the image pickup portion 12 and makes the image pickup portion 12 pickup the image. The image pickup portion 12 is provided with the image showing the outer shapes of the press contact blades 111*a*, 111*b*, 111*c* viewed from the position along the longitudinal direction of the electric wire 2 at an interval therefrom. In this way, at step S12, the images of the press contact blades 111*a*, 111*b*, 111*c* of the press contact terminal 100 are picked up. In this way, at step S12, the electric wire 2 is brought into press contact with the press contact terminal 100 and images of these are picked up. The operation proceeds to step S13.

At step S13, the image is binarized by the predetermined threshold to provide the binarized image. According to the binarized image, the holding portion 64, the pair of side walls 109, the press contact blades 111*a*, 111*b*, 111*c* become black and the other portion becomes white. In this way, at step S13, the binarization is carried out and the operation proceeds to step S14.

At step S14, the outer shapes (edges) of the pair of side walls 109, the press contact blades 111*a*, 111*b*, 111*c* and the holding portion 64 are extracted and the operation proceeds to step S15. At step S15, the processing portion 17 extracts the surface 108*a* of the bottom wall 108 from the extracted outer shapes (edges) and calculates the distance Hb to output to the control apparatus 8. The control apparatus 8 calculate the difference Hs between the distance Hb and the h1 and is stored with the difference as the displacement Hs of the press contact blades 111*b*. The operation proceeds to step S16.

At step S16, the prediction determining portion 38 of the control apparatus 8 predicts the contact load Ps between the press contact blades 111*a*, 111*b*, 111*c* and the core wire 3 of the electric wire 2 based on the reference data KD and the measured displacement Hs of the press contact blades 111*b*. The operation proceeds to step S17.

At step S17, the prediction determining portion 38 of the control apparatus 8 determines whether the predicted contact load Ps falls in the predetermined range. When it is determined that the predicted contact load Ps falls in a predetermined range, the prediction determining portion 38 proceeds to step S18 and determines the press contact terminal 100 as the object to be inspected as an acceptable product. When it is determined that the predicted contact load Ps does not fall in the predetermined range, the prediction determining portion 38 proceeds to step S19 and determines the press contact terminal 100 as the object to be inspected as an unacceptable product.

According to the embodiment, the expander 50 as the detector is inserted between the press contact blades 111*b* and the expander 50 and the expander 50 is expanded between the press contact blades 111*b*. Therefore, in expanding the expander 50 between the pair of press contact blades 111*b*, the press contact blades 111*b*, that is, the pair of side walls 109 are not hampered from separating from each other. Therefore, the contact loads P1, P2 provided by the pressure of the oil as the fluid supplied to the expander 50 become proximate to the contact loads when the electric wire 2 is inserted between the pair of press contact blades 111*b*. Therefore, the contact loads P1, P2 calculated by the calculating portion 35 of the control apparatus 8 become proximate to the contact loads when the electric wire 2 is inserted between the pair of press contact blades 111*b*.

In expanding the expander 50 as the detector between the pair of press contact blades 111*b*, the press contact blades 111*b*, that is, the pair of side walls 109 are not hampered from separating from each other. Therefore, the characteristic data TD showing the relationship between information in accordance with the contact loads P1, P2 produced by expanding the expander 50 between the press contact blades 111*b* and the displacements of the press contact blades 111*b* measured by the measuring apparatus 5 becomes proximate to the data when the electric wire 2 is actually brought into press contact with the press contact terminal 100 as the object to be inspected.

The determining portion 37 of the control apparatus 8 determines acceptability of the press contact terminal 100 based on the characteristic data TD and the reference data KD. Since the characteristic data TD is accurate, acceptability of the press contact terminal 100 can accurately be determined.

The measuring apparatus 5 measures the displacement Hs of the press contact blades 111*a*, 111*b*, 111*c* when the press contact apparatus 60 inserts the electric wire 2 between the press contact blades 111*a*, 111*b*, 111*c* of the press contact terminal 100. Therefore, there is measured the displacement Hs of the press contact blades 111*a*, 111*b*, 111*c* in a state in which the pair of side walls 109 are not hampered from separating from each other. Therefore, the measured displacement Hs of the press contact blades 111*a*, 111*b*, 111*c* is accurate.

The prediction determining portion 38 of the control apparatus 8 predicts the contact load Ps between the core wire 3 of the electric wire 2 and the press contact blades 111*a*, 111*b*, 111*c* based on the reference data KD stored to the storing portion 34 and the displacement Hs of the press contact blades 111*a*, 111*b*, 111*c* measured by the measuring apparatus 5. Therefore, the predicted contact load Ps becomes proximate to the actual value. That is, the predicted contact load Ps becomes accurate.

The prediction determining portion 38 determines acceptability of the press contact terminal 100 based on the predicted contact load Ps. Since the predicted contact load Ps is accurate, acceptability of the press contact terminal 100 can accurately be determined.

The terminal holding portion 13 for holding the press contact terminal 100 is positioned in the state in which the optical axis of light emitted by the light emitting portion 11 between the light emitting portion 11 and the image pickup portion 12 and the electric wire 2 are in parallel with each other. Therefore, the image pickup portion 12 acquires the outer shapes of the press contact blades 111*a*, 111*b*, 111*c* viewed from the position along the longitudinal direction of the electric wire 2 inserted between the press contact blades 111*a*, 111*b*, 111*c* at an interval therefrom.

Since the displacements of the press contact blades 111*a*, 111*b*, 111*c* are measured from the outer shapes acquired by the processing apparatus 17, the measured displacements of the press contact blades 111*a*, 111*b*, 111*c* become accurate. Therefore, acceptability of the press contact terminal 100 can further accurately be determined.

The press contact terminal 100 held by the press contact apparatus 60 is positioned in the state in which the optical axis of light emitted by the light emitting portion 11 between the light emitting portion 11 and the image pickup portion 12 and the electric wire 2 are in parallel with each other. Therefore, the image pickup portion 12 acquires the outer shapes of the press contact blades 111*a*, 111*b*, 111*c* viewed from the position along the longitudinal direction of the electric wire 2 inserted between the press contact blades 111*a*, 111*b*, 111*c* at an interval therefrom.

Since the displacement Hs of the press contact blades 111*a*, 111*b*, 111*c* is measured from the outer shapes acquired by the processing apparatus 17, the measured displacement Hs of the press contact blades 111*a*, 111*b*, 111*c* becomes accurate. Therefore, acceptability of the press contact terminal 100 can further accurately be determined.

There is used the expander 50 inserted between the press contact blades 111*b* of the detector and supplied with the pressurized oil as the pressurized fluid from the pressurized fluid supply source 51. The maximum width Wb of the expander 50 is equal to or larger than the interval between the press contact blades 111*b* and equal to or smaller than the outer diameter R of the core wire 3 of the electric wire 2. Therefore, the state of the press contact blades 111*b* when the expander 50 is expanded between the press contact blades 111*b* and the state of the press contact blades 111*a*, 111*b*, 111*c* when the electric wire 2 is inserted between the press contact blades 111*a*, 111*b*, 111*c* become proximate to each other.

The control apparatus 8 calculates the contact loads P1, P2 by using the expander 50 as the detector and based on the pressure of the pressurized oil as the pressurized fluid supplied by the pressurized fluid supply source 51. Therefore, the accurate contact loads P1, P2 can be provided. Therefore, the further accurate characteristic data TD can be provided and the acceptability of the press contact terminal 100 can further accurately be determined.

As described above, the determining apparatus 1 of the invention inserts the piezoelectric element 7 or the rotor 41 or the expander 50 for producing information in accordance with the contact loads between the piezoelectric element 7 or the rotor 41 or the expander 60 the press contact blades 111*a*, 111*b*, 111*c* are inserted between the press contact blades 111*a*, 111*b*, 111*c*. The determining apparatus 1 acquires the characteristic data TD showing the relationship between information in accordance with the contact loads produced by inserting the piezoelectric element 7 or the rotor 41 or the expander 50 and the displacements of the press contact blades 111*a*, 111*b*, 111*c* measured by the measuring apparatus 5. The determining apparatus 1 determines acceptability of the press contact terminal 100 as the object to be inspected based on the reference data KD previously stored to the storing portion 34 and the characteristic data TD.

Therefore, the press contact blades 111*a*, 111*b*, 111*c* are not hampered from separating from each other when the piezoelectric element 7 or the rotor 41 or the expander 50 is inserted between the press contact blades 111*a*, 111*b*, 111*c*. Therefore, information in accordance with the contact loads P1, P2 between the piezoelectric element 7 or the rotor 41 or the expander 50 and the press contact blades 111*a*, 111*b*, 111*c* produced by inserting the piezoelectric element 7 or the rotor 41 or the expander 50 becomes proximate to the contact loads when the electric wire 2 is inserted between the press contact blades 111*a*, 111*b*, 111*c*. When the piezoelectric element 7 or the rotor 41 or the expander 50 is inserted between the press contact blades 111*a*, 111*b*, 111*c*, the press contact blades 111*a*, 111*b*, 111*c* are not hampered from separating from each other. Therefore, the characteristic data showing the relationship between information in accordance with the contact loads between the piezoelectric element 7 or the rotor 41 or the expander 50 and the press contact blades 111*a*, 111*b*, 111*c* produced thereby and the measured displacement of the press contact blades 111*a*, 111*b*, 111*c* becomes accurate. Therefore, since the characteristic data TD is accurate, acceptability of the press contact terminal 100 can accurately be determined.

The determining apparatus 1 actually inserts the electric wire 2 between the press contact blades 111*a*, 111*b*, 111*c* of the press contact terminal 100 as the object to be inspected and measures the displacements of the press contact blades 111*a*, 111*b*, 111*c*. The contact load Ps between the core wire 3 of the electric wire 2 and the press contact blades 111*a*, 111*b*, 111*c* is predicted based on the measured displacements of the press contact blades 111*a*, 111*b*, 111*c* and the reference data KD. The determining apparatus 1 determines acceptability of the press contact terminal 100 based on the predicted contact load Ps and the reference data KD.

The displacements of the press con tact blades 111*a*, 111*b*, 111*c* are measured by bringing the electric wire 2 into press contact with the press contact terminal 100. Therefore, the displacements of the press contact blades 111*a*, 111*b*, 111*c* in the state in which the press contact blades 111*a*, 111*b*, 111*c* are not hampered from separating from each other are measured. Therefore, the measured displacements of the press contact blades 111*a*, 111*b*, 111*c* are accurate. Therefore, also the predicted contact load Ps becomes very proximate to the actual value. That is, the predicted contact load Ps is accurate. Acceptability of the press contact terminal 100 is determined based on the predicted contact load Ps and the reference data KD. Since the predicted contact load Ps is accurate, acceptability of the press contact terminal 100 can accurately be determined.

Fourth Embodiment

Figure 47:
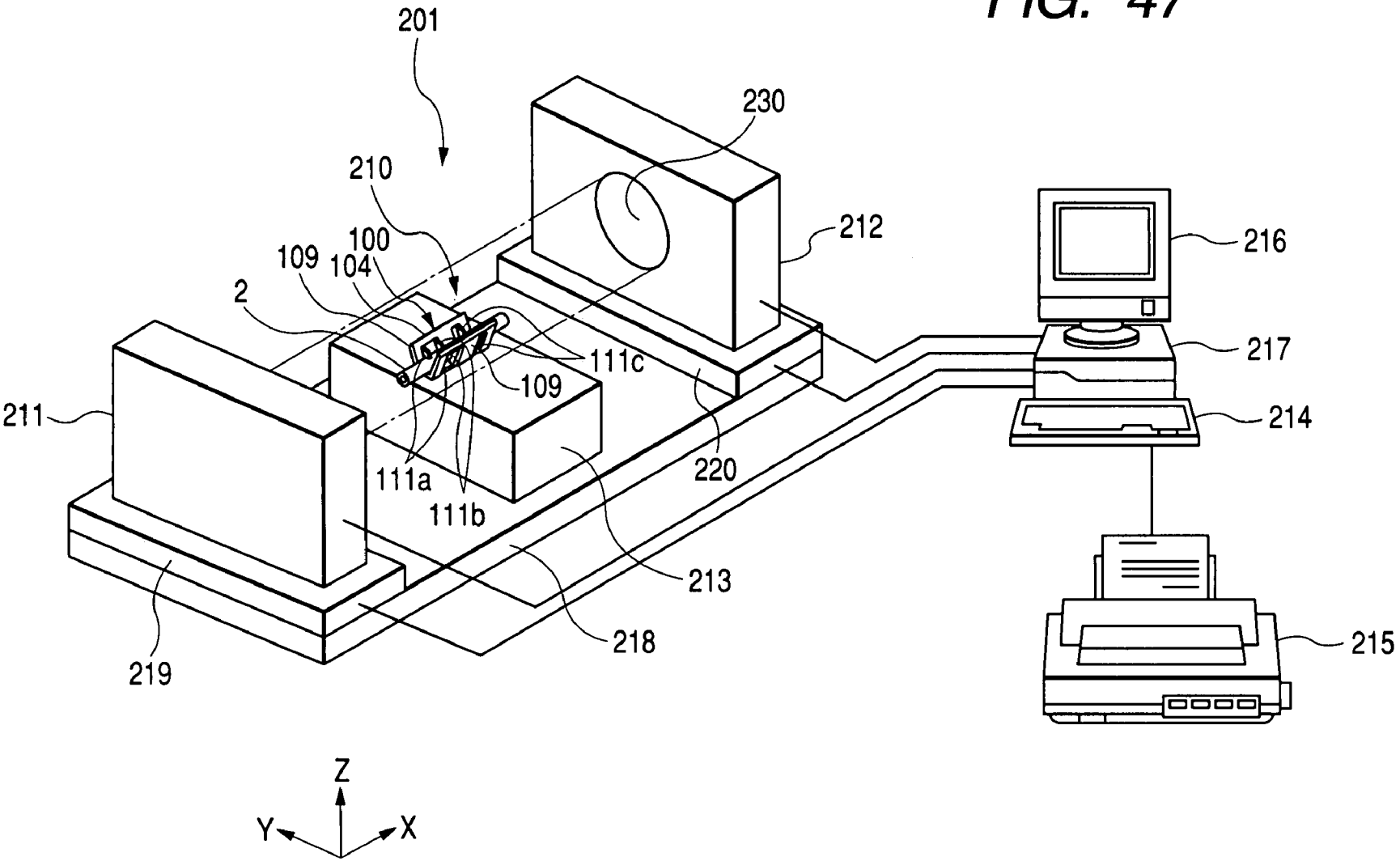
FIG. 47 is an explanatory view showing a constitution of a measuring apparatus according to an embodiment of the invention.

An explanation will be given of an apparatus of measuring a width of a press contact terminal in press contact (hereinafter, simply referred to as measuring apparatus) 201 according to a fourth embodiment of the invention in reference to FIG. 47 through FIG. 55. The measuring apparatus 201 shown in FIG. 47 is an apparatus of measuring a width H (shown in FIG. 54) of a press contact terminal 100 when an electric wire 2 (shown in FIG. 10) is brought into press contact with the press contact terminal 100 shown in FIG. 12. The press contact terminal 100 shown in FIG. 12 is attached to a connector housing 101 shown in FIG. 10 and the electric wire 2 is brought into press contact therewith to thereby constitute a connector 120 shown in FIG. 11.

The measuring apparatus 201 shown in FIG. 47 measures the width H of the press contact terminal 100 by measuring the distance H (shown in FIG. 54) between outer faces 109*a* (shown in FIG. 8 and FIG. 9) of the pair of side walls 109 of the electric wire connecting portion 104 in a state of bringing the electric wire 2 into press contact therewith In the specification, the width H of the press contact terminal 100 indicates the distance H between the outer faces 109*a* of the pair of side walls 109 of the electric wire connecting portion 104.

Figure 48:
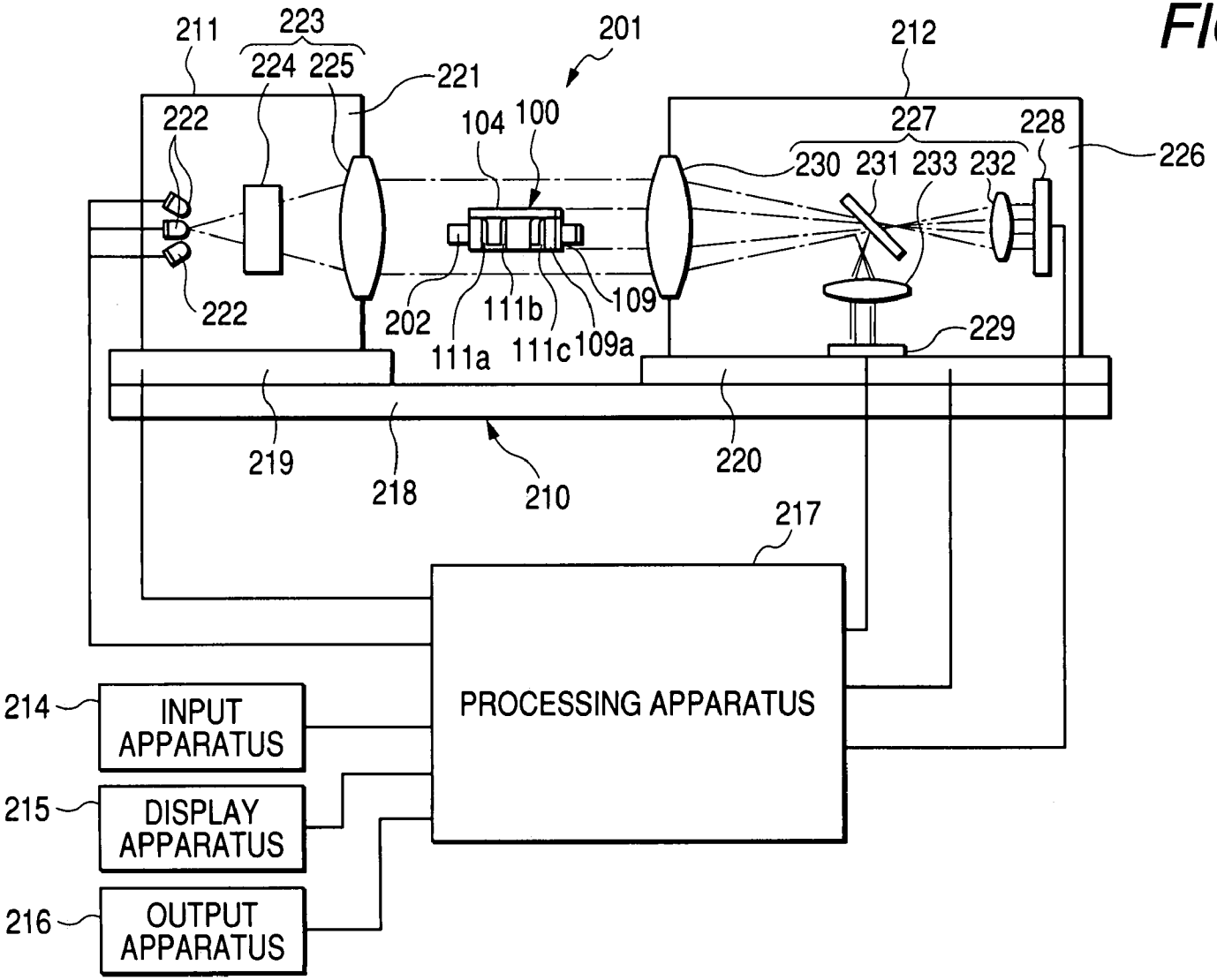
FIG. 48 is a block diagram showing the constitution of the measuring apparatus shown in FIG. 1.
Figure 49:
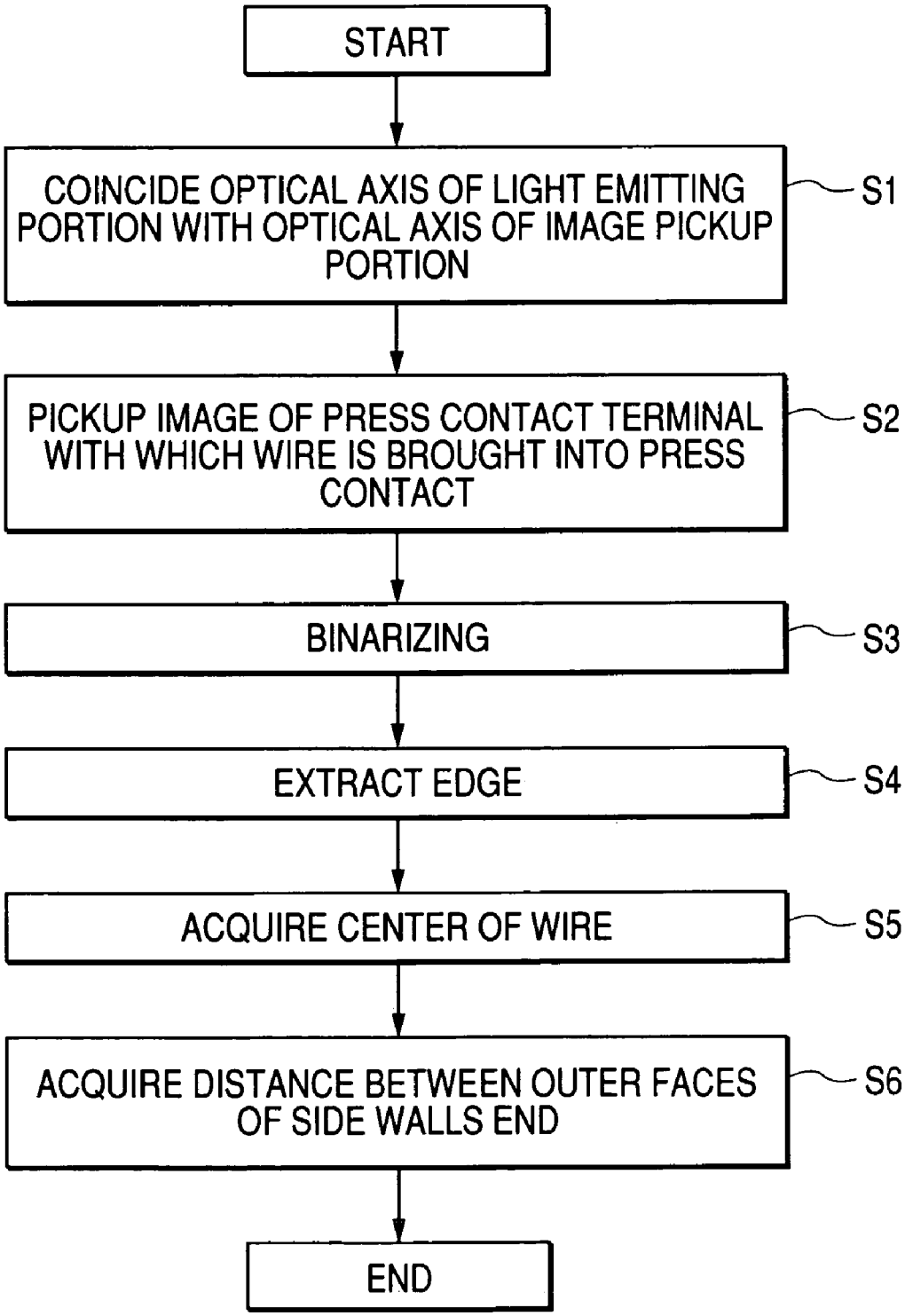
FIG. 49 is a flowchart showing a procedure of measuring a width of the press contact terminal by the measuring apparatus shown in FIG. 47.

As shown by FIG. 47 and FIG. 48, the measuring apparatus 201 is provided with an apparatus main body 210, a light emitting portion 211, an image pickup portion 212, a terminal holding portion 213 (shown in FIG. 47), an input apparatus 214, a display apparatus 215, an output apparatus 216, and a processing apparatus 217 as a processing portion.

As shown by FIG. 47 and FIG. 48, the apparatus main body 210 is provided with a base 218, a light emitting moving portion 219, and an image pickup moving portion 220. The base 218 is installed above a floor of a factory. The light emitting moving portion 219 is attached to an upper face of the base 218 and moves the light emitting portion 211 along arrow marks X, Y, Z orthogonal to each other shown in FIG. 47. The image pickup moving portion 220 is attached to the upper face of the base 218 and moves the image pickup portion 212 along the arrow marks X, Y, Z orthogonal to each other shown in FIG. 47. The light emitting moving portion 219 is provided at one end portion of the base 218 and the image pickup moving portion 220 is provided at other end portion of the base 218.

The light emitting portion 211 is installed above the light emitting moving portion 19. As shown by FIG. 48, the light emitting portion 211 is provided with a main body portion 221, a plurality of light emitting diodes (hereinafter, described as LED) 222 as a light source provided at inside of the main body portion 221, and an optical portion 223.

The main body portion 221 is formed in a box-like shape and installed above the light emitting moving portion 219. The plurality of LEDs 222 are contained at inside of the main body portion 221 and emit fluxes of light, that is, become luminescent to a diffusing unit, mentioned later, of the optical portion 223 along one-dotted chain lines in FIG. 48. The optical portion 223 is provided with the diffusing unit 224 and a collimator 225. The diffusing unit 224 is contained at inside of the main body portion 221 for making intensities of the fluxes of light from the plurality of LEDs 222 uniform to guide to the collimator 225 along the one-dotted chain lines in FIG. 48.

The collimator 225 is attached to an outer wall of the main body portion 221. The collimator 225 converts light from the diffusing unit 224 into parallel light to emit to outside of the main body portion 221, that is, outside of the light emitting portion 211 along one-dotted chain lines in FIG. 48. In this way, the light emitting portion 211 emits light converted into parallel light to the image pickup portion 212 along one-dotted chain lines in FIG. 48. In this way, the light emitting portion 11 becomes luminescent.

The image pickup portion 212 is installed above the image pickup moving portion 220. As shown by FIG. 48, the image pickup portion 12 is provided with a main body portion 226, an optical portion 227, an optical axis matching image pickup element 228, and an image pickup element 229. The main body portion 226 is formed in a box-like shape and is installed above the image pickup moving portion 220.

The optical portion 227 is provided with a collimator 230, a beam splitter 231, a collimator for optical axis 232, and a collimator for image pickup 233. The collimator 230 is attached to an outer wall of the main body portion 226. The collimator 230 guides light from the light emitting portion 211 into the main body portion 226, that is, into the image pickup portion 212 along one-dotted chain lines in FIG. 48.

The collimator 230 guides light from the light emitting portion 211 to the beam splitter 231.

The beam splitter 231 is contained at inside of the main body portion 226. The beam splitter 231 transmits a portion of light guided from the collimator 230 to guide to the collimator for optical axis 232 along one-dotted chain lines in FIG. 48. The beam splitter 231 reflects a remaining portion of the light to guide to the collimator for image pickup 232 along one-dotted chain lines in FIG. 48.

The collimator for optical axis 232 is contained at inside of the main body portion 226. The collimator for optical axis 232 converts light transmitted through the beam splitter 231 into parallel light to guide to the optical axis matching image pickup element 228 along one-dotted chain lines in FIG. 48. The collimator for image pickup 233 is contained at inside of the main body portion 226. The collimator for image pickup 233 converts light reflected by the beam splitter 31 into parallel light to guide to the image pickup element 229 along one-dotted chain lines in FIG. 48.

The optical axis matching image pickup element 228 is contained at inside of the main body portion 226. The optical axis matching image pickup element 228 comprises CMOS (Complementary Metal Oxide Semiconductor) and receives light guided from the beam splitter 231. The optical axis matching image pickup element 228 calculates a position of an optical axis of light guided from the beam splitter 231. The optical axis matching image pickup element 228 outputs the position of the calculated optical axis of light to the processing apparatus 217.

The image pickup element 229 is contained at inside of the main body portion 226. The image pickup portion comprises CCDs (Charge Coupled Device) for receiving light reflected by the beam splitter 231. The image pickup element 229 picks up images of the terminal holding portion 213 positioned between the light emitting portion 211 and the image pickup portion 212. The image pickup element 229 outputs a picked-up image G1 (shown in FIG. 50) to the processing apparatus 217.

The image G1 provided by being picked up by the image pickup element 229 comprises intensities of respective fluxes of light at respective pixels aligned on a plane. Therefore, the image G1 provided by being picked up by the image pickup element 229 constitutes plane monochrome images. In this way, the image pickup portion 229 receives light from the light emitting portion 211 and picks up an image of the electric wire connecting portion 104 of the press contact terminal 100 attached to the terminal holding portion 213 or a holding portion 264, mentioned later.

The terminal holding portion 213 is attached at a central portion of the base 218 of the apparatus main body 210. The terminal holding portion 213 is provided between the light emitting portion 211 and the image pickup portion 212. The electric wire connecting portion 104 of the press contact terminal 100 in which the electric wire 202 shown in FIG. 7 is brought into press contact with is attachable and detachable to and from the terminal holding portion 213. The terminal holding portion 213 is attached with the electric wire connecting portion 104 of the press contact terminal 100 in a state in which the longitudinal direction of the electric wire 2 brought into press contact with the electric wire connecting portion 104 and an optical axis of light emitted from the light emitting portion 211 to the image pickup portion 212 are in parallel with each other.

The terminal holding portion 213 is attached with the electric wire connection portion 104 of the press contact terminal 100 in a state in which a total of the electric wire connecting portion 104 of the press contact terminal 100 is disposed within light emitted from the light emitting portion 211 to the image pickup portion 212. In this way, the terminal holding portion 213 holds the press contact terminal 100 press fit with the electric wire 2 between the press contact blades 111*a*, 111*b*, 111*c* in the state in which the longitudinal direction of the electric wire 2 and the optical axis of light are in parallel with each other.

Since the terminal holding portion 213 holds the electric wire connecting portion 104 in the state in which the longitudinal direction of the electric wire 2 and the optical axis are in parallel with each other, the image pickup portion 212 picks up images of the electric wire 2, the pair of side walls 109 and the press contact blades 111*a*, 111*b*, 111*c* viewed from a position along the longitudinal direction of the press contact terminal 100 and the electric wire 2 at an interval therefrom. That is, the image pickup portion 212 acquires outer shapes of the electric wire 2, the pair of side walls 109 and the press contact blades 111*a*, 111*b*, 111*c* viewed from the position along the longitudinal direction of the press contact terminal 100 and the electric wire 2 at an interval therefrom.

The input apparatus 214 is used for variously operating the measuring apparatus 1. As the input apparatus 214, a keyboard, a mouse, various switches and operation buttons which are well known can be used. As the illustrated example, a keyboard is used as the input apparatus 214.

The display apparatus 215 displays a situation of operating the measuring apparatus 211, the image G1 picked up by the image pickup element 229 and a result of measurement. As the display apparatus 215, various display apparatus of a CRT (Cathode Ray Tube) display and a liquid crystal display which are well known can be used. In the illustrated example, a liquid crystal display is used as the display apparatus 215.

The output apparatus 216 outputs a result of measurement of the measuring apparatus 211 and the image G1 picked up by the image pickup element 229. As the output apparatus 216, a well known printer for printing a result of measurement and the image G1, a CD-ROM drive apparatus capable of writing the result of measurement and the image G1 to various record media such as CD-ROM can be used. In the illustrated example, a printer is used as the output apparatus 16.

The processing apparatus 217 is a computer provided with CPU (Central Processing Unit), ROM (Read-only Memory) and RAM (Random Access Memory) which are well known. The processing apparatus 217 is connected with the light emitting moving portion 219, LED 222 of the light emitting portion 211, the image pickup moving portion 220, the optical axis matching image pickup element 228, the image pickup element 229 of the image pickup portion 212, the input apparatus 214, the display apparatus 215 and the output apparatus 216, and controls operation of these. The processing apparatus 217 governs to control a total of the measuring apparatus 201.

The processing apparatus 217 is stored with a program for operating the measuring apparatus 201. The processing apparatus 217 makes the light emitting portion 211 emit light and makes the image pickup portion 212 receive light from the light emitting portion 211 before the measuring apparatus 201 measures the distance H between the outer faces 109*a* of the pair of side walls 109. The processing apparatus 217 coincides an optical axis of the light emitting portion 211 and an optical axis of the image pickup portion 211 by driving the respective moving portions 219, 220.

The processing portion 217 binarizes the image G1 (shown in FIG. 50) provided by being picked up by the image pickup element 229 by a predetermined threshold. The processing apparatus 217 provides an image G3 constituted by extracting outer shapes (edges) of the pair of side walls 109, the press contact blades 111*a*, 111*b*, 111*c* of the electric wire connecting portion 104 of the press contact terminal 100 and the electric wire 2 as shown by FIG. 52 from a binarized image G2 (shown in FIG. 51) provided by the binarization. Further, as shown by FIG. 53, an image G4 constituted by extracting the outer shape (edge) of the electric wire 2 in a circular arc shape from the extracted outer shape (edge) and calculates a center C of the electric wire 2 in the image G4.

Figure 53:
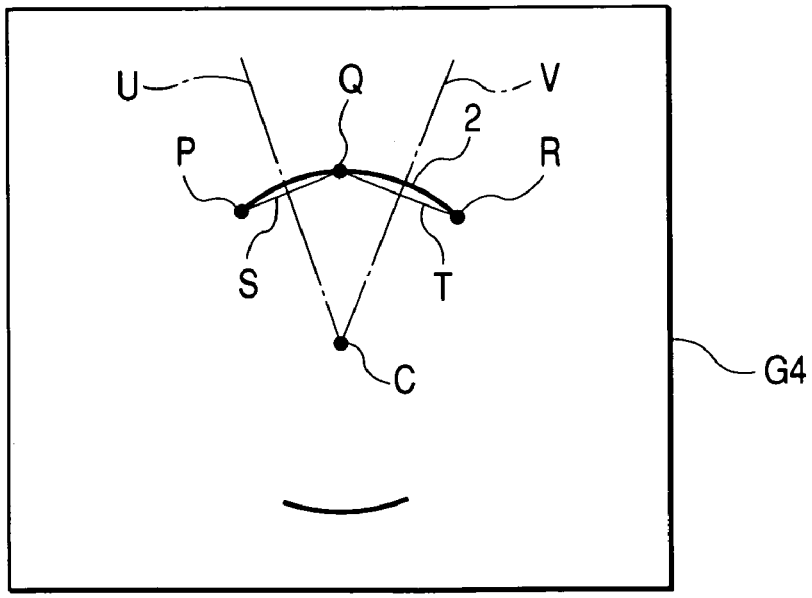
FIG. 53 is an explanatory view showing a procedure of calculating a center of the electric wire by extracting only an outer shape of the electric wire from the image shown in FIG. 52.

In calculating the center C of the electric wire 2, for example, as shown by FIG. 53, the processing apparatus 217 picks up arbitrary three points P, Q, R and calculates two arbitrary straight lines S, T (shown by bold lines in FIG. 53) connecting the three points P, Q, R. Respective perpendicular lines U, V (shown by one-dotted chain lines in FIG. 53) of the straight lines S, T are calculated and the center C of the electric wire 2 is constituted by an intersection of the perpendicular lines U, V. In this way, the center C of the electric wire 2 is calculated.

Figure 54:
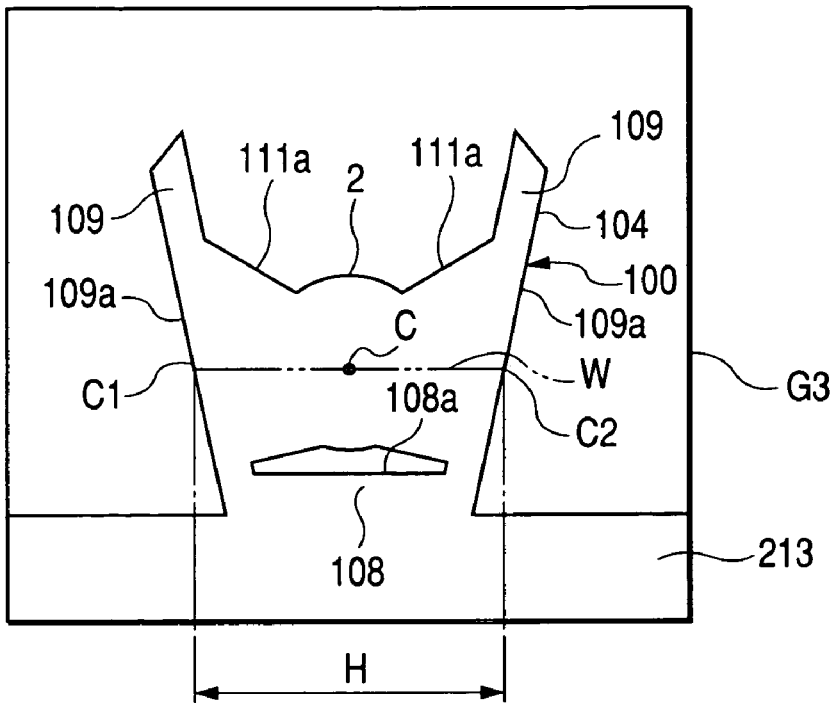
FIG. 54 is an explanatory view showing a procedure of calculating a distance between outer faces of a pair of side walls passing the center of the electric wire and in a direction along a bottom wall in the image shown in FIG. 52.

After calculating the center C of the electric wire 2, as shown by FIG. 54, the processing apparatus 217 calculates a straight line W (shown by a two-dotted chain line in FIG. 54) passing the center C and in parallel with the surface 108*a* of the bottom wall 108 in the image G3. The processing apparatus 217 calculates intersections C1, C2 between the straight line W and respective outer shapes (also referred to as edges, attached with the same sign since the outer shapes correspond to outer faces thereof) 109*a* of the pair of side walls 109.

The processing apparatus 217 calculates the distance H between the intersections C1, C2. The distance H between the outer faces 109*a* of the pair of side walls 109 is constituted by the distance H between the intersections C1, C2 and the width H of the press contact terminal 100 is constituted thereby. In this way, the processing apparatus 217 calculates the center C of the electric wire 2 from the outer shapes of the images G1, G2, G3, G4 provided by being picked up by the image pickup portion 212, that is, the electric wire 2, the pair of side walls 109 and the press contact blades 111*a*, 111*b*, 111*c* and calculates the distance H between the outer faces 109*a* of the pair of side walls 109 in a direction along the surface 108*a* of the bottom wall 108.

Next, an explanation will be given of a procedure of measuring the distance H between the outer faces 109*a* of the pair of side walls 109, that is, the width H of the press contact terminal 100 of the electric wire connecting portion 104 of the press contact terminal 100 by the measuring apparatus 201 of the fourth embodiment. First, at step S1 in FIG. 49, light is emitted from the light emitting portion 211 to the image pickup portion 212 by starting the measuring apparatus 201. The processing apparatus 217 coincides the optical axis of the collimator 225 of the light emitting portion 211 and the optical axis of the collimator 230 of the image pickup portion 212 by driving the respective moving portions 219, 220 based on an optical axis of light provided by receiving light by the optical axis matching image pickup element 228. The operation proceeds to step S2.

At step S2, the terminal holding portion 213 is attached with the electric wire connecting portion 104 of the press contact terminal 100 in which the electric wire 2 is press fit between the press contact blades 111*a*, 111*b*, 111*c*. At this occasion, the longitudinal direction of the electric wire 2 and the optical axis of light emitted by the light emitting portion 211 are made in parallel with each other. Further, light is emitted from the light emitting portion 211 to the image pickup portion 212 and the image of the electric wire connecting portion 104 of the press contact terminal 100 with which the electric wire 2 is brought into press contact is picked up by the image pickup portion 212. The image pickup portion 212 is provided with (acquires) the image G1 (shown in FIG. 50) showing the outer shapes of the electric wire 2, the pair of side walls 109 and the press contact blades 111*a*, 111*b*, 111*c* viewed from the position along the longitudinal direction of the press contact terminal 100 and the electric wire 2 at an interval therefrom.

At this occasion, light is emitted from the light emitting portion 211 to the image pickup portion 212 and therefore, in the image G1 provided by the image pickup portion 212, the terminal holding portion 213, the electric wire 2, the pair of side walls 109 and the press contact blades 111*a*, 111*b*, 111*c* become dark by constituting shadow and the other portion becomes bright. In this way, at step S2, the image of the press contact terminal 100 with which the electric wire 2 is brought into press contact is picked up and the operation proceeds to step S3.

Figure 50:
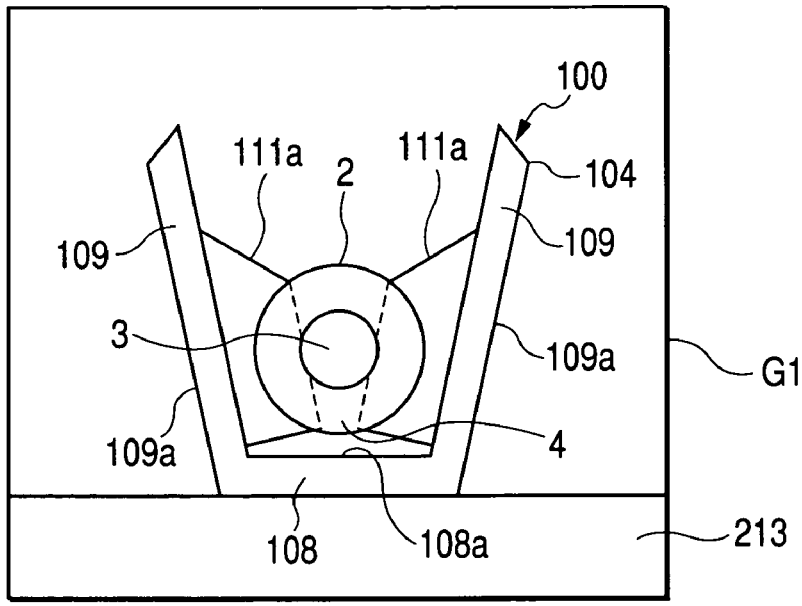
FIG. 50 is an explanatory view showing an image provided at step S2 of the flowchart shown in FIG. 49.
Figure 51:
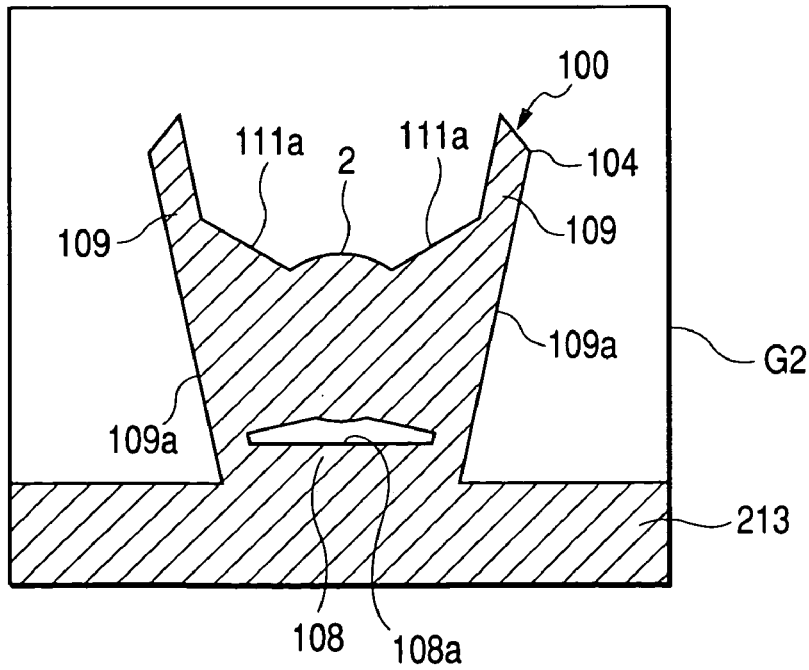
FIG. 51 is an explanatory view showing a binarized image provided by binarizing the image shown in FIG. 50.
Figure 52:
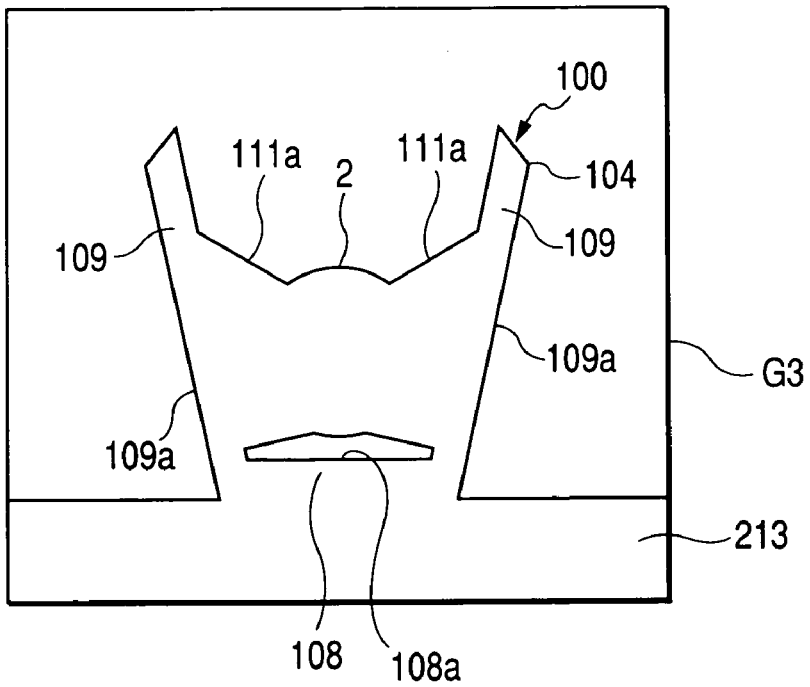
FIG. 52 is an explanatory view showing an image provided by extracting an outer shape (edge) from the binarized image shown in FIG. 51.

At step S3, the image G1 shown in FIG. 50 is binarized by a predetermined threshold to provide the binarized image G2 shown in FIG. 51. In the binarized image G2 shown in FIG. 51, the terminal holding portion 213, the electric wire 2, the pair of side walls 109 and the press contact blades 111*a*, 111*b*, 111*c* shown by parallel hatched lines become black and the other potion becomes white. In this way, at step S3, the binarization is carried out and the operation proceeds to step S4.

At step S4, a boundary of white and black of the binarized image G2, that is, the outer shapes (edges) of the electric wire 2, the pair of side walls 109, the press contact blades 111*a*, 111*b*, 111*c* and the terminal holding portion 213 are extracted to provide the image G3 shown in FIG. 52. The operation proceeds to step S5.

At step S5, the outer shape of the portion in the circular arc shape, that is, the electric wire 2 is extracted from the extracted outer shapes (edges) to provide the image shown in FIG. 53. In the image G4, arbitrary three points P, Q, R are picked up on the outer shape of the electric wire 2 and the straight lines S, T (shown in FIG. 53 by bold lines) connecting the three points P, Q, R are calculated. The perpendiculars U, V (shown in FIG. 53 by one-dotted chain lines) of the respective straight lines S, T are calculated and the intersection C of the perpendiculars is calculated. The center C of the electric wire 2 is constituted by the intersection C. In this way, at step 5, the center C of the electric wire 2 is calculated and the operation proceeds to step S6.

At step S6, as shown by FIG. 54, the straight line W (shown by the two-dotted chain line in FIG. 54) passing the center C and in parallel with the surface 108*a* of the bottom wall 108 is calculated in the image G3. The distance H between the intersections C1, C2 is calculated by calculating the intersections C1, C2 of the straight line W and the outer faces 109*a* of the pair of side walls 109. In this way, there is measured the distance H between the outer faces 109*a* of the pair of side walls 109 in the direction passing the center C of the electric wire 2 and along the surface 108*a* of the bottom wall 108, that is, the width of the press contact terminal 100.

According to the fourth embodiment, the terminal holding portion 213 holds the electric wire connecting portion 104 of the press contact terminal 100 in which the electric wire 2 is press fit between the press contact blades 111*a*, 111*b*, 111*c* in the state in which the optical axis of light emitted by the light emitting portion 211 between the light emitting portion 211 and the image pickup portion 212 and the longitudinal direction of the electric wire 2 are in parallel with each other. Therefore, the image pickup portion 212 acquires the outer shapes of the electric wire 2, the pair of side walls 109 and the press contact blades 111*a*, 111*b*, 111*c* viewed from the position along the longitudinal direction of the press contact terminal 100 and the electric wire 2 at an interval therefrom. The processing apparatus 217 calculates the center C of the electric wire 2 from the acquired outer shapes. Since the processing apparatus 217 acquires the outer shapes viewed from the position along the longitudinal direction of the electric wire 2 at an interval therefrom, the calculated position of the center C of the electric wire 2 is accurate.

The processing apparatus 217 measures the distance H between the outer faces 109*a* of the pair of side walls 109 passing the center C of the electric wire 2. Therefore, the processing apparatus 217 measures the distance H between the outer faces 109*a* of the pair of side walls 109 always passing the center C of the electric wire 2, the position of the center C is accurate and therefore, the measured distance H between the outer faces 109*a* of the pair of side walls 109 becomes accurate.

Therefore, since the measuring apparatus 217 measures the distance H between the outer faces 109*a* of the pair of side walls 109 always passing the center C of the electric wire 2, the measured portion can be prevented from being dispersed at each measurement. The center C of the electric wire 2 can accurately be calculated. Therefore, the distance H between the outer faces 109*a* of the pair of side walls 109, that is, the width H of the press contact terminal 100 can accurately be measured.

Figure 55:
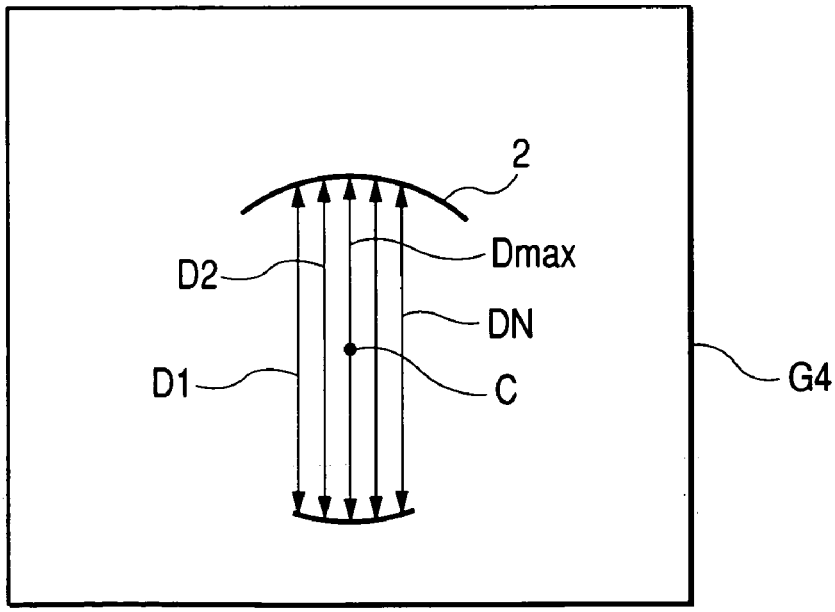
FIG. 55 is an explanatory view showing a modified example of the procedure of calculating the center of the electric wire shown in FIG. 13.

According to the fourth embodiment, the center C of the electric 2 is calculated by extracting the outer shape of the electric wire 2, providing the arbitrary three points P, Q, R and calculating the straight lines S, T passing the three points P, Q, R. However, according to the fourth embodiment, as shown by FIG. 55, widths D1, D2 . . . Dn orthogonal to the extracted surface 108*a* of the bottom wall 108 of the electric wire 2 are calculated and a maximum Dmax among these is calculated. Since the outer diameter of the electric wire 2 is constituted by Dmax, the position C dividing Dmax equally in two is calculated and the center C of the electric wire 2 is constituted by the position C. The center C of the electric wire 2 may be calculated in this way. In this way, according to the invention, the center C of the electric wire 2 may naturally be calculated by using various means.

Fifth Embodiment

An explanation will be given of an apparatus of grasping a press contact state of a press contact terminal (hereinafter, simply referred to as grasping apparatus) 1 according to a fifth embodiment of the invention in reference to FIG. 56 through FIG. 62. The grasping apparatus 1 shown in FIG. 56 reproduces to bring an electric wire 2 (shown in FIG. 10) into press contact with a press contact terminal 100 shown in FIG. 12 and measures displacements of press contact blades 111*b*, mentioned later, of the press contact terminal 100.

The grasping apparatus 301 measures contact loads P1, P2 between the press contact blades 111*a*, 111*b*, 111*c* of the press contact terminal 100 and a piezoelectric element 7, mentioned later, to thereby provide the contact loads between a core wire 3 of the electric wire 2 inserted between the press contact blades 111*a*, 111*b*, 111*c* and the press contact blades 111*a*, 111*b*, 111*c*. The grasping apparatus 301 is an apparatus of providing a relationship between an amount of expanding (also referred to as displacement) of a pair of side walls 109, mentioned later, before and after press contact and a sum of the press contact loads P1, P2.

Figure 56:
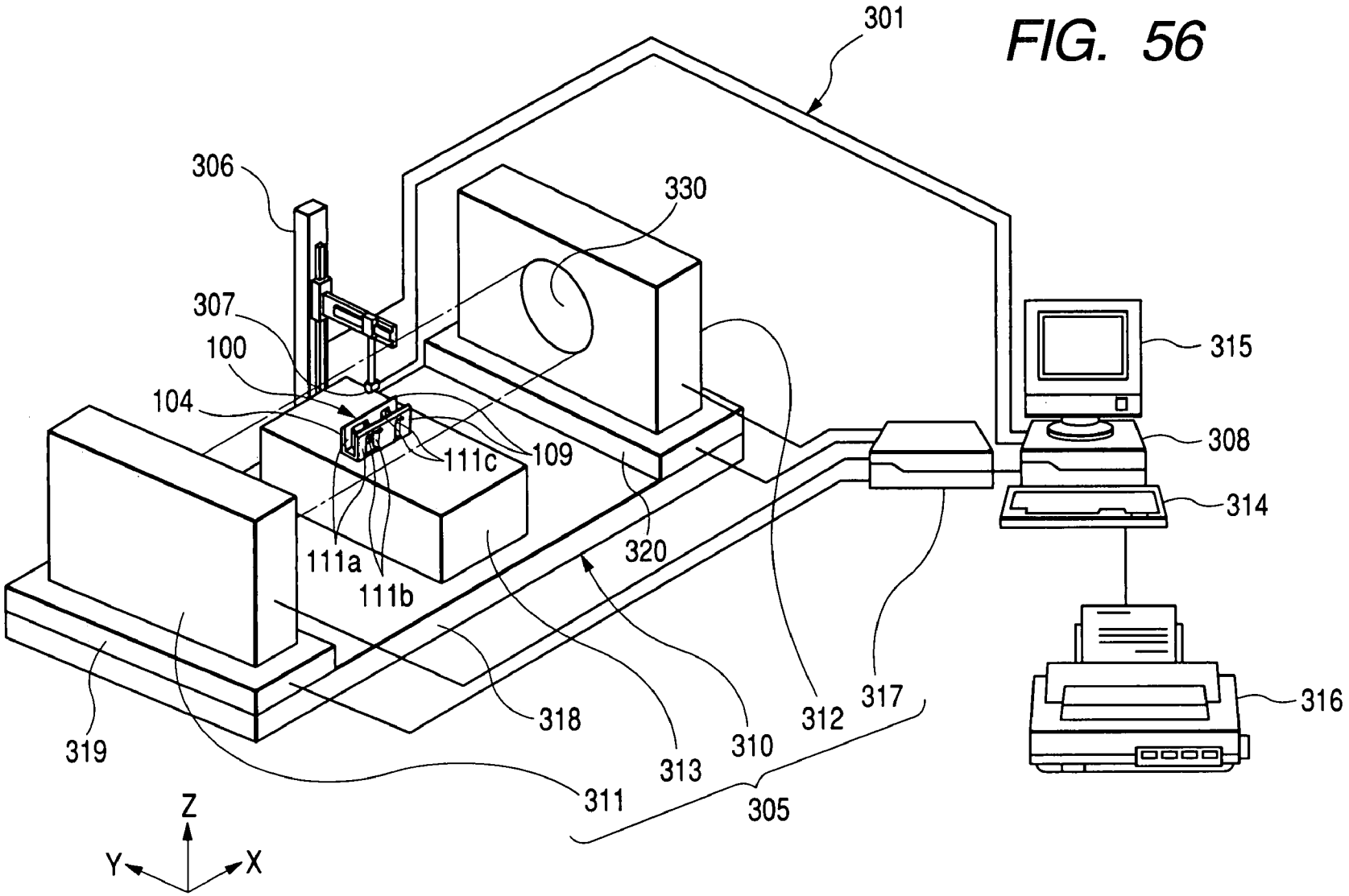
FIG. 56 is an explanatory view showing a constitution of a grasping apparatus according to a fifth embodiment of the invention.

The grasping apparatus 301 shown in FIG. 56 reproduces to press fit the electric wire 2 between the press contact blades 111*a*, 111*b*, 111*c*, measures a distance H between outer faces 109*a* of the side walls 109 and calculates a difference between the distance H and a distance h1 (shown in FIG. 8) between the outer faces 109*a* of the side walls 109 before press contact. The difference between the distance H and the distance h1 constitutes displacements of the pair of side walls 109 and constitutes displacements of the press contact blades 111*a*, 111*b*, 111*c* described in the specification. Therefore, the displacements of the press contact blades 111*a*, 111*b*, 111*c* described in the specification are an amount of expanding an interval between the outer faces 109*a* of the pair of side walls 109.

The grasping apparatus 1 calculates the contact loads P1, P2 between the core wire 3 of the electric wire 2 and the press contact blades 111*a*, 111*b*, 111*c* by reproducing to press fit the electric wire 2 between the press contact blades 111*a*, 111*b*, 111*c* and measuring the contact loads P1, P2 (shown in FIG. 17) between the piezoelectric element 307 and the press contact blades 111*a*, 111*b*, 111*c*. The grasping apparatus 301 calculates a relationship between the displacements of the press contact blades 111*a*, 111*b*, 111*c* and the sum of the contact loads P1, P2. The grasping apparatus 301 grasps a state of bringing the electric wire 2 into press contact with the press contact terminal 100 by calculating the relationship between the displacements and the contact loads. P1, P2.

The contact loads between the press contact blades 111*a* and the piezoelectric element 307, the contact loads P1, P2 between the press contact blades 111*b* and the piezoelectric element 307 and the contact load between the press contact blades 111*c* and the piezoelectric element 307 are substantially equal. Therefore, according to the fifth embodiment, the contact loads P1, P2 between the press contact blade 111*b* and the piezoelectric element 307 are measured by representing the press contact blades 111*a*, 111*b*, 111*c*.

Figure 57:
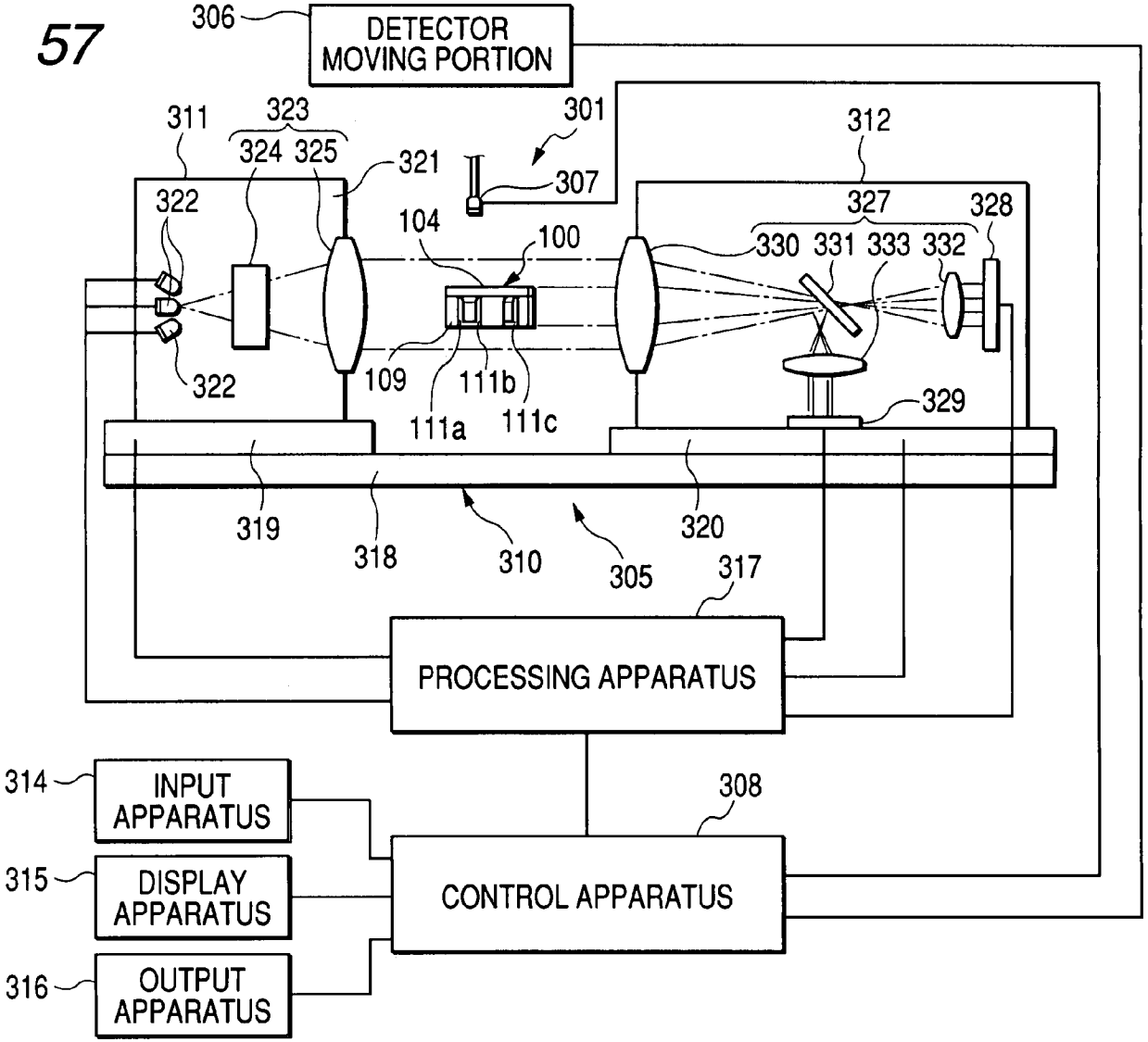
FIG. 57 is a block diagram showing a constitution of the grasping apparatus shown in FIG. 56.

As shown by FIG. 56 and FIG. 57, the grasping apparatus 301 is provided with a measuring apparatus 305 as a measuring unit, the detector moving portion 306, the piezoelectric element 307 as the detector, an input apparatus 314, a display apparatus 315, an output apparatus 316, and a control apparatus 308 as a calculating unit. As shown by FIG. 56 and FIG. 57, the measuring apparatus 305 is provided with an apparatus main body 310, a light emitting portion 311, an image pickup portion 312, a terminal holding portion 313 as a holding portion (shown in FIG. 56), and a processing apparatus 317 as a processing portion.

As shown by FIG. 56 and FIG. 57, the apparatus main body 310 is provided with a base 318, a light emitting moving portion 319, and an image pickup moving portion 320. The base 318 is installed above a floor of a factory. The light emitting moving portion 319 is attached to an upper face of the base 318 and moves the light emitting portion 311 along arrow marks X, Y, Z orthogonal to each other shown in FIG. 56. The image pickup moving portion 320 is attached to the upper face of the base 318 and moves the image pickup portion 312 along the arrow marks X, Y, Z orthogonal to each other shown in FIG. 56. The light emitting moving portion 319 is provided at one end portion of the base 318 and the image pickup moving portion 320 is provided at other end portion of the base 318.

The light emitting portion 311 is installed above the light emitting moving portion 319. As shown by FIG. 57, the light emitting portion 311 is provided with a main body portion 321, a plurality of light emitting diodes (hereinafter, described as LED) 322 as a light source provided at inside of the main body portion 321, and an optical portion 323.

The main body portion 321 is formed in a box-like shape and installed above the light emitting moving portion 319. The plurality of LEDs 322 are contained at inside of the main body portion 321 and emit fluxes of light, that is, become luminescent to a diffusing unit, mentioned later, of the optical portion 323 along one-dotted chain lines in FIG. 57. The optical portion 323 is provided with the diffusing unit 324 and a collimator 325. The diffusing unit 324 is contained at inside of the main body portion 321 for making intensities of the fluxes of light from the plurality of LEDs 322 uniform to guide to the collimator 325 along the one-dotted chain lines in FIG. 57.

The collimator 325 is attached to an outer wall of the main body portion 321. The collimator 325 converts light from the diffusing unit 324 into parallel light to emit to outside of the main body portion 321, that is, outside of the light emitting portion 311 along one-dotted chain lines in FIG. 57. In this way, the light emitting portion 311 emits light converted into parallel light to the image pickup, portion, 312 along one-dotted chain lines in FIG. 57. In this way, the light emitting portion 311 becomes luminescent.

The image pickup portion 312 is installed above the image pickup moving portion 320. As shown by FIG. 57, the image pickup portion 312 is provided with a main body portion 326, an optical portion 327, an optical axis matching image pickup element 328, and an image pickup element 329. The main body portion 326 is formed in a box-like shape and is installed above the image pickup moving portion 320.

The optical portion 327 is provided with a collimator 330, a beam splitter 331, a collimator for optical axis 332, and a collimator for image pickup 333. The collimator 330 is attached to an outer wall of the main body portion 326. The collimator 330 guides light from the light emitting portion 311 into the main body portion 326, that is, into the image pickup portion 312 along one-dotted chain lines in FIG. 57. The collimator 330 guides light from the light emitting portion 311 to the beam splitter 331.

The beam splitter 331 is contained at inside of the main body portion 326. The beam splitter 331 transmits a portion of light guided from the collimator 330 to guide to the collimator for optical axis 332 along one-dotted chain lines in FIG. 57. The beam splitter 331 reflects a remaining portion of the light to guide to the collimator for image pickup 332 along one-dotted chain lines in FIG. 57.

The collimator for optical axis 332 is contained at inside of the main body portion 326. The collimator for optical axis 332 converts light transmitted through the beam splitter 331 into parallel light to guide to the optical axis matching image pickup element 328 along one-dotted chain lines in FIG. 57. The collimator for image pickup 333 is contained at inside of the main body portion 326. The collimator for image pickup 333 converts light reflected by the beam splitter 331 into parallel light to guide to the image pickup element 329 along one-dotted chain lines in FIG. 57.

The optical axis matching image pickup element 328 is contained at inside of the main body portion 326. The optical axis matching image pickup element 328 comprises CMOS (Complementary Metal Oxide Semiconductor) and receives light guided from the beam splitter 331. The optical axis matching image pickup element 328 calculates a position of an optical axis of light guided from the beam splitter 331. The optical axis matching image pickup element 328 outputs the position of the calculated optical axis of light to the processing apparatus 317.

The image pickup element 329 is contained at inside of the main body portion 326. The image pickup portion comprises CCDs (Charge Coupled Device) for receiving light reflected by the beam splitter 331. The image pickup element 329 picks up images of the terminal holding portion 313 positioned between the light emitting portion 11 and the image pickup portion 312. The image pickup element 329 outputs a picked-up image G1 (shown in FIG. 59) to the processing apparatus 317.

The image G1 provided by being picked up by the image pickup element 329 comprises intensities of respective fluxes of light at respective pixels aligned on a plane. Therefore, the image G1 provided by being picked up by the image pickup element 329 constitutes plane monochrome images. In this way, the image pickup portion 329 receives light from the light emitting portion 311 and picks up an image of the electric wire connecting portion 104 of the press contact terminal 100 attached to the terminal holding portion 313 or a holding portion 364, mentioned later.

The terminal holding portion 313 is attached at a central portion of the base 318 of the apparatus main body 310. The terminal holding portion 313 is provided between the light emitting portion 311 and the image pickup portion 312. The electric wire connecting portion 104 of the press contact terminal 100 in which the electric wire 2 shown in FIG. 14 is brought into press contact with is attachable and detachable to and from the terminal holding portion 13. The terminal holding portion 313 is attached with the electric wire connecting portion 104 of the press contact terminal 100 in a state in which the longitudinal direction of the electric wire 2 brought into press contact with the electric wire connecting portion 104 and an optical axis of light emitted from the light emitting portion 311 to the image pickup portion 312 are in parallel with each other.

The terminal holding portion 313 is attached with the electric wire connecting portion 104 of the press contact terminal 100 in a state in which a total of the electric wire connecting portion 104 of the press contact terminal 100 is disposed within light emitted from the light emitting portion 311 to the image pickup portion 312. In this way, the terminal holding portion 313 holds the press contact blades 111*a*, 111*b*, 111*c* in a state in which a longitudinal direction of the electric wire 2 and an optical axis of the light is in parallel with each other.

Since the terminal holding portion 313 holds the electric wire connecting portion 104 in the state in which the longitudinal direction of the electric wire 2 and the optical axis are in parallel with each other, the image pickup portion 312 picks up images of the pair of side walls 109 and the press contact blades 111*a*, 111*b*, 111*c* viewed from a position along the longitudinal direction of the press contact terminal 100 and the electric wire 2 at an interval therefrom. That is, the image pickup portion 312 acquires outer shapes of the press contact blades 111*a*, 111*b*, 111*c* viewed from the position along the longitudinal direction of the press contact terminal 100 and the electric wire 2 at an interval therefrom.

The processing apparatus 317 is a computer provided with CPU (Central Processing Unit), ROM (Read-only Memory) and RAM (Random Access Memory) which are well known. The processing apparatus 317 is connected with the light emitting moving portion 319, LEDs 322 of the light emitting portion 311, the image pickup moving portion 320, the optical axis matching image pickup element 328 of the image pickup portion 312 and the image pickup element 329 of the image pickup portion 312 and controls operation of these. The processing apparatus 317 governs to control a total of the measuring apparatus 305.

The processing apparatus 317 is stored with a program for operating the measuring apparatus 305. The processing apparatus 317 makes the light emitting portion 311 emit light and makes the image pickup portion 312 receive light from the light emitting portion 311 before attaching the electric wire connecting portion 104 of the press contact terminal 100 to the terminal holding portion 313. The processing apparatus 317 coincides an optical axis of the light emitting portion 311 and an optical axis of the image pickup portion 312 by driving the respective moving portions 319, 320.

The processing apparatus 317 binarizes the image G1 (shown in FIG. 59) provided by picking up the image by the image pickup element 329 by a predetermined threshold. The processing apparatus 317 provides an image G3 constituted by extracting outer shapes (edges) of the pair of side walls 109, and the press contact blades 111*a*, 111*b*, 111*c* of the electric wire connecting portion 104 of the press contact terminal 100 as shown by FIG. 61 from a binarized image G2 (shown in FIG. 60) provided by the binarization.

Among the edges in the image G3, the surface 108*a* of the bottom wall 108 along the horizontal direction is extracted. Widths H1, H2, . . . Hn in a direction in parallel with the surface 108*a* of the bottom wall 108 are calculated and a maximum Hmax thereamong is calculated. The Hmax is outputted to the control apparatus 308 as the distance H between the outer faces 109*a* of the pair of side walls 109. The measuring apparatus 305 can measure the displacements of the press contact blades 111*a*, 111*b*, 111*c* by measuring the distances H, h1.

The detector moving portion 306 is installed above the base 318 of the measuring apparatus 305. The detector moving portion 306 moves the piezoelectric element 307 along arrow marks X, Y, Z in FIG. 56. The detector moving portion 306 disposes the piezoelectric element 307 right above between the press contact blades 111*b* of the electric wire connecting portion 104 of the press contact terminal 100 attached to the terminal holding portion 3013. The detector moving portion 306 makes the piezoelectric element 307 disposed right above between the press contact blades 111*b* proximate to the electric wire connecting portion 104 of the press contact terminal 100. The detector moving portion 306 inserts the piezoelectric element 307 between the press contact blades 111*b*.

The piezoelectric element 307 is supported by the detector moving portion 306. The piezoelectric element 307 is moved by the detector moving portion 306 along the arrow marks X, Y, Z in FIG. 56. The piezoelectric element 307 is made of, for example, a material having high rigidity and having piezoelectricity of lead titanate (PT), lead titanate zirconate (PZT), quartz. The piezoelectric element 307 is connected to the control apparatus 308. The piezoelectric element 307 is positioned right above between the press contact blades 111*b* by the detector moving portion 306 and thereafter inserted between the press contact blades 111*b*.

The piezoelectric element 307 generates an electromotive force when the piezoelectric element 307 is strained and outputs an output current in accordance with the electromotive force to the control apparatus 308. The output current constitutes information in accordance with the contact loads P1, P2 described in the specification. Further, a width W (shown in FIG. 16) in the direction (shown by an arrow mark S in FIG. 17) of aligning the pair of press contact blades 111*b* of the piezoelectric element 307 is equal to or larger than an interval D (shown in FIG. 16) between the press contact blades 111*a*, 111*b*, 111*c* and equal to or smaller than an outer diameter R (shown in FIG. 8) of the core wire 3 of the electric wire 2. In this way, when the piezoelectric element 307 is brought into contact with the press contact blades 111*b*, the piezoelectric element 307 is strained and generates the output current. Therefore, when the piezoelectric element 307 is inserted between the press contact blades 111*b*, the piezoelectric element 307 is brought into contact with the press contact blades 111*b* and generates the output current. In the illustrated example, the width W of the piezoelectric element 307 is equal to the outer diameter R of the core wire 3 of the electric wire 2.

The input apparatus 314 is used for variously operating the grasping apparatus 301. As input apparatus 301, a keyboard, a mouse, various switches and operation buttons which are well known can be used. In the illustrated example, a keyboard is used as the input apparatus 314.

The display apparatus 315 displays an operating state of the determining apparatus 301, the image G1 picked up by the pickup element 329 and a result of measurement. As the display apparatus 315, various display apparatus of a CRT (Cathode Ray Tube) display and a liquid crystal display which are well known can be used. In the illustrated example, a liquid crystal display is used as the display apparatus 315.

The output apparatus 316 outputs a result of measurement of the grasping apparatus 301 and the image G1 picked up by the image pickup element 329. As the output apparatus 316, a well known printer for printing the result of measurement and the image G1, a CD-ROM drive apparatus capable of writing the result of measurement and the image G1 to various record media such as CD-ROM as electronic information can be used. In the illustrated example, a printer is used as the output apparatus 316.

The control apparatus 308 is a computer provided with CPU (Central Processing Unit), ROM (Read-only Memory) and RAM (Random Access Memory) which are well known. The control apparatus is connected with the processing apparatus 317, the detector moving portion 306, the detector 307, the input apparatus 314, the display apparatus 315 and the output apparatus 316 of the measuring apparatus 305 to control operation of these. The control apparatus 308 governs to control a total of the determining apparatus 301.

The control apparatus 308 makes the processing apparatus 307 of the measuring apparatus 305 coincide optical axes of the collimators 325, 330 before grasping the press contact state of the press contact terminal 100. The control apparatus 308 makes the processing apparatus 317 pick up the image of the electric wire connecting portion 104 when the electric wire connecting portion 104 of the press contact terminal 100 is attached to the terminal holding portion 313. The control apparatus 308 makes the processing apparatus 317 binarize the picked-up image G1 (shown in FIG. 59). Thereafter, the distance h1 (shown in FIG. 16) between the outer faces 109*a* the pair of side walls 109 are calculated thereby. The distance h1 constitutes the width of the press contact terminal 100 before press contact. The control apparatus is stored with the width h1.

The control apparatus 308 makes the detector moving portion 6 position the piezoelectric element 307 right above between the press contact blades 111*b* and thereafter gradually approach the piezoelectric element 307 to the electric wire connecting portion 104 of the press contact terminal 100. When the output current is inputted from the piezoelectric element 307, the control apparatus 308 stops the detector moving portion 306, makes the measuring apparatus 305 measure the distance H between the outer faces 109*a* of the pair of side walls 109 and calculates the contact loads P1, P2 between the piezoelectric element 307 and the press contact blades 111*b* based on the output current inputted from the piezoelectric element 307.

The control apparatus 308 calculates a difference between the measured distance H and the distance h1 and calculates the displacements of the pair of side walls 109, that is, the press contact blades 111*b*. The control apparatus 308 calculates the sum of the contact loads P1, P2. The control apparatus 308 is stored with the displacements of the press contact blades 111*b* and the sum of the contact loads P1, P2 which are calculated.

The control apparatus 308 makes the detector moving portion 306 approach the piezoelectric element 307 to the electric wire connecting portion 107 of the press contact terminal 100 by a previously determined distance. That is, the control apparatus 308 makes the detector moving portion 306 inserts to a further depth side between the pair of press contact blades 111*b*. Thereafter, the control apparatus 308 calculates the displacements of the press contact blades 111*b* as described above, calculates the sum of the contact loads P1, P2 and is stored with the calculated values.

The control apparatus 308 inserts the piezoelectric element 307 to the further depth side between the pair of press contact blades 111*b* until the piezoelectric element 307 is positioned to a predetermined position. The control apparatus 308 calculates the displacements of the press contact blades 111*b* and the sum of the contact loads P1, P2 until the piezoelectric element 307 is positioned to the predetermined position. When the piezoelectric element 307 is positioned to the predetermined position, the control apparatus 308 calculates a relationship between the displacements of the press contact blades 111*b* and the sum of the contact loads P1, P2 shown in FIG. 62 by a graph and makes the detector moving portion 306 separate the piezoelectric element 307 from the electric wire connecting portion 104 of the press contact terminal 100.

Figure 62:
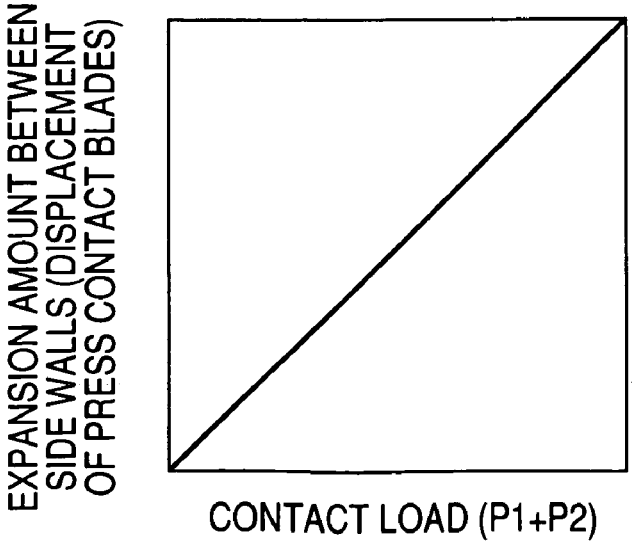
FIG. 62 is an explanatory view showing an example of a relationship between displacements of the press contact blades and contact loads grasped by the grasping apparatus shown in FIG. 56.

In this way, the control apparatus 308 calculates the relationship between the displacements of the press contact blades 111*b* and the sum of the contact loads P1, P2 shown in FIG. 62 by the graph to thereby grasp the press contact state of the electric wire connecting portion 104 of the press contact terminal 100.

Next, an explanation will be given of a procedure of grasping the press contact state of the electric wire connecting portion 104 of the press contact terminal 100 by the grasping apparatus 301 of the fifth embodiment.

Figure 58:
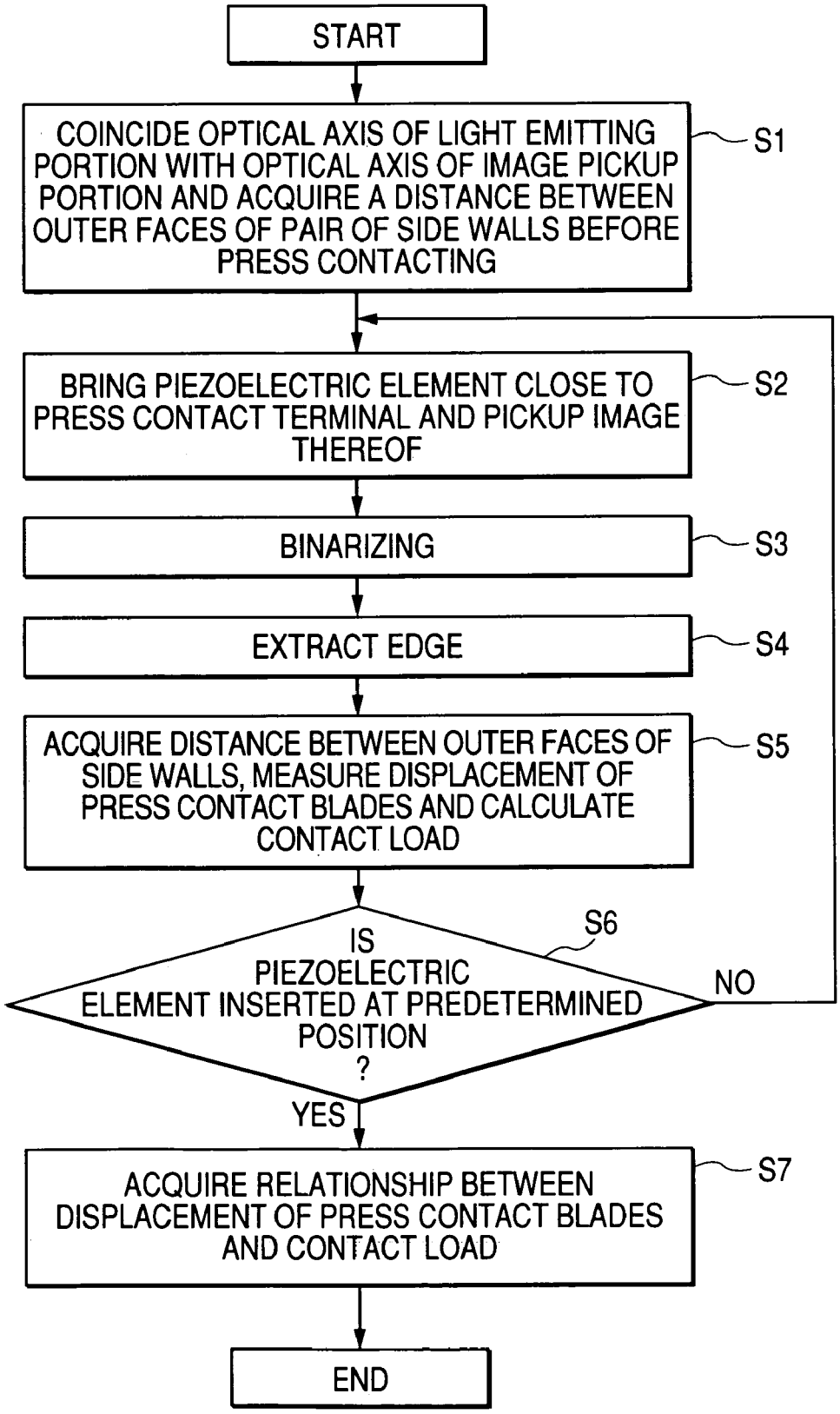
FIG. 58 is a flowchart showing a procedure of grasping the press contact state of the press contact terminal by the grasping apparatus shown in FIG. 26.

First, at step S1 in FIG. 58, the grasping apparatus 301 is started. The control apparatus 308 makes the measuring apparatus 305 emit light from the light emitting portion 311 to the image pickup portion 312. The control apparatus 8 makes the processing apparatus 317 coincide the optical axis of the collimator 325 of the light emitting portion 311 with the optical axis of the collimator 330 of the image pickup portion 312 by driving the respective moving portions 319, 320 based on the optical axis of light provided by receiving light by the optical axis matching image pickup element 328.

The electric wire connecting portion 104, that is, the press contact blades 111*a*, 111*b*, 111*c* are attached to the terminal holding portion 313. At this occasion, the electric wire connecting portion 104, that is, the press contact blades 111*a*, 111*b*, 111*c* are attached to the terminal holding portion 313 in a state in which the longitudinal direction of the electric wire 302 inserted between the press contact blades 111*a*, 111*b*, 111*c* and the optical axis of light emitted by the light emitting portion 311 are in parallel with each other. At this occasion, the electric wire connecting portion 104 of the press contact terminal 100 is brought into a state before press contact as shown by FIG. 14 and FIG. 16.

The control apparatus 308 makes the processing apparatus 317 emit light from the light emitting portion 311 to the image pickup portion 312 and make the image pickup portion 312 pick up the image. The control apparatus 308 makes the processing apparatus 317 calculate the distance h1 between the outer faces 109*a* of the pair of side walls 109 and store the calculated distance h1. In this way, at step S1, the distance h1 between the outer faces 109*a* of the pair of side walls 109 of the press contact terminal 100 before press contact is calculated by aligning the optical axis of the light emitting portion 311 and the optical axis of the image pickup portion 312. The operation proceeds to step S2.

At step S2, the control apparatus 308 makes the detector moving portion 306 move the piezoelectric element 307 and insert the piezoelectric element 307 gradually between the press contact blades 111*b*. When the output current is inputted from the piezoelectric element 307 to the control apparatus 308, the pair of side walls 109, that is, the press contact blades 111*b* are gradually separated from each other. The control apparatus 308 stops the detector moving portion 306. The control apparatus 308 makes the processing apparatus 317 emit light from the light emitting portion 311 to the image pickup portion 312 and makes the image pickup portion 312 pick up the image. The image pickup portion 12 provides the image G1 (shown in FIG. 59) showing the outer shapes of the press contact blades 111*a*, 111*b*, 111*c* viewed from the position along the longitudinal direction of the electric wire 2 at an interval therefrom.

At this occasion, light is emitted from the light emitting portion 311 to the image pickup portion 312 and therefore, in the image G1 provided by the image pickup portion 312, the terminal holding portion 313, the pair of side walls 109 and the press contact blades 111*a*, 111*b*, 111*c* become dark by constituting shadow and the other portion becomes bright. In this way, at step S2, the images of the press contact blades 111*a*, 111*b*, 111*c* of the press contact terminal 100 are picked up. In this way, at step S2, the piezoelectric element 307 is made to be proximate to the electric wire connecting portion 104 of the press contact terminal 100 and images of these are picked up. The operation proceeds to step S3.

Figure 59:
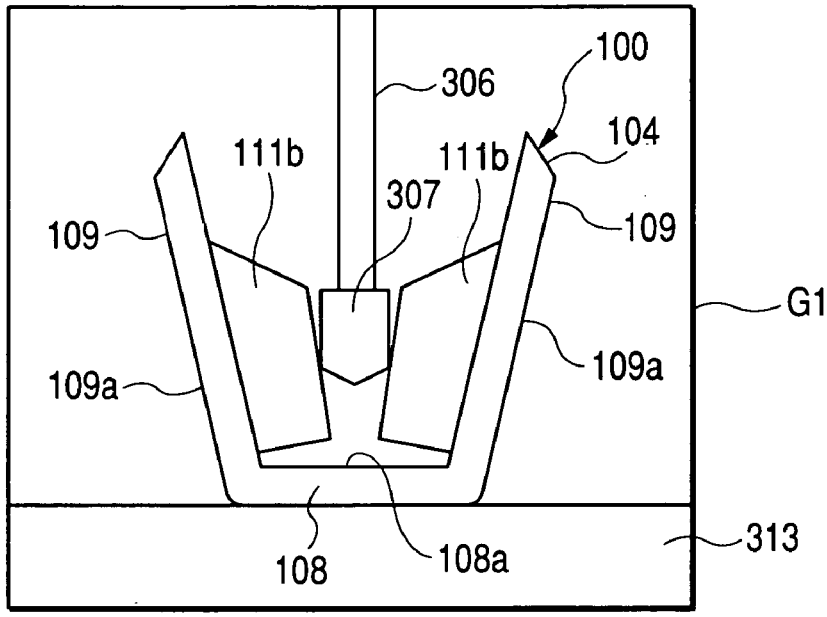
FIG. 59 is an explanatory view showing an image provided at step S2 of the flowchart shown in FIG. 58.
Figure 60:
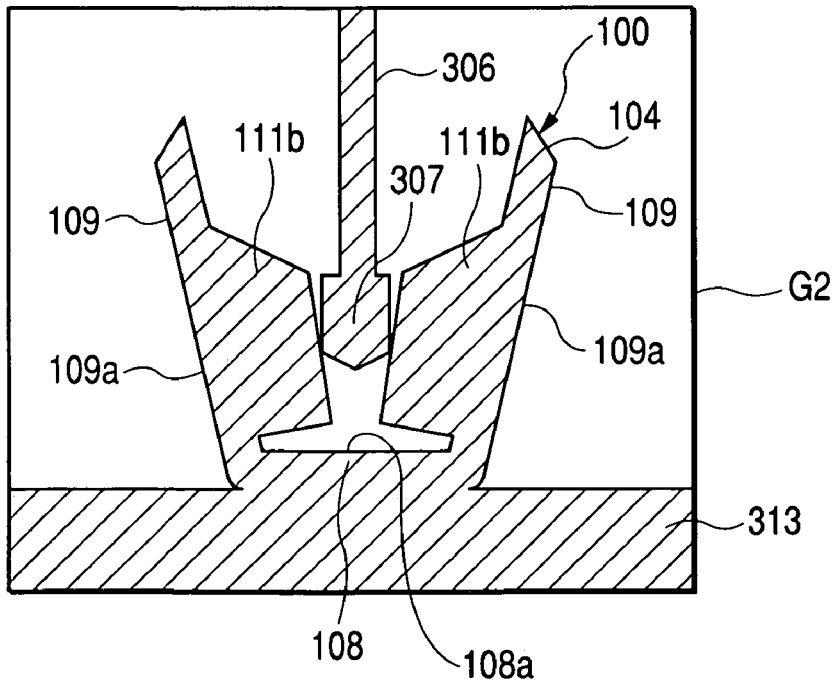
FIG. 60 is an explanatory view showing a binarized image provided by binarizing the image shown in FIG. 59.
Figure 61:
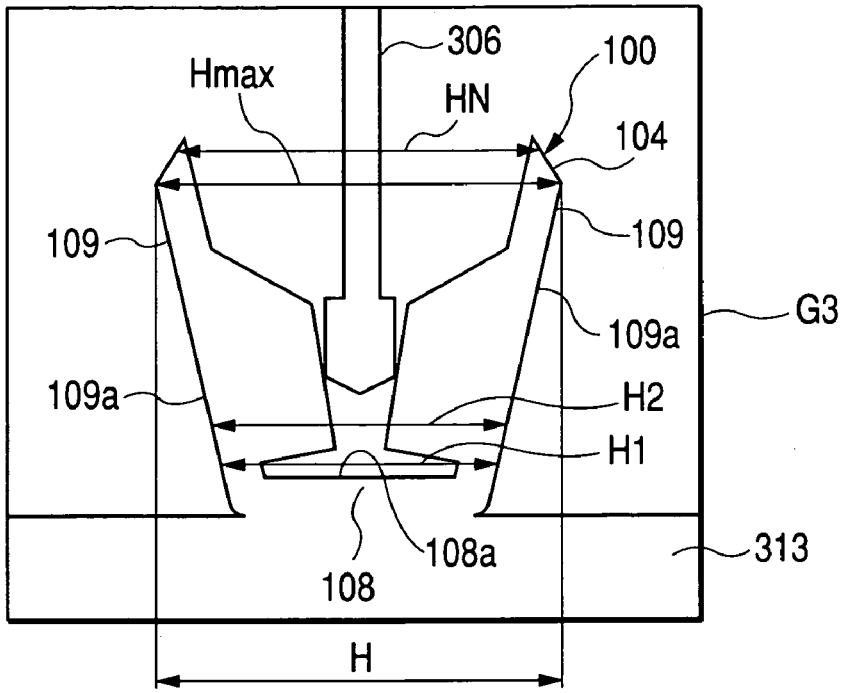
FIG. 61 is an explanatory view showing an image provided by extracting an outer shape (edge) from the binarized image shown in FIG. 60.

At step S3, the image G1 shown in FIG. 59 is binarized by a predetermined threshold to provide the binarized image G2 shown in FIG. 60. In the binarized image G2 shown in FIG. 60, the terminal holding portion 313, the pair of side walls 109 and the press contact blades 111*a*, 111*b*, 111*c* shown by parallel hatched lines become black and the other portion becomes white. In this way, at step S3, the binarization is carried out and the operation proceeds to step S4.

At step S4, a boundary of white and black of the binarized image G2, that is, the outer shapes (edges) of the pair of side walls 109, the press contact blades 111*a*, 111*b*, 111*c* and the terminal holding portion 313 are extracted to provide the image G3 shown in FIG. 61. The operation proceeds to step S5.

At step S5, the processing apparatus 317 extracts the surface 108*a* of the bottom wall 108 from the extracted outer shapes (edges), calculates the widths H1, H2 . . . HN of the outer shapes (edges) along the surface 108*a* to calculate the maximum width Hmax. The processing apparatus 317 outputs the maximum width Hmax to the control apparatus 308 as the distance H between the outer faces 109*a* of the pair of side walls 109. The control apparatus 308 calculates the difference between the distance H and the h1 and stores the difference as the displacements of the press contact blades 111*b*.

At step S5, the control apparatus 308 calculates the contact loads P1, P2 between the piezoelectric element 307 and the press contact blades 111*b* based on the output current from the piezoelectric element 307. The control apparatus 308 stores the sum of the contact loads P1, P2. In this way, at step S5, the distance H between the outer faces 109*a* of the side walls 109 is calculated. The displacements of the press contact blades 111*b* are measured and the contact loads P1, P2 between the piezoelectric element 307 and the press contact blades 111*b* are calculated. The operation proceeds to step 6.

At step S6, the control apparatus 308 determines whether the piezoelectric element 307 is inserted between the press contact blades 111*b* to the predetermined position shown in FIG. 15 and FIG. 17. When it is determined that the piezoelectric element 307 is not inserted between the press contact blades 111*b* to the predetermined position, the operation returns to step S2. At step S2, the control apparatus 308 inserts again the piezoelectric element 307 to the depth side between the press contact blades 111*b* by driving the detector moving portion 306. The operation successively proceeds from step S2 to step S5 and calculates the displacements of the press contact blades 111*b* and the sum of the contact loads P1, P2 to store. In this way, the displacements of the press contact blades 111*b* and the sum of the contact loads P1, P2 are calculated by gradually inserting the piezoelectric element 307 at the depth side between the piezoelectric element 307 and the press contact blades 111*b* until the piezoelectric element 307 is positioned at the predetermined position shown in FIG. 15 and FIG. 17.

When it is determined that the piezoelectric element 307 is inserted between the press contact blades 111*b* to the predetermined position, the operation proceeds to step S7. At step S7, the relationship between the displacements of the press contact blades 111*b* and the contact loads shown in FIG. 62 by the graph is calculated based on the displacements of the press contact blades 111*b* and the contact loads P1, P2 which are stored as described above.

According to the fifth embodiment, the piezoelectric element 307 as the detector is inserted between the press contact blades 111*b*. Therefore, in inserting the piezoelectric element 307 between the pair of press contact blades 111*b*, the press contact blades 111*b*, that is, the pair of side walls 109 are not hampered from separating from each other. Therefore, information in accordance with the contact loads P1, P2 between the press contact blades 111*b* detected by the piezoelectric element 307 becomes proximate to the contact loads when the electric wire 2 is inserted between the pair of press contact blades 111*b*.

The contact loads P1, P2 calculated by the control apparatus 308 become proximate to contact loads when the electric wire 2 is inserted between the pair of press contact blades 111*b*. Therefore, the press contact state of the press contact terminal 100 in which the electric wire 2 is inserted between the press contact blades 111*b* can accurately be grasped.

In addition to the contact loads P1, P2, the measuring apparatus 305 measures the displacements of the press contact blades 111*b*. The relationship between the contact loads P1, P2 and the displacements of the press contact blades 111*b* is grasped. Therefore, the press contact state of the press contact terminal 100 can further accurately be grasped.

The terminal holding portion 313 holds the electric wire connecting portion 104, that is, the press contact blades 111*a*, 111*b*, 111*c* in the state in which the optical axis of light emitted by the light emitting portion 311 between the light emitting portion 311 and the image pickup portion 312 and the electric wire 2 are in parallel with each other. Therefore, the image pickup portion 312 acquires the outer shapes of the press contact blades 111*a*, 111*b*, 111*c* viewed from the position along the longitudinal direction of the electric wire 2 inserted between the press contact blades 111*a*, 111*b*, 111*c* at an interval therefrom. Since the processing apparatus 317 measures the displacements of the press contact blades 111*a*, 111*b*, and 111*c* from the acquired outer shapes, the measured displacements of the press contact blades 111*a*, 111*b*, 111*c* become accurate. Therefore, the press contact state of the press contact terminal in which the electric wire 2 is inserted between the press contact blades 111*a*, 111*b*, 111*c* can further accurately be grasped.

The piezoelectric element 307 is used as the detector. The width W of the piezoelectric element 307 is equal to or larger than the interval D between the press contact blades 111*a*, 111*b*, 111*c* and equal to or smaller than the outer diameter R of the core wire 3 of the electric wire 2. Therefore, a state of the press contact blades 111*b* when the piezoelectric element 307 is inserted between the pair of press contact blades 111*b* and a state of the press contact blades 111*a*, 111*b*, 111*c* when the electric wire 2 is inserted between the pair of press contact blades 111*a*, 111*b*, 111*c* become proximate to each other. The control apparatus 308 calculates the contact loads P1, P2 based on the output current of the piezoelectric element 7 by using the piezoelectric element 307 as the detector. Therefore, the accurate contact loads P1, P2 can be provided. Therefore, the press contact state of the press contact terminal 100 in which the electric wire 302 is inserted between the press contact blades 111*a*, 111*b*, 111*c* can further accurately be grasped.

Sixth Embodiment

Next, an explanation will be given of the determining apparatus 1 according to a sixth embodiment of the invention in reference to FIG. 63 through FIG. 66. Further, portions thereof the same as those of the fifth embodiment are attached with the same notations and an explanation thereof will be omitted.

Figure 63:
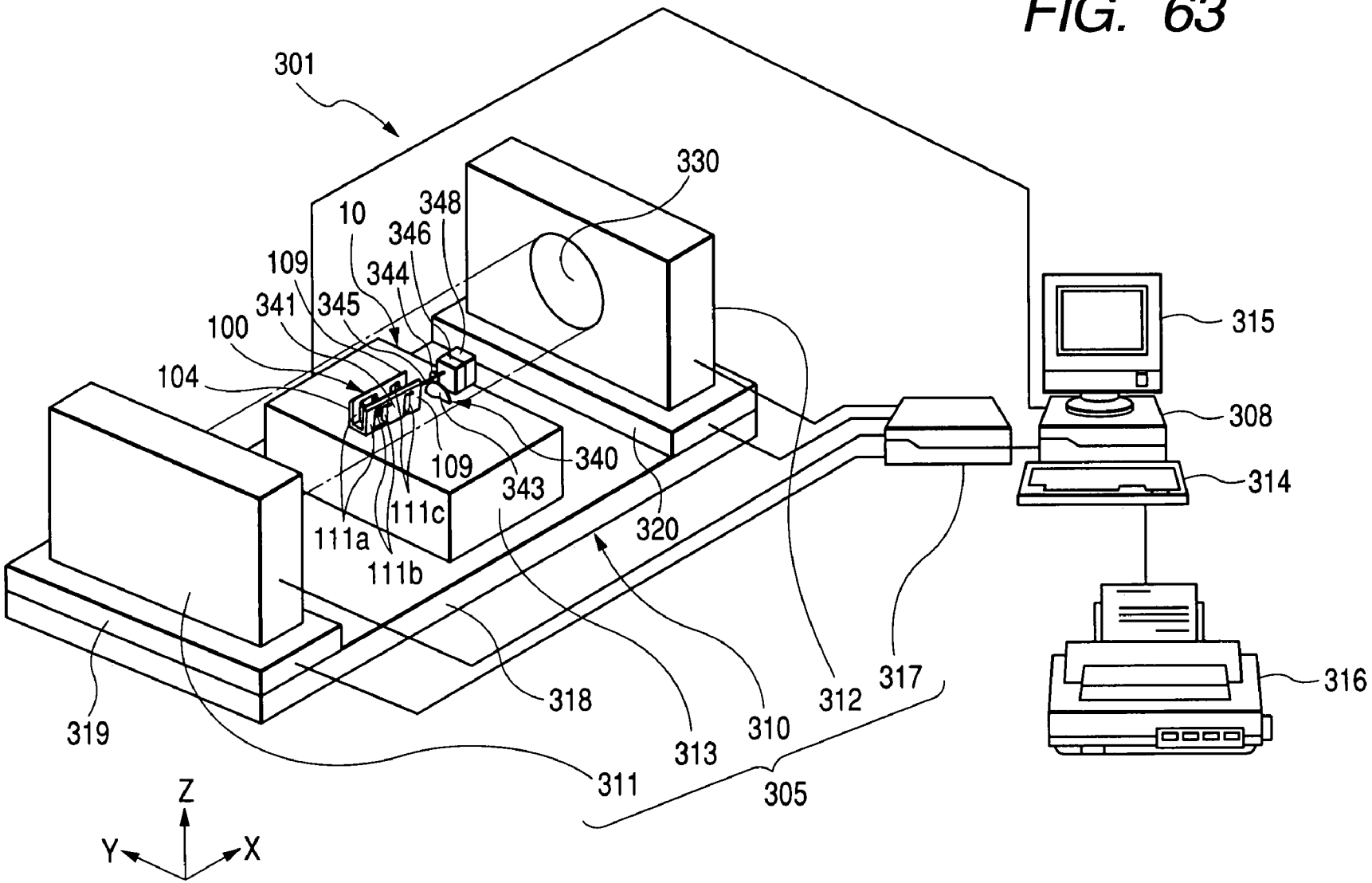
FIG. 63 is an explanatory view showing a constitution of a grasping apparatus according to a sixth embodiment of the invention.
Figure 64:
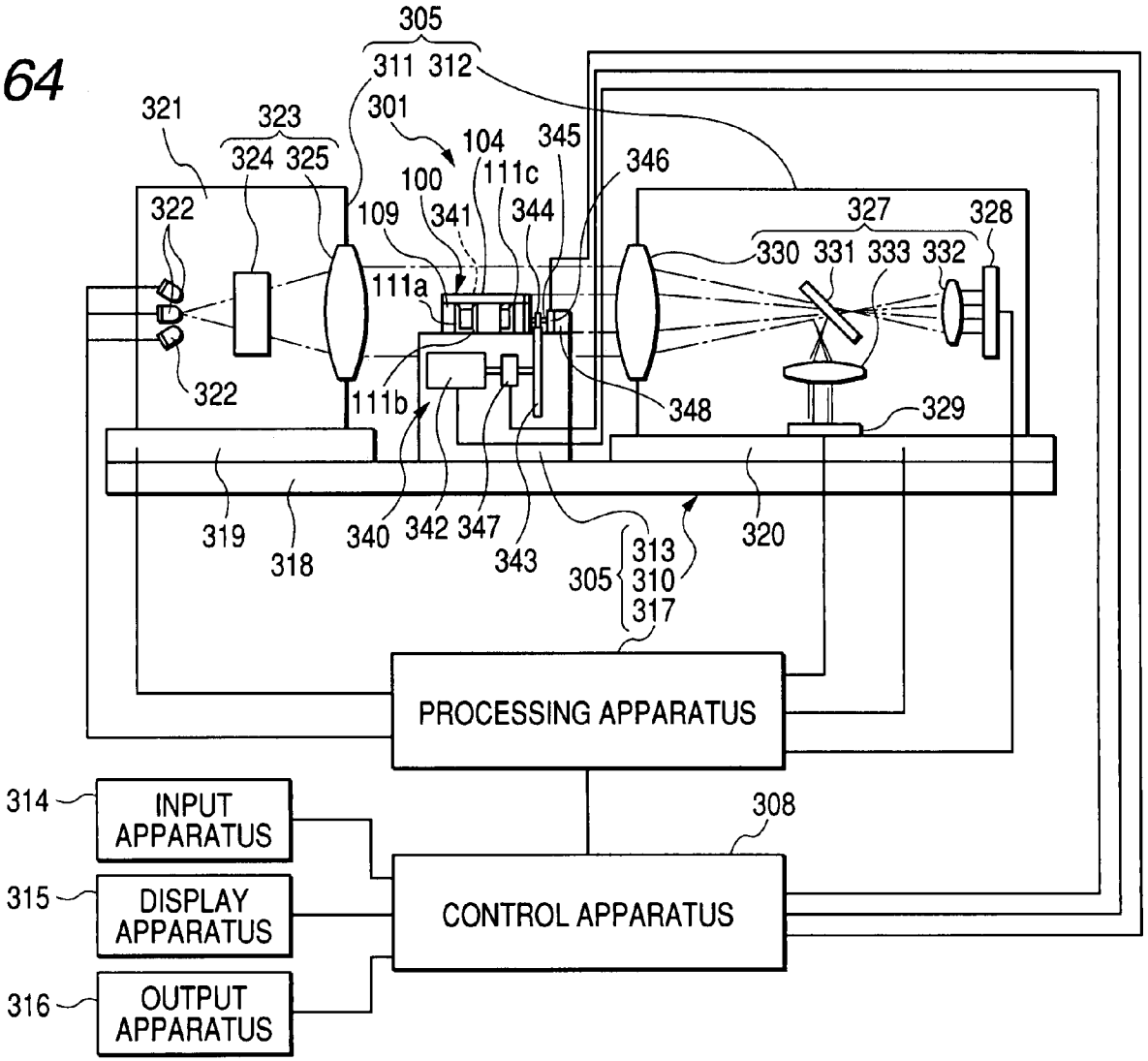
FIG. 64 is a block diagram showing a constitution of the grasping apparatus shown in FIG. 63.

As shown by FIG. 63 and FIG. 64, the determining apparatus 301 of the sixth embodiment is provided with a rotating mechanism 340 and a rotor 341 in place of the detector moving portion 306 and the piezoelectric element 307. The rotor 341 constitutes the detector described in the specification. As shown by FIG. 64, the rotating mechanism 340 is provided with a motor 342 as a drive source, a large diameter gear 343, a small diameter gear 344, a rotating shaft 345, a revolution counter 346, and a torque meter 347. The motor 342 is attached to the terminal holding portion 313. An output shaft of the motor 342 is in parallel with the optical axis of light emitted by the light emitting portion 311.

The large diameter gear 343 is attached to the output shaft of the motor 342. The large diameter gear 343 and the output shaft of the motor 342 are coaxial. The small diameter gear 344 is brought in mesh with the large diameter gear 343. An outer diameter of the small diameter gear 344 is smaller than an outer diameter of the large diameter gear 343. The rotating shaft 345 is formed in a rod-like shape and is rotatably supported by the terminal holding portion 313 by a bearing 348. The rotating shaft 345 is attached with the small diameter gear 344. The rotating shaft 345 and the small diameter gear 344 are coaxial.

The revolution counter 346 is attached to the rotating shaft 345. The resolution counter 346 detects a rotational angle of the rotating shaft 345. The revolution counter 346 is connected to the control apparatus 308 and outputs information in accordance with the rotational angle of the rotating shaft 345 to the control apparatus 308.

The torque meter 347 is attached to the output shaft of the motor 342. The torque meter 347 detects a torque of the output shaft of the motor 342. The torque meter 347 is connected to the control apparatus 308 and outputs information in accordance with the torque of the output shaft of the motor 342, that is, the torque of the rotating shaft 345 to the control apparatus 308. The torque constitutes information in accordance with the contact loads P1, P2 described in the specification.

As shown by FIG. 34 and FIG. 35, the rotor 341 is formed in an oval shape in a plane shape thereof. A center of the rotor 341 is attached with the rotating shaft 345. Therefore, the rotor 341 is rotated by the motor 342. The rotor 341 is inserted between the press contact blades 111*b* of the electric wire connecting portion 104 of the press contact terminal 100 attached to the terminal holding portion 313. A width Wa1 (shown in FIG. 34) in a direction of a short diameter of the rotor 341 constitutes a minimum width of the rotor 341 described in the specification. A width Wa2 (shown in FIG. 35) in a direction of a long diameter of the rotor 341 constitutes a maximum width of the rotor 341 described in the specification.

The width Wa1 in the direction of the short diameter of the rotor 341 and the width Wa2 in the direction of the long diameter thereof are equal to or larger than the interval between the press contact blades 111*a*, 111*b*, 111*c* and equal to or smaller than the outer diameter R of the core wire 3 of the electric wire 2. In the illustrated example, the width Wa1 in the direction of the short diameter is equal to the interval D between the press contact blades 111*a*, 111*b*, 111*c* and the width Wa2 in the direction of the long diameter is equal to the outer diameter R of the core wire 3 of the electric wire 2. The rotor 341 produces information in accordance with the torque, that is, the contact loads P1, P2 by being brought into contact with the press contact blades 111*b* by being inserted between the press contact blades 111*b* and rotated by the motor 342.

The control apparatus 308 of the sixth embodiment is connected with the motor 342, the resolution counter 346 and the torque meter 347 of the rotating mechanism 340. The control apparatus 308 controls the motor 342 based on information in accordance with the rotational angle of the rotating shaft 345 from the revolution counter 346. The control apparatus 308 calculates the contact loads P1, P2 based on information in accordance with the torque inputted from the torque meter 347.

The control apparatus 308 makes the processing apparatus 317 of the measuring apparatus 305 coincide the optical axes of the collimators 325, 330 before grasping the press contact state of the press contact terminal 100. The control apparatus 308 makes the processing apparatus 317 pick up the image of the electric wire connecting portion 104 when the electric wire connecting portion 104 of the press contact terminal 100 is attached to the terminal holding portion 313 and the rotor 341 is inserted between the press contact blades 111*b*. At this occasion, as shown by FIG. 34, the long diameter of the rotor 341 is along the vertical direction, that is, the outer face 109*a* of the side wall 109. The control apparatus 308 makes the processing apparatus 317 binarize the picked up image and thereafter calculate the distance h1 (shown in FIG. 34) between the outer faces 109*a* of the pair of side walls 109. The distance h1 constitutes the width of the press contact terminal 100 before press contact. The control apparatus 308 is stored with the width h1.

The control apparatus 308 makes the rotor 341 gradually rotate by driving the motor 342 of the rotating mechanism 340. When the control apparatus 308 recognizes rotation of the rotor 341 based on information from the revolution counter 346, the control apparatus 308 stops the rotating mechanism 340 and makes the measuring apparatus 305 measure the distance H (shown in FIG. 35) between the outer faces 109*a* of the pair of side walls 109 and calculates the contact loads P1, P2 (shown in FIG. 35) between the rotor 341 and the press contact blades 111*b* by dividing a torque inputted from the torque meter 347 by a half value of the width Wa2 in the direction of the long diameter of the rotor 341.

The control apparatus 308 calculates the difference between the measured distance H and the distance h1 and calculates the displacements of the pair of side walls 109, that is, the press contact blades 111*b*. The control apparatus 308 calculates the sum of the contact loads P1, P2. The control apparatus 308 is stored with the displacements of the press contact blades 111*b* and the sum of the contact loads P1, P2 which are calculated.

The control apparatus 308 makes the rotating mechanism 340 rotate the rotor 341 by a previously determined angle. That is, the control apparatus 308 further rotates the rotor 341. Thereafter, the control apparatus 308 calculates the displacements of the press contact blades 111*b* as described above, calculates the sum of the contact loads P1, P2 and is stored with the calculated values.

The control apparatus 308 rotates the rotor 341 between the pair of press contact blades 111*b* until the rotor 341 is rotated by a predetermined angle (until the long diameter shown in FIG. 35 is in parallel with the arrow mark S). The control apparatus 308 calculates the displacements of the press contact blades 111*b* and the sum of the contact loads P1, P2 until the rotor 341 is rotated by the predetermined angle (until the long diameter is in parallel with the arrow mark S).

When the rotor 341 is rotated by the predetermined angle, the control apparatus 308 calculates the relationship between the displacements of the press contact blades 111*b* and the sum of the contact loads P1, P2 and makes the rotating mechanism 340 stop to rotate the rotor 341. In this way, the control apparatus 308 grasps the press contact state of the electric wire connecting portion 104 of the press contact terminal 100 by calculating the relationship between the displacements of the press contact blades 111*b* and the sum of the contact loads P1, P2.

Next, an explanation will be given of a procedure of grasping the press contact state of the electric wire connecting portion 104 of the press contact terminal 100 by the grasping apparatus 301 of the sixth embodiment.

Figure 65:
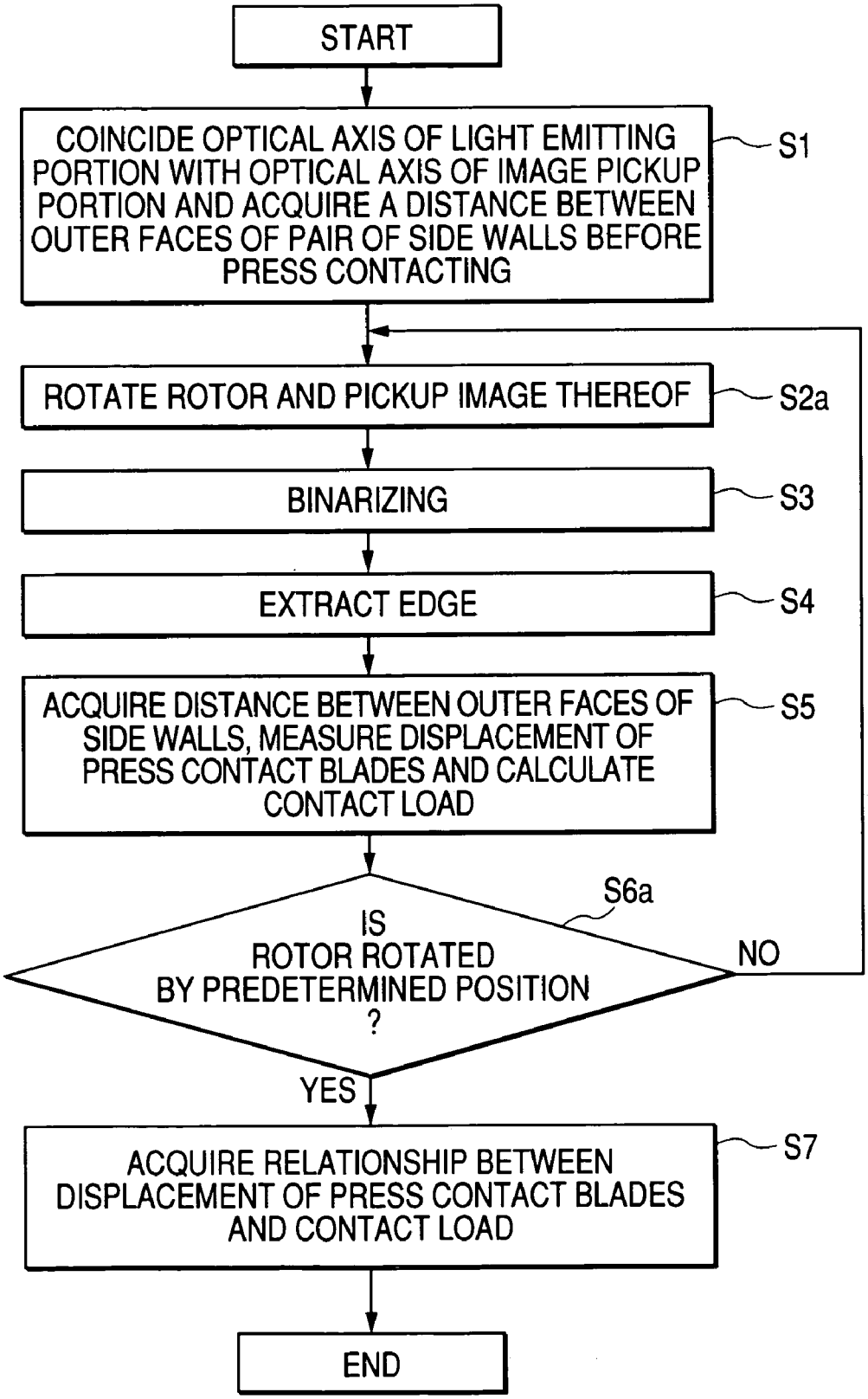
FIG. 65 is a flowchart showing a procedure of grasping a press contact state of a press contact terminal by the grasping apparatus shown in FIG. 63.

First, the grasping apparatus 301 is started at step S1 in FIG. 65. The control apparatus 308 makes the measuring apparatus 305 emit light from the light emitting portion 311 to the image pickup portion 312. The control apparatus 8 makes the processing apparatus 317 coincide the optical axis of the collimator 325 of the light emitting portion 25 and the optical axis of the collimator 330 of the image pickup portion 312 by driving the respective moving portions 319, 320 based on the optical axis of light provided by receiving light by the optical axis matching image pickup element 328.

Figure 33:
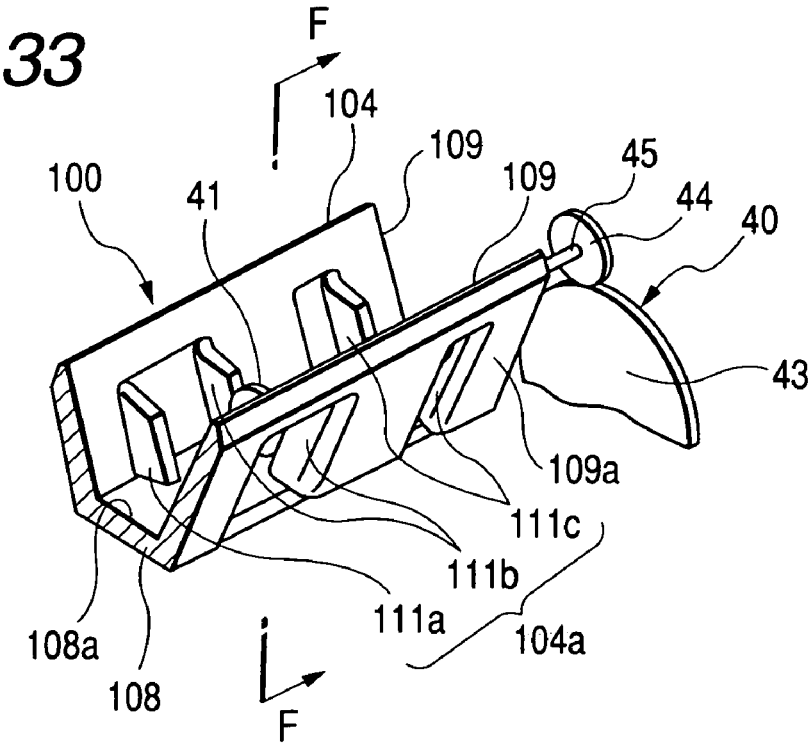
FIG. 33 is a perspective view showing a state of rotating the rotor shown in FIG. 32 between the press contact blades.

The terminal holding portion 313 is attached with the press contact terminal 100, that is, the press contact blades 111*a*, 111*b*, 111*c* and the rotor 341 is inserted between the press contact blades 111*b*. At this occasion, the long diameter of the rotor 341 is made to be along the vertical direction and as shown by FIG. 32 and FIG. 33, the electric wire connecting portion 104 of the press contact terminal 100 is brought into a state before press contact. The press contact terminal 100, that is, the press contact blades 111*a*, 111*b*, 111 are attached to the terminal holding portion 313 in a state in which the longitudinal direction of the electric wire 2 inserted between the press contact blades 111*a*, 111*b*, 111 and the optical axis of light emitted by the light emitting portion 311 are in parallel with each other.

The control apparatus 308 makes the processing portion 317 emit light from the light emitting portion 311 to the image pickup portion 312 and makes the image pickup portion 312 pick up the image. The control apparatus 308 makes the processing apparatus 317 calculate the distance H1 between the outer faces 109*a* of the pair of side walls 109 and store the calculated distance h1. In this way, at step S1, the distance h1 between the outer faces 109*a* of the pair of side walls 109 of the press contact terminal 100 before press contact is calculated by aligning the optical axis of the light emitting portion 311 and the optical axis of the image pickup portion 312. The operation proceeds to step S2*a*.

At step S2*a*, the control apparatus 308 makes the rotating mechanism 340 gradually rotate the rotor 341 between the press contact blades 111*b*. When the control apparatus 308 is inputted with information indicating rotation of the rotating shaft 345 from the revolution counter 346, the pair of side walls 109, that is, the press contact blades 111*b* are gradually separated from each other. Then, the control apparatus 308 stops the rotating mechanism 340. The control apparatus 308 makes the processing apparatus 317 emit light from the light emitting portion 311 to the image pickup portion 312 and makes the image pickup portion 312 pick up the image and the operation proceeds to step S3.

At step S3, the picked-up image is binarized by the predetermined threshold and the operation proceeds to step S4. At step S4, the operation extracts the outer shapes (edges) of the pair of side walls 109, the press contact blades 111*a*, 111*b*, 111*c* and the terminal holding portion 313 of the image provided by the binarization and proceeds to step S5.

At step S5, the processing apparatus 317 calculates the distance H between the outer faces 109*a* of the pair of side walls 109 to output to the control apparatus 308. The control apparatus 308 calculates the difference between the distance H and the h1 and stores the difference as the displacements of the press contact blades 111*b*.

At step S5, the calculating portion 335 of the control apparatus 308 calculates the contact loads P1, P2 between the rotor 341 and the press contact blades 111*b* by dividing the torque from the torque meter 347 by the half value of the width Wa2 in the direction of the long diameter of the rotor 341. The control apparatus 308 stores the sum of the contact loads P1, P2. In this way, at step S5, the distance H between the outer faces 109*a* of the side walls 109 is calculated, the displacements of the press contact blades 111*b* are measured and the contact loads P1, P2 between the rotor 341 and the press contact blades 111*b* are calculated. The operation proceeds to step S6*a*.

At step S6*a*, the control apparatus 308 determines whether the rotor 341 is rotated to the predetermined angle. When it is determined that the rotor 341 is not rotated to the predetermined angle, the operation returns to step S2*a*. At step S2*a*, the control apparatus 308 drives again the rotating mechanism 340 and rotates the rotor 341 between the press contact blades 111*b*. The operation successively proceeds from step S2*a* to step S5 and calculates the displacements of the press contact blades 111*b* and the sum of the press contact loads P1, P2 to store. In this way, the control apparatus 308 calculates the displacements of the press contact blades 111*b* and the sum of the contact loads P1, P2 by gradually rotating the rotor 341 between the press contact blades 111*b* until the rotor 341 is rotated by the predetermine angle shown in FIG. 33 and FIG. 35.

When it is determined that the rotor 341 is rotated between the press contact blades 111*b* to the predetermined angle at step S6*a*, the operation proceeds to step S7. At step S7, the relationship between the displacements of the press contact blades 111*b* and the contact loads P1, P2 is calculated based on the displacements of the press contact blades 111*b* and the contact loads P1, P2 which are stored as described above.

According to the sixth embodiment, the rotor 341 as the detector is inserted between the press contact blades 111*b*. Therefore, in inserting the rotor 341 between the pair of press contact blades 111*b* to rotate, the press contact blades 111*b*, that is, the pair of side walls 109 are not hampered from separating from each other. Therefore, information in accordance with the contact loads P1, P2 between the rotor 341 and the press contact blades 111*b* detected by rotating the rotor 341 becomes proximate to the contact loads when the electric wire 2 is inserted between the pair of press contact blades 111*b*.

The contact loads P1, P2 calculated by the control apparatus 308 become proximate to contact loads when the electric wire 2 is inserted between the pair of press contact blades 111*b*. Therefore, the contact state of the press contact terminal 100 in which the electric wire 2 is inserted between the press contact blades 111*b* can accurately be grasped.

In addition to the contact loads P1, P2, the measuring apparatus 305 measures the displacements of the press contact blades 111*b*. The relationship between the contact loads P1, P2 and the displacements of the press contact blades 111*b* is grasped. Therefore, the press contact state of the press contact terminal 100 can further accurately be grasped.

The terminal holding portion 313 holds the electric wire connecting portion 104, that is, the press contact blades 111*a*, 111*b*, 111*c* in the state in which the optical axis of light emitted by the light emitting portion 311 between the light emitting portion 311 and the image pickup portion 312 and the electric wire are in parallel with each other. Therefore, the image pickup portion 312 acquires outer shapes of the press contact blades 111*a*, 111*b*, 111*c* viewed from the position along the longitudinal direction of the electric wire 2 inserted between the press contact blades 111*a*, 111*b*, 111*c* at an interval therefrom. Since the processing apparatus 317 measures the displacements of the press contact blades 111*a*, 111*b*, 111*c* from the acquired outer shapes, the measured displacements of the press contact blades 111*a*, 111*b*, 111*c* become accurate. Therefore, the press contact state of the press contact terminal 100 in which the electric wire 2 is inserted between the press contact blades 111*a*, 111*b*, 111*c* can further accurately be grasped.

The rotor 341 inserted between the press contact blades 111*b* and driven to rotate by the motor 342 is used as the detector. Both of the width Wa2 in the direction of the long diameter and the width Wa1 in the direction of the short diameter of the rotor 341 are equal to or larger than the interval D between the press contact blades 111*b* and equal to or smaller than the outer diameter R of the core wire 3 of the electric wire 2. Therefore, a state of the press contact blades 111*b* when the rotor 341 is rotated between the press contact blades 111*b* and a state of the press contact blades 111*a*, 111*b*, 111*c* when the electric wire 2 is inserted between the pair of press contact blades 111*a*, 111*b*, 111*c* become proximate to each other.

The control apparatus 308 calculates the contact loads P1, P2 based on the torque of rotating the rotor 341 by using the rotor 341 as the detector. Therefore, the accurate contact loads P1, P2 can be provided. Therefore, the contact state of the press contact terminal 100 in which the electric wire 2 is inserted between the press contact blades 111*a*, 111*b*, 111*c* can further accurately be grasped.

Seventh Embodiment

Next, an explanation will be given of a seventh embodiment of the invention in reference to FIG. 66 to FIG. 71. Further, portions thereof the same as those of the fifth embodiment are attached with same notations and an explanation thereof will be omitted.

Figure 66:
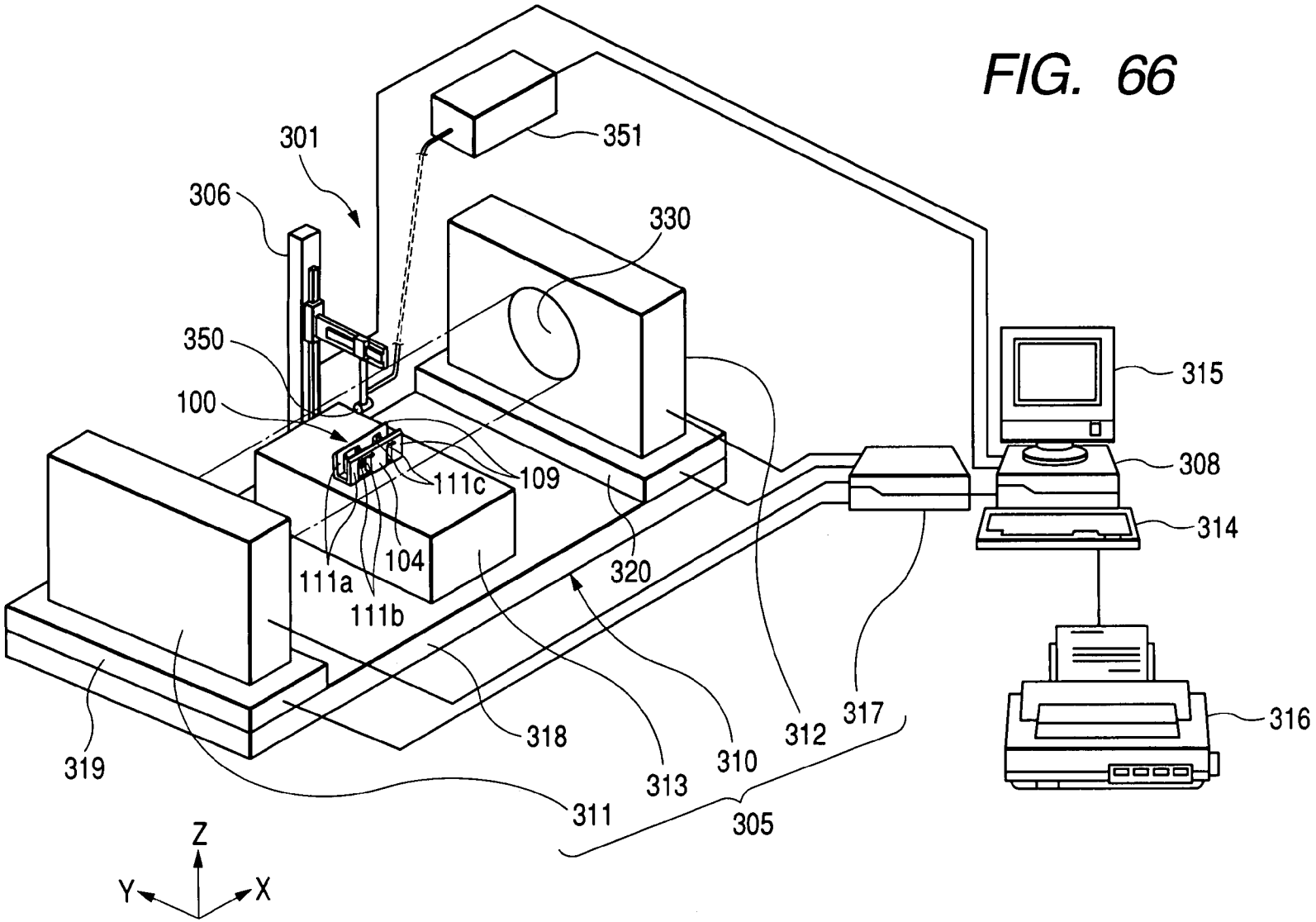
FIG. 66 is an explanatory view showing a constitution of a grasping apparatus according to a seventh embodiment of the invention.
Figure 67:
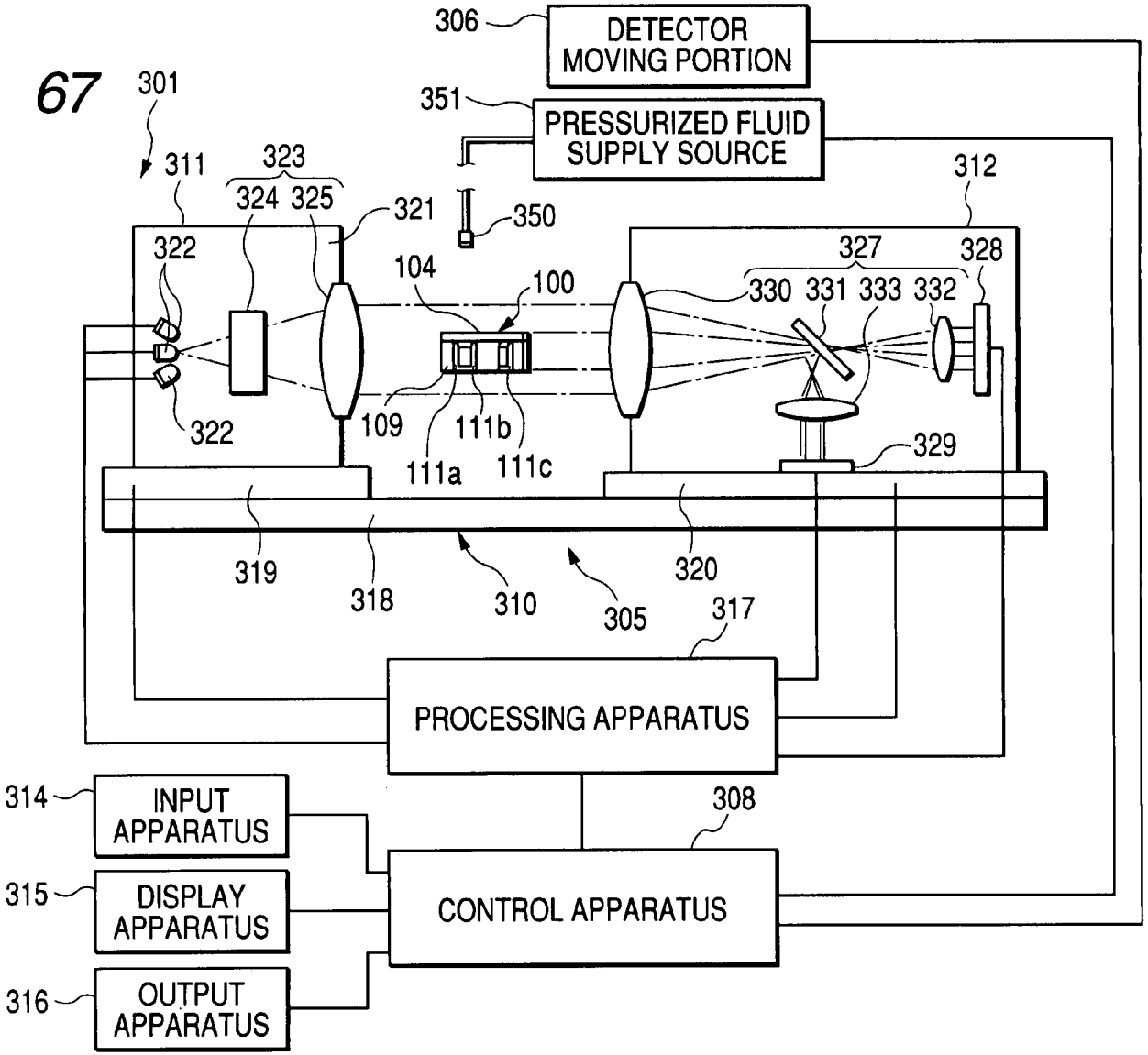
FIG. 67 is a block diagram showing a constitution of the grasping apparatus shown in FIG. 66.

According to the seventh embodiment, an expander 350 is used as a detector as shown by FIG. 66, FIG. 67. The expander 350 is supported by the detector moving portion 306 and is moved along the arrow marks X, Y, Z in FIG. 67 by the detector moving portion 306. The expander 350 is formed in a shape of an expandable and contractable bag. The expander 350 is connected with a pressurized fluid supply source 351.

The expander 350 is expanded by supplying a pressurized oil as a pressurized fluid from the pressurized fluid supply source 351. A width Wb (shown in FIG. 45) of the expander 350 in a maximally expanded state is equal to or larger than the interval D (shown in FIG. 43) between the press contact blades 111*a*, 111*b*, 111*c* and equal to or smaller than the outer diameter R of the core wire 3 of the electric wire 2. The width Wb is the maximum width of the expander 350. In the illustrated example, the width Wb of the expander 350 in the maximally expanded state is equal to the outer diameter R of the core wire 3 of the electric wire 2. The pressurized fluid supply source 351 supplies the pressurized oil as the pressurized fluid to the expander 350. A pressure of the oil supplied into the expander 350 by the pressurized fluid supply source 351 constitutes information in accordance with the contact loads P1, P2 described in the specification. The expander 350 produces information in accordance with the pressure of the oil, that is, the contact loads P1, P2 by being brought into contact with the press contact blades 111*b* by being expanded between the press contact blades 111*b*.

The control apparatus 308 is connected to the pressurized fluid supply source 351. The control apparatus 308 controls the pressure of the oil supplied to the expander 350 by the pressurized fluid supply source 351. The control apparatus 308 is stored with thicknesses of the press contact blades 111*a*, 111*b*, 111*c*.

The control apparatus 308 makes the processing apparatus 317 of the measuring apparatus 305 coincide the optical axes of the collimators 325, 330 before grasping the press contact state of the press contact terminal 100. When the electric wire connecting portion 104 of the press contact terminal 100 is attached to the terminal holding portion 313, the control apparatus 308 makes the processing apparatus 317 pick up the image of the electric wire connecting portion 104. The control apparatus 308 makes the processing apparatus 317 binarize the picked-up image and thereafter calculate the distance h1 (shown in FIG. 31 and FIG. 43) between the outer faces 109*a* of the pair of side walls 109. The distance h1 constitutes the width of the press contact terminal 100 before press contact. The control apparatus 308 is stored with the width h1.

The control apparatus 308 makes the detector moving portion 306 position the expander 350 right above between the press contact blades 111*b* as shown by FIG. 41 and FIG. 43 and thereafter gradually approach the expander 350 to the electric wire connecting portion 104 of the press contact terminal 100 and insert the expander 350 between the press contact blades 111*b* as shown by FIG. 44. The control apparatus 308 supplies the pressurized oil from the pressurized fluid supply source 351 to the expander 350. When the expander 350 starts expanding, the control apparatus 308 stops supplying the oil from the pressurized fluid supply source 351 to the expander 350 and makes the measuring apparatus 305 measure the distance H (shown in FIG. 45) between the outer faces 109*a* of the pair of side walls 109. The control apparatus 308 measures a length L (shown in FIG. 45) of contact portions of the press contact blades 111*b* and the expander 350.

The control apparatus 308 calculates the contact loads P1, P2 (shown in FIG. 45) between the expander 350 and the press contact blades 111*b* by calculating products of the length L of the contact portions, the thicknesses of the press contact blades 111*b* and the pressure of the oil supplied by the pressurized fluid supply source 351. In this way, the control apparatus 308 calculates the contact loads P1, P2 based on the pressure of the oil as the pressurized fluid supplied to the expander 350 by the pressurized fluid supply source 351 and the outer shapes of the press contact blades 111*a*, 111*b*, 111*c* the images of which are picked up by the image pickup portion 312 of the measuring apparatus 305.

The control apparatus 308 calculates the difference between the measured distance H and the distance h1 to thereby calculate the displacements of the pair of side walls 109, that is, the press contact blades 111*b*. The control apparatus 308 calculates the sum of the contact loads P1, P2. The control apparatus 308 is stored with the displacements of the press contact blades 111*b* and the sum of the contact loads P1, P2 which are calculated.

The control apparatus 308 expands the expander 350 to a previously determined size Wb by supplying the pressurized oil from the pressurized fluid supply source 351. That is, the control apparatus 308 further expands the expander 350 between the pair of press contact blades 111*b*. Thereafter, the control apparatus 308 calculates the displacements of the press contact blades 111*b* as described above, calculates the sum of the contact loads P1, P2 and is stored with the calculated values.

The control apparatus 308 expands the expander 350 to the previously determined size Wb. The control apparatus 308 calculates the displacements of the press contact blades 111*b* and the sum of the contact loads P1, P2 until the expander 350 is expanded to the previously determined size Wb. When the expander 350 is expanded to the previously determined size Wb, the control apparatus 308 calculates the relationship between the displacements of the press contact blades 111*b* and the sum of the press contact loads P1, P2 and stop supplying the pressurized oil from the pressurized fluid supply source 351 to the expander 350.

In this way, the control apparatus 308 grasps the press contact state of the electric wire connecting portion 104 of the press contact terminal 100 by calculating the relationship between the displacements of the press contact blades 111*b* and the sum of the contact loads P1, P2.

Next, an explanation will be given of a procedure of grasping the press contact state of the electric wire connecting portion 104 of the press contact terminal 100 by the grasping apparatus 301 of the seventh embodiment.

Figure 68:
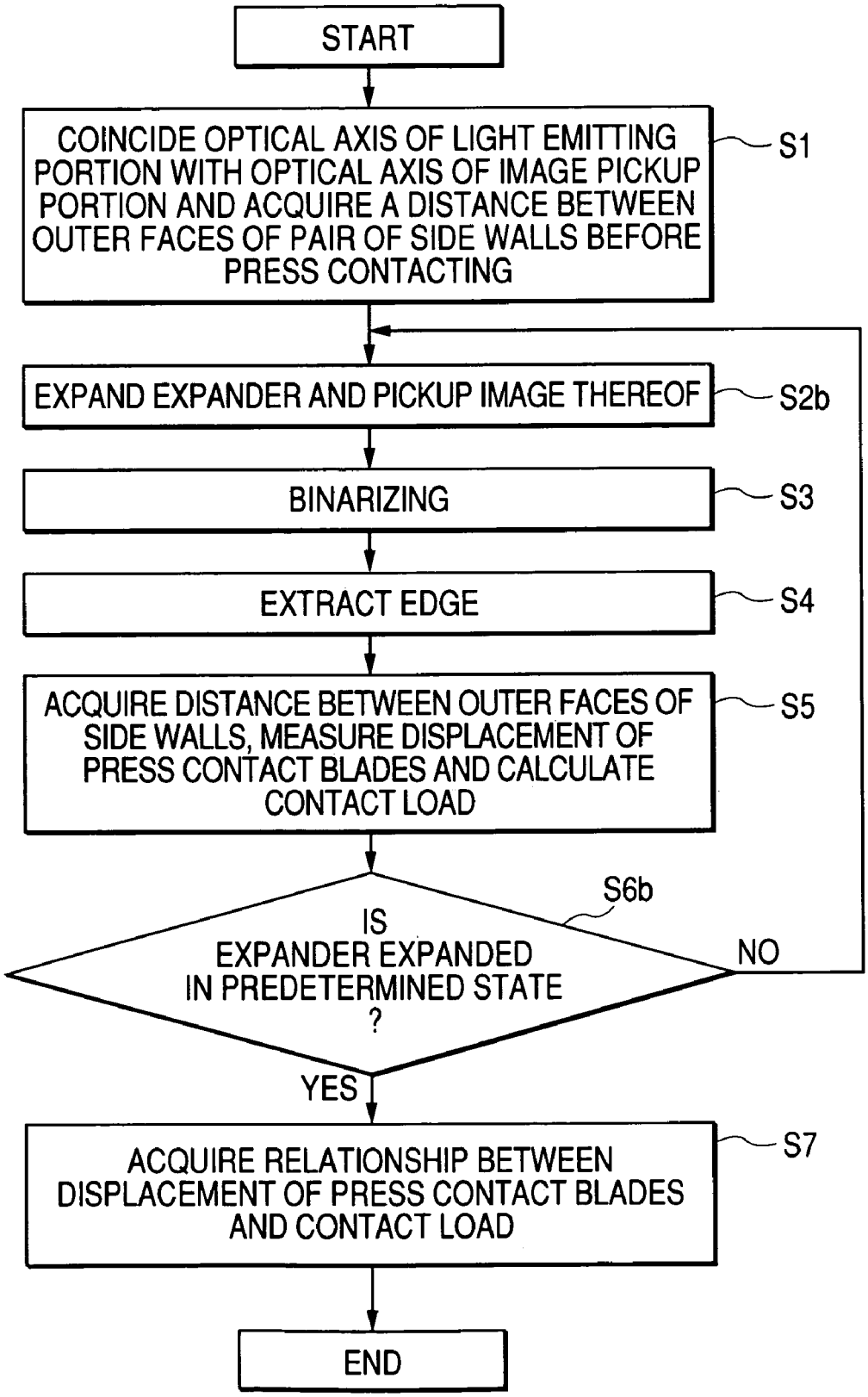
FIG. 68 is a flowchart showing a procedure of grasping a press contact state of a press contact terminal by the grasping apparatus shown in FIG. 66.

First, the grasping apparatus 301 is started at step S1 of FIG. 68. The control apparatus 308 makes the measuring apparatus 305 emit light from the light emitting portion 311 to the image pickup portion 312. The control apparatus 308 makes the processing portion 317 coincide the optical axis of the collimator 325 of the light emitting portion 311 and the optical axis of the collimator 330 of the image pickup portion 312 by driving the respective moving portions 319, 320 based on the optical axis of light provided by receiving light by the optical axis matching image pickup element 328.

The press contact terminal 100, that is, the press contact blades 111*a*, 111*b*, 111*c* are attached to the terminal holding portion 313. At this occasion, the electric wire connecting portion 104, that is, the press contact blades 111*a*, 111*b*, 111*c* are attached to the terminal holding portion 313 in the state in which the longitudinal direction of the electric wire 2 inserted between the press contact blades 111*a*, 111*b*, 111*c* and the optical axis of light emitted by the light emitting portion 311 are in parallel with each other. At this occasion, as shown by FIG. 41 and FIG. 43, the electric wire connecting portion 104 of the press contact terminal 100 is brought into a state before press contact.

The control apparatus 308 makes the processing apparatus 317 emit light from the light emitting portion 311 to the image pickup portion 312 and makes the image pickup portion 312 pick up the image. The control apparatus 308 makes the processing apparatus 317 calculate the distance h1 between the outer faces 109*a* of the pair of side walls 109 to store the calculated distance h1. In this way, at step S1, the distance h1 between the outer faces 109*a* of the pair of side walls 109 of the press contact terminal 100 before press contact is calculated by aligning the optical axis of the light emitting portion 11 and the optical axis of the image pickup portion 312. The operation proceeds to step S2*b*.

At step S2*b*, the control apparatus 308 makes the detector moving portion 306 move the expander 350 and position the expander 50 right above between the press contact blades 111*b* as shown by FIG. 41 and FIG. 43. Thereafter, as shown by FIG. 44, the expander 350 is inserted between the press contact blades 111*b*. The control apparatus 308 supplies the pressurized oil from the pressurized fluid supply source 351 to the expander 350. When the expander 350 is expanded, the pair of side walls 109, that is, the press contact blades 111*b* are gradually separated from each other. The control apparatus 308 stops supplying the oil from the pressurized fluid supply source 351.

The control apparatus 308 makes the processing apparatus 317 emit light from the light emitting portion 311 to the image pickup portion 312 and makes the image pickup portion 312 pick up the image. The image pickup portion 312 is provided with an image G1 (shown in FIG. 69) showing the outer shapes of the pair of side walls 109 and the press contact blades 111*a*, 111*b*, 111*c* viewed from the position along the longitudinal direction of the electric wire 2 at an interval therefrom.

At this occasion, light is emitted from the light emitting portion 11 to the image pickup portion 312 and therefore, in the image G1 provided by the image pickup portion 312, the terminal holding portion 313, the pair of side walls 109 and the press contact blades 111*a*, 111*b*, 111*c* become dark by constituting shadow and the other portion becomes bright. In this way, at step S2*b*, the images of the press contact blades 111*a*, 111*b*, 111*c* of the press contact terminal 100 are picked up. In this way, at step S2*b*, the expander 350 is expanded and the images of the electric wire connecting portion 104 of the press contact terminal 100 are picked up. The operation proceeds to step S3.

Figure 69:
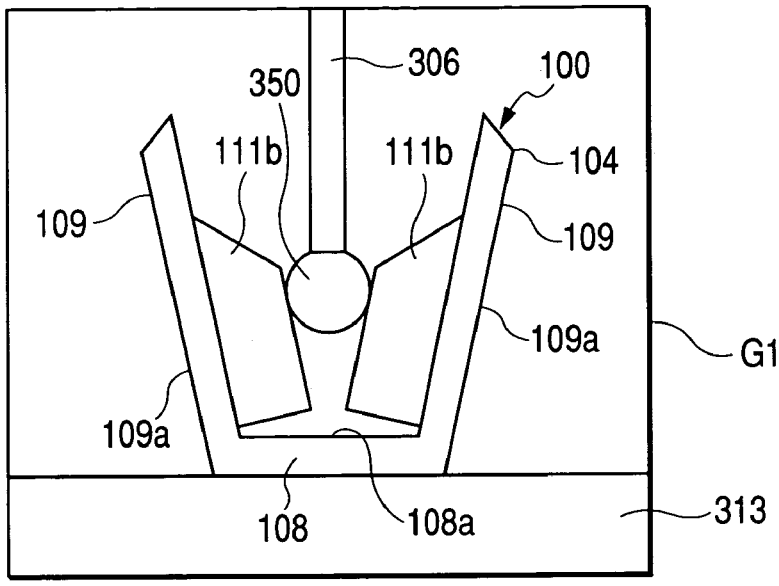
FIG. 69 is an explanatory view showing an image provided at step S2 of the flowchart shown in FIG. 68.
Figure 70:
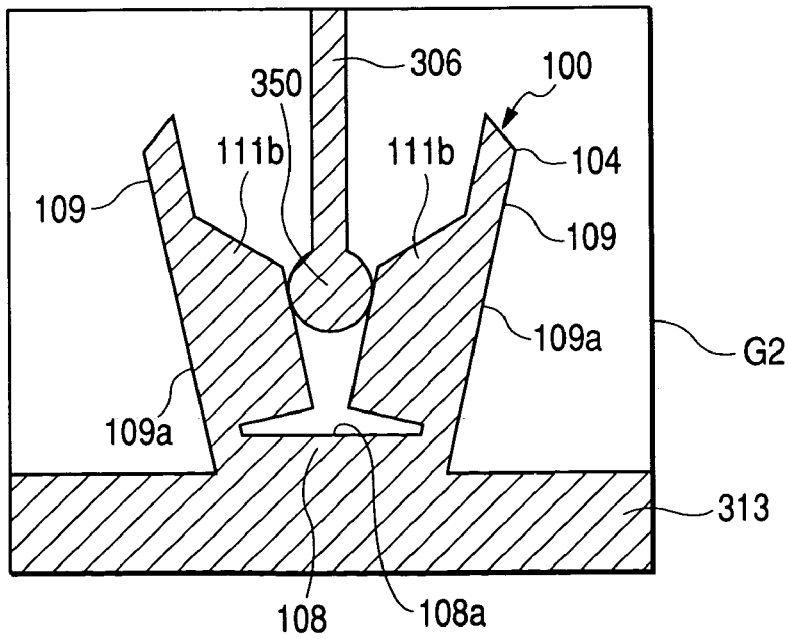
FIG. 70 is an explanatory view showing a binarized image provided by binarizing the image shown in FIG. 69.

At step S3, the binarized image G2 shown in FIG. 70 is provided by binarizing the image G1 shown in FIG. 69 by a predetermined threshold. In the binarized image G2 shown in FIG. 70, the terminal holding portion 313, the pair of side walls 109 and the press contact blades 111*a*, 111*b*, 111*c* shown by parallel hatched lines become black and the other portion becomes white. In this way, at step S3, the binarization is carried out and the operation proceeds to step S4.

Figure 71:
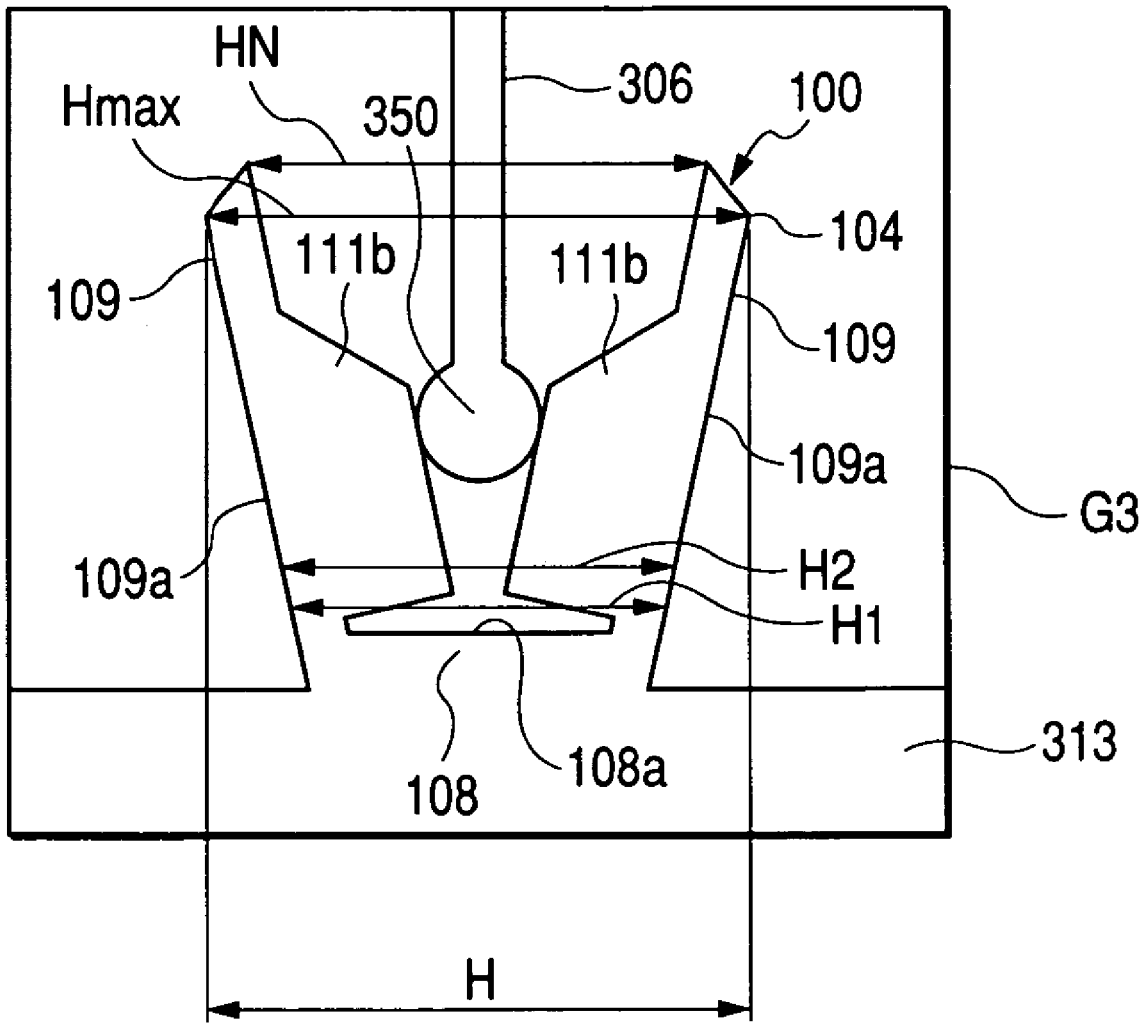
FIG. 71 is an explanatory view showing an image provided by extracting an outer shape (edge) from the binarized image shown in FIG. 70.

At step S4, a boundary of black and white of the binarized image G2, that is, the outer shapes (edges) of the pair of side walls 109, the press contact blades 111*a*, 111*b*, 111*c* and the terminal holding portion 313 are extracted to provide an image G3 shown in FIG. 71. The operation proceeds to step S5.

At step S5, the processing apparatus extracts the surface 108*a* of the bottom wall 108 by the extracted outer shapes (edges), calculates widths H1, H2 . . . HN of the outer shapes (edges) along the surface 108*a* and calculates a maximum width Hmax. The processing apparatus 317 outputs the maximum width Hmax to the control apparatus 308 as the distance H between the outer faces 109*a* of the pair of side walls 109. The control apparatus 308 calculates the difference between the distance H and the h1 and is stored with the difference as the displacements of the press contact blades 111*b*.

At step S5, the control apparatus 308 makes the processing apparatus 317 measure the length L (shown in FIG. 69) of the portions at which the expander 350 and the press contact blades 111*b* are brought into contact with each other. The control apparatus 308 calculates the contact loads P1, P2 between the expander 350 and the press contact blades 111*b* by calculating the products of the pressure of the oil supplied from the pressurized fluid supply source 351 to the expander 350, the length L of the contact portions and the thicknesses of the press contact blades 111*b*. The control apparatus 308 is stored with the sum of the contact loads P1, P2. In this way, at step S5, the distance H between the outer faces 109*a* of the side walls 109 is calculated, the displacements of the press contact blades 111*b* are measured and the contact loads P1, P2 between the expander 350 and the press contact blades 111*b* are calculated. The operation proceeds to S6*b*.

At step S6*b*, the control apparatus 308 determines whether the expander 350 is expanded to the predetermined state (the width becomes Wb) shown in FIG. 42 and FIG. 45. When it is determined that the expander 350 is not expanded to the predetermined state (the width becomes Wb), the operation returns to step S2. At step S2, the control apparatus 308 supplies again the pressurized oil from the pressurized oil supply source 351 to the expander 350. The operation successively proceeds from step S2*b* to step S5 and calculates the displacements of the press contact blades 111*b* and the sum of the contact loads P1, P2 to store. In this way, the control apparatus 308 calculates the displacements of the press contact blades 111*b* and the sum of the contact loads P1, P2 by expanding the expander 350 between the press contact blades 111*b* until the expander 350 is expanded to the predetermined state (the width becomes Wb).

When it is determined that the expander 350 is expanded between press contact blades 111*b* until the predetermined state (the width becomes Wb) at step S6*b*, the operation proceeds to step S7. At step S7, the relationship between the displacements of the press contact blades 111*b* and the contact loads is calculated based on the displacements of the press contact blades 111*b* and the contact loads P1, P2 which are stored as described above.

According to the seventh embodiment, the expander 350 as the detector is inserted between the press contact blades 111*b* and the expander 350 and the expander 350 is expanded between the press contact blades 111*b*. Therefore, in expanding the expander 350 between the pair of press contact blades 111*b*, the press contact blades 111*b*, that is, the pair of side walls 109 are not hampered from separating from each other. Therefore, the contact loads P1, P2 provided by the pressure of the oil as the fluid supplied to the expander 350 become proximate to the contact loads when the electric wire 2 is inserted between the pair of press contact blades 111*b*.

The contact loads P1, P2 calculated by the control apparatus 308 become proximate to contact loads when the electric wire 2 is inserted between the pair of press contact blades 111*b*. Therefore, the press contact state of the press contact terminal 100 in which the electric wire 2 is inserted between the press contact blades 111*b* can accurately be grasped.

In addition to the contact loads P1, P2, the measuring apparatus 305 measures the displacements of the contact blades 111*b*. The relationship between the contact loads P1, P2 and the displacements of the press contact blades 111*b* is grasped. Therefore, the press contact state of the press contact terminal 100 can further accurately be grasped.

The terminal holding portion 313 holds the electric wire connecting portion 104, that is, the press contact blades 111*a*, 111*b*, 111*c* in the state in which the optical axis of light emitted by the light emitting portion 312 between the light emitting portion 311 and the image pickup portion 312 and the electric wire are in parallel with each other. Therefore, the image pickup portion 312 acquires the outer shapes of the press contact blades 111*a*, 111*b*, 111*c* viewed from the position along the longitudinal direction of the electric wire 2 inserted between the press contact blades 111*a*, 111*b*, 111*c* at an interval therefrom. Since the processing apparatus 317 measures the displacements of the press contact blades 111*a*, 111*b*, 111*c* from the acquired outer shapes, the measured displacements of the press contact blades 111*a*, 111*b*, 111*c* become accurate. Therefore, the press contact state of the press contact terminal 100 in which the electric wire 2 is inserted between the press contact blades 111*a*, 111*b*, 111*c* can further accurately be grasped.

There is used the expander 350 inserted between the press contact blades 111*b* of the detector and supplied with the pressurized oil as the pressurized fluid from the pressurized fluid supply source 351. The maximum width Wb of the expander 350 is equal to or larger than the interval between the press contact blades 111*b* and equal to or smaller than the outer diameter R of the core wire 3 of the electric wire 2. Therefore, the state of the press contact blades 111*b* when the expander 350 is expanded between the press contact blades 111*b* and the state of the press contact blades 111*a*, 111*b*, 111*c* when the electric wire 2 is inserted between the press contact blades 111*a*, 111*b*, 111*c* become proximate to each other.

The control apparatus 308 calculates the contact loads P1, P2 by using the expander 350 as the detector and based on the pressure of the pressurized oil as the pressurized fluid supplied by the pressurized fluid supply source 351. Therefore, the accurate contact loads P1, P2 can be provided. Therefore, the press contact state of the press contact terminal 100 inserted with the electric wire 2 between the press contact blades 111*a*, 111*b*, 111*c* can further accurately be grasped.

As described above, the grasping apparatus 301 of the invention inserts the piezoelectric element 307 or the rotor 341 or the expander 350 for producing information in accordance with the contact loads between the press contact blades 111*a*, 111*b*, 111*c* and the piezoelectric element 307 or the rotor 341 or the expander 350 between the press contact blades 111*a*, 111*b*, 111*c*. The grasping apparatus 301 grasps the contact loads between the core wire 3 and the press contact blades 111*a*, 111*b*, 111*c* when the electric wire 2 is inserted between the press contact blades 111*a*, 111*b*, 111*c* based on the information in accordance with contact loads produced by inserting the piezoelectric element 307 or the rotor 341 or the expander 350 thereto.

The grasping apparatus 301 grasps the relationship between the contact loads and the displacements by measuring the displacements of the press contact blades 111*a*, 111*b*, 111*c* when the piezoelectric element 307 or the rotor 341 or the expander 350 is inserted between the press contact blades 111*a*, 111*b*, 111*c*.

Therefore, in inserting the piezoelectric element 307 or the rotor 341 or the expander 350 between the press contact blades 111*a*, 111*b*, 111*c*, the press contact blades 111*a*, 111*b*, 111*c* are not hampered from separating from each other. Therefore, the information in accordance with the contact loads P1, P2 between the piezoelectric element 307 or the rotor 341 or the expander 350 and the press contact blades 111*a*, 111*b*, 111*c* produced by inserting the piezoelectric element 307 or the rotor 341 or the expander 350 becomes proximate to the contact loads when the electric wire 2 is inserted between the press contact blades 111*a*, 111*b*, 111*c*. Therefore, the press contact state of the press contact terminal 100 in which the electric wire 2 is inserted between the press contact blades 111*a*, 111*b*, 111*c* can accurately be grasped.

In addition to the contact loads P1, P2, the displacements of the press contact blades 111*a*, 111*b*, 111*c* are measured. The relationship between the contact loads P1, P2 and the displacements of the press contact blades 111*a*, 111*b*, 111*c* is grasped. Therefore, the press contact state of the press contact terminal 100 can further accurately be grasped.

As has been explained above, according to the invention, the detector is inserted between the press contact blades, therefore, in inserting the detector between the press contact blades, the press contact blades are not hampered from separating from each other. Therefore, the information in accordance with the contact loads between the press contact blades and the detector produced by the detector becomes proximate to the contact loads when the electric wire is inserted between the press contact blades.

In inserting the detector between the press contact blades, the press contact blades are not hampered from separating from each other. Therefore, the characteristic data showing the relationship between the information in accordance with the contact loads between the press contact blades and the detector produced by the detector and the displacements of the press contact blades becomes proximate to the data when the electric wire is actually brought into press contact with the object to be inspected.

Acceptability of the press contact terminal is determined based on the characteristic data and the reference data showing the relationship between the displacements and the contact loads of the press contact blades when the electric wire is brought into press contact with the normal one of the press contact terminal. Since the characteristic data is accurate, acceptability of the press contact terminal can accurately be determined.

According to the invention, the displacements of the press contact blades are measured by bringing the electric wire into press contact with the press contact terminal. Therefore, the displacements of the press contact blades in a state in which the press contact blades are not hampered from separating from each other are measured.

The contact loads between the core wire of the electric wire and the press contact blades are measured based on the previously stored reference data and the measured displacements of the press contact blades. The reference data shows the relationship between the displacements and the contact loads of the press contact blades when the electric wire is brought into press contact with the normal one of the press contact terminal. Since the displacements of the press contact blades in the state in which the press contact blades are not hampered from separating from each other are measured, the measured displacements of the press contact blades are accurate. Therefore, also the predicted contact loads become very proximate to actual values. Therefore, the predicted contact loads are accurate.

Acceptability of the press contact terminal is determined based on the predicted contact loads. Since the predicted contact loads are accurate, acceptability of the press contact terminals can accurately be determined.

According to the invention, the width of the detector is equal to or larger than the interval between the press contact blades and equal to or smaller than the outer diameter of the core wire of the electric wire. Therefore, the state of the press contact blades in inserting the detector between the press contact blades and the state of the press contact blades in inserting the electric wire between the press contact blades become proximate to each other. Therefore, the characteristic data comprising information in accordance with the contact loads produced by inserting the measuring element between the press contact blades becomes accurate. Therefore, acceptability of the press contact terminal can further accurately be determined.

According to the invention, the detector is inserted between the press contact blades. Therefore, in inserting the detector between the press contact blades, the press contact blades are not hampered from separating from each other. Therefore, the information in accordance with the contact loads between the press contact blades and the detector produced by the detector becomes proximate to the contact loads in inserting the electric wire between the press contact blades and the contact loads calculated by the calculating unit become proximate to the contact loads in inserting the electric wire between the press contact blades.

In inserting the detector between the press contact blades, the press contact blades are not hampered from separating from each other. Therefore, the characteristic data showing the relationship between the information in accordance with the contact loads between the press contact blades and the detector produced by the detector and the displacements of the press contact blades measured by the measuring unit becomes proximate to the data when the electric wire is actually brought into press contact with the press contact terminal constituting the object to be inspected.

The determining unit determines acceptability of the press contact terminal based on the characteristic data and the reference data. Since the characteristic data is accurate, acceptability of the press contact terminal can accurately be determined.

According to the invention, the measuring unit measures the displacements of the press contact blades when the inserting unit inserts the electric wire between the press contact blades of the press contact terminal. Therefore, the displacements of the press contact blades in the state in which the press contact blades are not hampered from separating from each other are measured.

The prediction determining unit predicts the contact loads between the core wire of the electric wire and the press contact blades based on the reference data stored by the storing unit and the measured displacements of the press contact blades. The reference data shows the relationship between the displacements and the contact loads of the press contact blades when the electric wire is brought into press contact with the normal one of the press contact terminal. Since the displacements of the press contact blades in the state in which the press contact blades are not hampered from separating from each other are measured, the measured displacements of the press contact blades are accurate. Therefore, also the predicted contact loads become proximate to actual values. That is, the predicted contact loads are accurate.

The prediction determining unit determines acceptability of the press contact terminal based on the predicated contact loads and the measured displacements of the press contact blades. Since the predicted contact loads are accurate, acceptability of the press contact terminal can accurately be determined.

According to the invention, the detector is inserted between the press contact blades. Therefore, in inserting the detector between the press contact blades, the press contact blades are not hampered from separating from each other. Therefore, the information in accordance with the contact loads between the press contact blades and the detector produced by the detector becomes proximate to the contact loads when the electric wire is inserted between the press contact blades and the contact loads calculated by the calculating unit become proximate to the contact loads when the electric wire is inserted between the press contact blades.

In inserting the detector between the press contact blades, the press contact blades are not hampered from separating from each other. Therefore, the characteristic data showing the relationship between the information in accordance with the contact loads between the press contact blades and the detector produced by the detector and the displacements of the press contact blades measured by the measuring unit becomes proximate to the data when the electric wire is actually brought into press contact with the press contact terminal constituting the object to be inspected.

The determining unit determines acceptability of the press contact terminal based on the characteristic data and the reference data. Since the characteristic data is accurate, acceptability of the press contact terminal can accurately be determined.

The measuring unit measures that displacements of the press contact blades when the inserting unit inserts the electric wire between the press contact blades of the press contact terminal. Therefore, the displacements of the press contact blades in the state in which the press contact blades are not hampered from separating from each other are measured.

The prediction determining unit predicts the contact loads between the core wire of the electric wire and the press contact blades based on the reference data stored by the storing unit and the measured displacements of the press contact blades. The reference data shows the relationship between the displacements and the contact loads of the press contact blades when the electric wire is brought into press contact with the normal one of the press contact terminal. Since the displacements of the press contact blades in the state in which the press contact blades are not hampered from separating from each other are measured, the measured displacements of the press contact blades are accurate. Therefore, also the predicted contact loads become proximate to actual values. That is, the predicted contact loads are accurate.

The prediction determining unit determines acceptability of the press contact terminal based on the predicated contact loads and the measured displacements of the press contact blades. Since the predicted contact loads are accurate, acceptability of the press contact terminal can accurately be determined.

According to the invention, the holding portion for holding the press contact terminal is positioned in the state in which the optical axis of light emitted by the light emitting portion between the light emitting portion and the image pickup portion of the measuring unit and the electric wire are in parallel with each other. Therefore, the image pickup portion acquires the outer shape of the press contact terminal viewed from the position along the longitudinal direction of the electric wire inserted between the press contact blades at an interval therefrom. Since the displacements of the press contact blades are measured from the outer shape acquired by the processing portion, the measured displacements of the press contact blades become accurate. Therefore, acceptability of the press contact terminal can further accurately be determined.

According to the invention, the press contact terminal held by the inserting unit is positioned in the state in which the optical axis of light emitted by the light emitting portion between the light emitting portion and the image pickup portion of the measuring unit and the electric wire is in parallel with each other. Therefore, the image pickup portion acquires the outer shape of the press contact terminal viewed from the position along the longitudinal direction of the electric wire inserted between the press contact blades at an interval therefrom. Since the displacements of the press contact blades are measured from the outer shape acquired by the processing portion, the measured displacements of the press contact blades become accurate. Therefore, acceptability of the press contact terminal can further accurately be determined.

According to the invention, the holding portion for holding the press contact terminal is positioned in the state in which the optical axis of light emitted by the light emitting portion between the light emitting portion and the image pickup portion of the measuring unit and the electric wire are in parallel with each other. The press contact terminal held by the inserting unit is positioned in the state in which the optical axis of light emitted by the light emitting portion between the light emitting portion and the image pickup portion of the measuring unit and the electric wire are in parallel with each other.

Therefore, the image pickup portion acquires the outer shape of the press contact terminal viewed from the position along the longitudinal direction of the electric wire inserted between the press contact blades at an interval therefrom. Since the displacements of the press contact blades are measured from the outer shape acquired by the processing portion, the measured displacements of the press contact blades become accurate. Therefore, acceptability of the press contact terminal can further accurately be determined.

According to the invention, the detector is the piezoelectric element and the width of the piezoelectric element is equal to or larger than the interval between the press contact blades and equal to or smaller than the outer diameter of the core wire of the electric wire. Therefore, the state of the press contact bladed in inserting the piezoelectric element between the press contact blades and the state of the press contact blades in inserting the electric wire between the press contact blades become proximate to each other. The piezoelectric element is used as the detector and the calculating unit calculates the contact loads based on the output current of the piezoelectric element. Therefore, the accurate contact loads can be provided. Therefore, acceptability of the press contact terminal can further accurately be determined.

According to the invention, the detector is the rotor inserted between the press contact blades and driven to rotate by the drive source and both of the maximum width and the minimum width of the rotor are equal to or larger than the interval between the press contact blades and equal to or smaller than the outer diameter of the core wire of the electric wire. Therefore, the state of the press contact blades in rotating the rotor between the press contact blades and the state of the press contact blades in inserting the electric wire between the press contact blades become proximate to each other. The rotor is used as the detector and the calculating unit calculates the contact loads based on the torque of rotating the rotor. Therefore, the accurate contact loads can be provided. Therefore, acceptability of the press contact terminal can further accurately be determined.

According to the invention, the detector is the expander inserted between the press contact blades and expanded by supplying the pressurized fluid from the pressurized fluid supply source and the maximum width of the expander is equal to or larger than the interval between the press contact blades and equal to or smaller than the outer diameter of the core wire of the electric wire. Therefore, the state of the press contact blades in expanding the expander between the press contact blades and the state of the press contact blades in inserting the electric wire between the press contact blades become proximate to each other. The expander is used as the detector and the calculating unit calculates contact loads based on the pressure of the pressurized fluid supplied by the pressurized fluid supply source. Therefore, the accurate contact loads can be provided. Therefore, the state of bringing the electric wire into press contact with the press contact terminal in inserting the electric wire between the press contact blades can further accurately be grasped.

As has been explained above, according to the invention, the outer shapes of the electric wire, the pair of side walls and the press contact blades viewed from the position along the longitudinal direction of the press contact terminal and the electric wire at an interval therefrom are acquired. The center of the electric wire is calculated from the acquired outer shapes. Since the outer shapes viewed from the position along the longitudinal direction of the electric wire at an interval therefrom is acquired, the calculated position of the center of the electric wire is accurate.

The distance between the outer faces of the pair of side walls passing the center of the electric wire is calculated. Therefore, the distance between the outer faces of the pair of side walls always passing the center of the electric wire is measured, the position of the center is accurate and therefore, the measured distance between the outer faces of the pair of side walls becomes accurate.

Therefore, the distance between the outer faces of the pair of side walls always passing the center of the electric wire is Measured and therefore, the measured portion can be prevented from being dispersed at each measurement. The center of the electric wire can accurately be calculated. Therefore, the distance between the outer faces of the pair of side walls, that is, the width of the press contact terminal can accurately be measured.

According to the apparatus of measuring a width of a press contact terminal in press contact of the invention, the terminal holding portion holds the press contact terminal press fit with the electric wire between the press contact blades in the state in which the optical axis of light emitted by the light emitting portion between the light emitting portion and the image pickup portion and the electric wire are in parallel with each other. Therefore, the image pickup portion acquires the outer shapes of the electric wire, the pair of side walls and the press contact blades viewed from the position along the longitudinal direction of the electric wire at an interval therefrom. The processing portion calculates the center of the electric wire from the acquired outer shape. Since the outer shapes viewed from the position along the longitudinal direction of the electric wire at an interval therefrom are acquired, the calculated position of the center of the electric wire is accurate.

The processing portion measures the distance between the outer faces of the pair of side walls passing the center of the electric wire. Therefore, the distance between the outer faces of the pair of side walls always passing the center of the electric wire is measured, the position of the center is accurate and therefore, the measured distance between the outer faces of the pair of side walls becomes accurate.

Therefore, since the distance between the outer faces of the pair of side walls always passing the center of the electric wire is measured, the measured position can be prevented from being dispersed at each measurement. The center of the electric wire can accurately be measured. Therefore, the distance between the outer faces of the pair of side walls, that is, the width of the press contact terminal can accurately be measured.

As has been explained above, the invention described inserts the detector between the press contact blades. Therefore, in inserting the detector between the press contact blades, the press contact blades are not hampered from separating from each other. Therefore, the information in accordance with the contact loads between the press contact blades and the detector produced by the detector becomes proximate to the contact loads when the electric wire is inserted between the press contact blades. Therefore, the press contact state of the press contact terminal inserted with the electric wire between the press contact blades can accurately be grasped.

According to the invention, the displacements of the press contact blades are measured in addition to the contact loads. The relationship between the contact loads and the displacements of the contact blades is grasped. Therefore, the contact state of the press contact terminal can further accurately be grasped.

According to the invention, the width of the detector is equal to or larger than the interval between the press contact blades and equal to or smaller than the outer diameter of the core wire of the electric wire. Therefore, the state of the press contact blades when the detector is inserted between the press contact blades and the state of the press contact blades when the electric wire is inserted between the press contact blades become proximate to each other. Therefore, the press contact state of the press contact terminal inserted with the electric wire between the press contact blades can further accurately be grasped.

According to the invention, the detector is inserted between the press contact blades. Therefore, in inserting the detector between the press contact blades, the press contact blades are not hampered from separating from each other. Therefore, the information in accordance with the contact loads between the press contact blades and the detector produced by the detector becomes proximate to the contact loads when the electric wire is inserted between the press contact blades and the contact loads calculated by the calculating unit become proximate to the contact loads when the electric wire is inserted between the press contact blades. Therefore, the press contact state of the press contact terminal inserted with the electric wire between the press contact blades can accurately be grasped.

According to the invention, the measuring unit measures the displacements of the press contact blades in addition to the contact loads. The relationship between the contact loads and the displacements of the press contact blades is grasped. Therefore, the press contact state of the press contact terminal can further accurately be grasped.

According to the invention, the measuring unit is provided with the holding portion for holding the press contact blades in the state in which the optical axis of light emitted by the light emitting portion between the light emitting portion and the image pickup portion and the electric wire are in parallel with each other. Therefore, the image pickup portion acquires the outer shapes of the press contact blades viewed from the position along the longitudinal direction of the electric wire inserted between the press contact blades at an interval therefrom. Since the displacements of the press contact blades are measured from the outer shapes acquired by the processing portion, the measured displacements of the press contact blades become accurate. Therefore, the press contact state of the press contact terminal inserted with the electric wire between the press contact blades can further accurately be grasped.

According to the invention, the detector is the piezoelectric element and the width of the piezoelectric element is equal to or larger than the interval between the press contact blades and equal to or smaller than the outer diameter of the core wire of the electric wire. Therefore, the state of the press contact blades when the piezoelectric element is inserted between the press contact blades and the state of the press contact blades when the electric wire is inserted between the press contact blades become proximate to each other. The piezoelectric element is used as the detector and the calculating unit calculates the contact loads based on the output current of the piezoelectric element. Therefore, the accurate contact loads can be provided. Therefore, the press contact state of the press contact terminal inserted with the electric wire between the press contact blades can further accurately be grasped.

The according to the invention, the detector is the rotor inserted between the press contact blades and driven to rotate by the drive source and both of the maximum width and the minimum width of the rotor are equal to or larger than the interval between the press contact blades and equal to or smaller than the outer diameter of the core wire of the electric wire. Therefore, the state of the press contact blades when the rotor is rotated between the press contact blades and the state of the press contact blades when the electric wire is inserted between the press contact blades become proximate to each other. The rotor is used as the detector and the calculating unit calculates the contact loads based on the torque of rotating the rotor. Therefore, the accurate contact loads can be provided. Therefore, the press contact state of the press contact terminal inserted with the electric wire between the press contact blades can further accurately be grasped.

According to the invention, the detector is expander inserted between the press contact blades and expanded by being supplied with the pressurized fluid from the pressurized fluid supply source and the maximum width of the expander is equal to or larger than the interval between the press contact blades and equal to or smaller than the outer diameter of the core wire of the electric wire. Therefore, the state of the press contact blades when the expander is expanded between the press contact blades and the state of the press contact blades when the electric wire is inserted between the press contact blades are proximate to each other. The expander is used as the detector and the calculating unit calculates the contact loads based on the pressure of the pressurized fluid supplied by the pressurized fluid supply source. Therefore, the accurate contact loads can be provided. Therefore, the press contact state of the press contact terminal inserted with the electric wire between the press contact blades can further accurately be grasped.

What is claimed is:

1. A method of determining acceptability of a press contact terminal including press contact blades which are separated from each other when a wire is inserted between the press contact blades so that a core wire of the wire is electrically connected to the press contact terminal, the method comprising the steps of:

storing a reference data showing a relationship between displacement of the press contact blades when the wire is brought into press contact with a normal one of the press contact terminal and contact loads between the press contact blades and the core wire;

inserting the wire between the press contact blades of the press contact terminal as an object to be inspected;

measuring the displacement of the press contact blades caused by the insertion of the wire; and determining the acceptability of the press contact terminal as the object to be inspected by predicting the contact loads between the press contact blades of the press contact terminal as the object to be inspected based on the measured displacement and the reference data.

* * * * *